US006289999B1

(12) United States Patent
Dewey et al.

(10) Patent No.: US 6,289,999 B1
(45) Date of Patent: Sep. 18, 2001

(54) FLUID FLOW CONTROL DEVICES AND METHODS FOR SELECTIVE ACTUATION OF VALVES AND HYDRAULIC DRILLING TOOLS

(75) Inventors: Charles H. Dewey; Wei Xu, both of Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/183,692

(22) Filed: Oct. 30, 1998

(51) Int. Cl.[7] ..... E21B 44/00

(52) U.S. Cl. ..... 175/38; 175/87; 175/232; 175/318

(58) Field of Search ..... 175/38, 87, 231, 175/232, 267, 315, 317, 318; 166/102, 319

(56) References Cited

U.S. PATENT DOCUMENTS

| | | | | |
|---|---|---|---|---|
| 3,901,333 | * | 8/1975 | Mori | 175/318 |
| 4,667,743 | | 5/1987 | Ringgenberg et al. | 166/321 |
| 5,070,950 | * | 12/1991 | Cendre et al. | 175/232 |
| 5,273,113 | | 12/1993 | Schultz | 166/250 |
| 5,318,137 | | 6/1994 | Johnson et al. | 175/40 |
| 5,318,138 | | 6/1994 | Dewey et al. | 175/74 |
| 5,332,048 | | 7/1994 | Underwood et al. | 175/26 |
| 5,343,963 | * | 9/1994 | Bouldin et al. | 175/38 |
| 5,392,867 | * | 2/1995 | De Chaffaut et al. | 175/38 |
| 5,437,308 | * | 8/1995 | Morin et al. | 175/38 |
| 5,443,129 | | 8/1995 | Bailey et al. | 175/45 |
| 5,518,073 | | 5/1996 | Manke et al. | 166/240 |
| 5,558,162 | | 9/1996 | Manke et al. | 166/319 |
| 5,979,572 | * | 11/1999 | Boyd et al. | 175/318 |

FOREIGN PATENT DOCUMENTS

| | | |
|---|---|---|
| 0344060 | 11/1989 | (EP) . |
| 0500343 | 8/1992 | (EP) . |
| 2211221 | 6/1989 | (GB) . |
| 2264135 | 8/1993 | (GB) . |
| 2302349 | 1/1997 | (GB) . |

OTHER PUBLICATIONS

Search Report for Application No. GB 9925577.0 from UK Patent Office Dated Mar. 24, 2000 (3 p.).

Halliburton, TRACS™ Adjustable Stabilizer, Telemetry Regulated Angle Control System Improve Drilling Efficiency, Maximize Drilling Control, © 1997 Halliburton Energy Services, Inc.

* cited by examiner

*Primary Examiner*—William Neuder
(74) *Attorney, Agent, or Firm*—Conley, Rose & Tayon

(57) ABSTRACT

Flow control devices and associated control methods are described for use with hydraulic tools, such as those in a drill string. The described flow control device is typically incorporated into a drill string and is selectively operable in either a flow-through mode or a valve control mode. In the valve control mode, fluid pressure is increased or decreased within the drill string to selectively actuate a valve which is associated with the flow control device. In the flow-through mode, fluid pressure may be increased or decreased without operating the valve. Techniques are described for selectively moving the flow control device between the flow-through mode and the valve control mode. Wellbore fluid pressure readings provide signals to a rig operator for selectively moving the device in this manner.

52 Claims, 39 Drawing Sheets

FLUID FLOW CONTROL DEVICES AND METHODS FOR SELECTIVE ACTUATION OF VALVES AND HYDRAULIC DRILLING TOOLS

BACKGROUND OF THE INVENTION

1. Field of the Invention

The invention relates broadly to methods and devices for selective control of valves or other downhole devices. In one particular aspect, the invention provides a signal indicating an opportunity for altering the operational mode of the downhole device. Further, the invention relates to means for remotely altering the operational mode of a component within a well bore.

2. Description of the Related Art

A number of hydraulic tools, such as a borehole underreamer, a section mill and so forth, function by extending and retracting, through manipulation of hydraulic pressure, cutter blades from the interior of a body of the underreamer to selectively ream a portion of a borehole. A means is required to extend or retract the moveable blades of the underreamer as it is operated in the borehole.

An early method to perform, for example, underreaming operations required the drill string to be tripped out of the borehole, other tools removed from the string, and the underreamer attached to the drill string. The whole assembly was then tripped back into the borehole. Increasing fluid pressure within the drill string then extended the underreamer blades. After the underreaming operation was completed, the procedure was reversed to remove the underreamer from the drill string. One disadvantage to this method is that no other tools, such as a drill bit assembly, MWD assembly, adjustable stabilizers, or the like, can be operated without also operating the underreamer. Obviously, this procedure is also costly, especially if the depth of the borehole is in the thousands of feet.

Another, more cost effective method, attaches a hydraulically actuatable underreamer to a drill string and when a desired depth is reached for commencement of the underreaming operation, a plug or "dart" is retrieved by wireline through the interior of the drill string to allow differential pressure to actuate the underreamer. When the underreamer operation is completed, the dart can be dropped back into the borehole to deactivate the tool. Hydraulic pressure can no longer open the underreamer.

Again, the method of controlling the tool is costly since the drilling operation is interrupted when the dart is moved in and out of the borehole. Moreover, in other hydraulically actuatable tools that are indexed to alternate positions by manipulation of flow, the tool generally has to be reset to the desired position each time hydraulic circulation is interrupted.

Still another method to control hydraulic actuatable tools such as anchors, valves, packers or underreamers is the use of shear pins designed to shear under specific hydraulic pressure loads to cause the aforementioned tools to perform in a predetermined manner and perform a specific function. These systems are disadvantaged in that they are one time mechanisms. Once the pins are sheared, the tool cannot be reset. The presence of debris within the borehole or sudden impacts to these tools may index or even weaken or shear triggering devices prematurely.

An example of an apparatus and method for orienting and setting a hydraulically-actuatable tool in a borehole is taught in U.S. Pat. No. 5,443,129. The patent is assigned to the same assignee as the present application and incorporated herein, by reference. The method of setting a hydraulically-actuatable tool and commencing drilling in a single trip of the drill string includes the steps of running the hydraulically-actuatable tool into the borehole on a drill string which includes an MWD (measurement while drilling) subassembly. The MWD subassembly senses the orientation of the hydraulically-actuatable tool, orients the drill string to the desired position and sets the hydraulically-actuatable tool. The tool is set by increasing the hydraulic pressure within a bypass valve positioned below the MWD subassembly to a predetermined level that will shear a shear pin in the bypass valve which allows a piston retained within the valve body to close off flow bypass ports and to direct the increased hydraulic pressure to activate the tool (for example an anchor-packer assembly) downstream of the valve.

Other hydraulically-actuatable tools utilize a combination of downhole MWD and microprocessor telemetering systems to manipulate the tools such that the tools perform in a predictable or programmed manner dependent upon conditions encountered downhole while drilling. U.S. Pat. Nos. 5,318,137, 5,318,138 and 5,332,048 relate to a method and apparatus for adjusting the position of stabilizer cutter blades utilizing the aforementioned telemetering systems. These systems are complex and rely on the workability and accuracy of MWD and microprocessing apparatus for communicating the information up the drill string to the data processing equipment at or near the borehole platform, a sometimes troublesome process. Microprocessor-based tools are also expensive.

U.S. Pat. No. 5,518,073 teaches a mechanical lockout for pressure responsive downhole tools. A tester ball valve may be opened or closed upon reaching a desired borehole depth and after a packer assembly is set below the valve. The tester valve is actuated by increasing the well annulus pressure to a level above hydrostatic pressure to move a power piston associated with the valve, thus moving the ball valve from a closed position to an open position. During operation, well annulus pressure can be cycled between hydrostatic pressure and a higher pressure level to open or close the tester valve. The valve uses hydraulic fluid such as oil to drive a valve actuating piston when the annulus pressure exceeds hydrostatic pressure in combination with nitrogen under pressure to return the piston to an initial position when the annulus pressure is reduced. Alternatively, the valve may be opened or closed by increasing annulus pressure in two different stages, the second stage requiring the annulus pressure to be considerably higher than the first stage.

In order for the tester valve to function, a packer assembly must first be actuated to seal off the borehole downstream of the valve so that the annulus pressure can be increased sufficiently to cause the valve to cycle either open or closed. Moreover, if it is desired to insert the tester valve in a closed position, sliding valve actuating members must be locked together for the valve to cycle properly from the closed position to the opened position. Once the members are locked together, they cannot be separated. Further, the apparatus of U.S. Pat. No. 5,518,073 requires multiple levels of positive pressure to be applied downhole. It cannot be used by merely turning surface-based pumps on and off.

The present invention overcomes the deficiencies in the prior art.

SUMMARY OF THE INVENTION

The present invention is directed to control devices and methods which can be selectively manipulated without depending upon a non-reversable mechanism, such as a predetermined ratchet path or shear pins or other one-time use mechanisms. In one described embodiment, an underreamer is actuated to selectively extend and retract the cutter assemblies. The invention provides the advantage of permitting multiple actuations of such devices. As a result, it is possible, for example, to underream several different sections within a wellbore as desired while the well is being drilled without having to pull the drill string from the wellbore.

In a second described embodiment, a bypass valve is actuated to selectively open and close the valve member.

The control arrangements of the present invention permit a controlled device to be placed into a flow-through mode wherein surface-based fluid pumps can flow fluid through or past the controlled device, and allow the pumps to be turned on or turned off without actuating the controlled device. The control arrangement also permits the controlled device to be taken out of the flow-through mode and placed into a valve control mode so that manipulation of the surface-based fluid pumps will selectively actuate the controlled device. Thus, a wellbore operator may selectively "lock out" actuation of the controlled device so that variations in fluid pressure within the drill string will not operate the controlled device. Multiple positive pressure levels are not required to cause this selective locking out to occur. Another advantage of the present invention is that a positive indication is provided to an operator at the surface of the presence of a "window of opportunity" during which the tool may be moved into or out of a valve control mode. Pressure differentials are used to drive a piston during the "window of opportunity" for the flow control device to move from one position to another.

In another aspect of the invention, strategically positioned flow restrictors formed in the flow sub housing downstream of the actuating mechanism, create momentary pressure spikes which can be readily detected on the rig platform when an actuating piston cycles downwardly in the sub housing. If it is desired to move the assembly into a flow-through mode, the pumps are stopped during a first pressure spike thus securing a floating position collet in a first position within the flow sub housing. Should it be desired to move the assembly out of a flow-through mode and activate the controlled device, surface-based pumps are stopped during a second pressure spike which prepares the floating position collet to be moved to a second position when the surface-based pumps are subsequently turned back on. When moved out of the flow control mode, the flow control mechanism allows the actuating piston additional downward travel within the sub housing to, for example, open a valve associated with the movement of the piston. The valve might be used to operate an underreamer or other hydraulically actuatable device. Alternatively, the valve might be used to divert a portion of fluid flow elsewhere in the manner of a bypass valve.

The control device for hydraulic drilling tools has an advantage over the foregoing prior art in that it needs no wirelines, MWD subassemblies, shear pins, non-reversing stepping devices or packers in order to generate very high pressures to actuate a valve or divert hydraulic flow.

Another object of this invention is to provide a means to remotely control the flow of drilling fluid to actuate hydraulically operable tools without the use of irreversible mechanisms or the necessity of tripping out of the borehole to manipulate the tools.

A remotely readable means communicates the axial position of the piston within the body and provides an indication to a surface operator of the position of a reciprocable piston within the flow control assembly.

The flow control apparatus will remain in the last set position when the piston is allowed to stroke without stopping during pump operation. It will also remain in the last set position if the pumps are turned off thus assuring reliable operation of the flow control apparatus despite flow interruptions or sudden impacts to the apparatus.

The flow control sub-assembly is capable of positioning itself in such a manner as to open or close off ports that control flow characteristics of hydraulic tools such as, for example, hydraulically actuatable underreamers or bypass subs. The tool contains a piston that cycles downstream in one direction when drilling fluid is circulating and is pushed in a reversing direction by a spring force when fluid circulation is stopped. The pressure differential to drive the piston results from a fluid pressure within the drill string which is greater than that in the annulus between the drill string and the borehole during circulation. The speed at which the piston strokes is controlled by a metering valve or restriction between two chambers formed within a sub-assembly housing. The first chamber is formed between the piston and a bulkhead that contains a metering valve. The second chamber is formed between the bulkhead and a second floating piston that is backed by the return spring. When circulation begins, the piston is forced downstream reducing the volume of fluid in the first chamber, thus forcing fluid through the metering valve and into the second chamber. When circulation is stopped, the spring force pushes the fluid back from the second chamber to the first chamber thereby stroking the piston back within its housing.

First and second pressure spikes are generated within the sub-assembly when the piston is stroked upon starting the fluid pump by providing strategically positioned flow restrictions at the downstream end of the housing. Two flow actuating positions within the sub housing are achieved by a floating position collet concentrically located over a catch collet fixed to the stroking piston. A positioning ring extending radially inwardly and outwardly from the floating position collet engages one of a pair of axially separated, radially aligned grooves formed in the piston bore sleeve only when the fluid pumps are stopped by the rig operator when the piston strokes over (and slightly past) the first or the second downstream flow restriction.

The flow control sub-assembly opens and closes ports based on how far the mechanism is allowed to stroke within its housing. The amount of stroke is controlled by the positioning of a floating position collet within the housing of the flow control assembly. When the floating position collet is moved to a lower position within the housing, it allows the piston to stroke further downstream within the sub housing as well. This additional downstream stroke of the piston within its sleeved housing will allow a valve associated with the piston to be selectively opened and closed.

An advantage then of the present invention over the prior art is that the flow control devices described do not change position or operation based on an interruption in flow circulation such as making a drill string connection. When resuming normal operations, the devices do not need to be reset. Sudden impacts to the flow control devices described will not change the characteristics of their functioning since they do not depend upon use of shear pins or non-reversing indexing devices.

A further advantage of the present invention is that the flow control devices can be placed into a flow-through mode wherein operation of an associated valve assembly is not possible, thereby preventing inadvertent operation of the valve assembly.

The above noted objects and advantages of the present invention will be more filly understood upon a study of the following description in conjunction with the detailed drawings.

BRIEF DESCRIPTION OF THE DRAWINGS

FIG. 2 is a time vs. pressure graph illustrating a first, second and third pressure spikes occurring with the flow pump on.

FIGS. 5A and B illustrate a cross-section of portions of the flow control assembly configured so as to be moved out of the flow-through mode and into a valve control mode when the surface-based pumps are turned on.

FIGS. 12A, B, C and D illustrate a partial cross-section of the bypass valve assembly of FIGS. 11A, B, C and D, still in a flow-through mode, after surface-based fluid pumps have been turned on.

DESCRIPTION OF THE PREFERRED EMBODIMENTS

Certain well known techniques for the attachment or construction of components, such as the use of O-rings for fluid tightness may not be described in detail herein as such are well understood by those of skill in the art.

Figure 1:
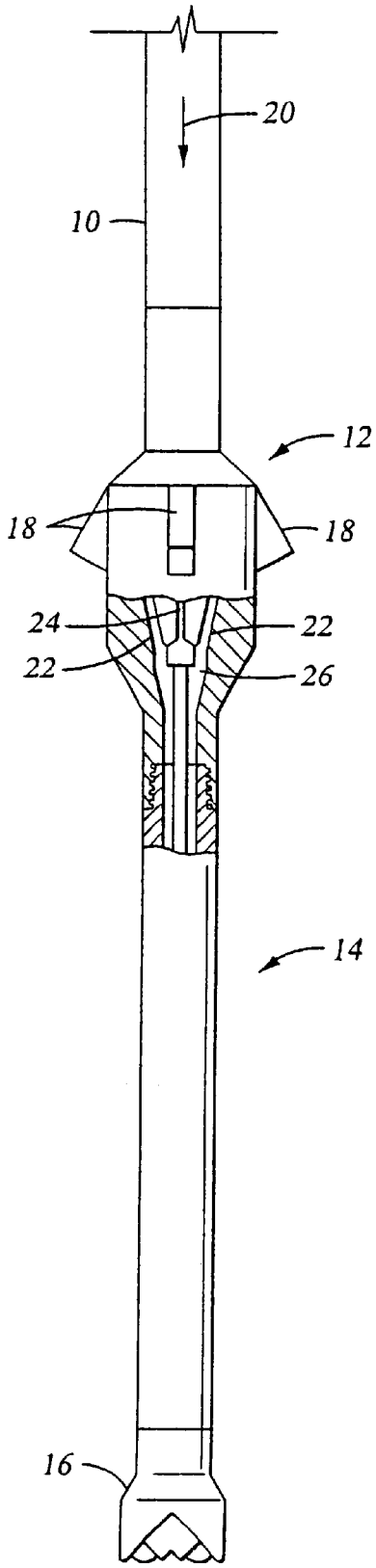
FIG. 1 is a partial cross-section of a drill string with a fluid control assembly located between an underreamer and a rock bit.

Referring first to FIG. 1, a drill string 10 is shown having an underreamer device 12, of a type well known in the art, affixed to its lower end. A flow control apparatus 14 is incorporated within the drill string 10 connecting the underreamer 12 to a drill bit assembly 16. The underreamer 12 is equipped with cutter blades 18 that are capable of extending and retracting radially with respect to the axis of the drill string 10 to underream a section of a wellbore. The underreamer 12 preferably comprises a hydraulic underreamer of the type described in greater detail in U.S. patent application Ser. No. 60/106,252, filed on Oct. 30, 1998 which is entitled "Remotely Operable Hydraulic Underreamer" and is assigned to the assignee of the present invention. That application is incorporated herein by reference. It is noted, however, that conventional underreamers may be adapted for use with the present invention as well.

As is well known, the drill string 10 is typically disposed within a wellbore (not shown) into which it is desired to drill using the drill bit assembly 16 and also to underream using the underreamer 12. Hydraulic fluid is flowed downward through the drill string 10 in the direction of arrow 20 under the impetus of a hydraulic pump (not shown) located at the surface of the well. Fluid flowing in the direction indicated by arrow 20 is said to be flowing in a "downstream" direction, meaning away from the hydraulic pump at the surface of the well. In accordance with this convention, components which are located further from entrance of the wellbore are described as being "downstream" from components which are located "upstream" or closer to the entrance. Similarly, the terms "up," "down," "upward,"

"downward," "above," "below" and so forth, as used herein, are intended to describe the relationship of components as if disposed within a wellbore with respect to the entrance of the wellbore. Thus, a component described as being "below" another component is disposed further away from the entrance as measured along the borehole path.

The hydraulic fluid passes through the underreamer 12 via lateral fluid passages 22 and into the flow control apparatus 14 where it can be transmitted toward the bit assembly 16 for lubrication of the bit assembly 16 during drilling operation. A central flow passage 24 extends through the approximate center of a portion of the underreamer 12, and fluid passing upward through the central passage 24 will operate the underreamer 12 so as to laterally extend the cutting blades 18 so that underreaming can be performed. The underreamer 12 is typically designed so that the cutting blades 18 retract back into the body of the underreamer 12 when hydraulic pressure is cut off at the surface. The purpose of the flow control apparatus 14, in this embodiment, is to open or close the central passage 24. The flow control apparatus 14 is used to selectively actuate a valve assembly 26 between open and closed positions. With the valve assembly 26 in a closed position (shown in FIG. 1), essentially all fluid flowing downward through the drill string 10 will pass through the lateral passages 22 toward the drill bit 16 and is blocked from entering the central passage 24. When the valve assembly 26 is in an open position, a portion of the fluid flowing downward through the lateral passages 22 will be permitted to enter the central passage 24, thus actuating the underreamer 12.

Structure of the Exemplary Flow Control Assembly 14

Figure 3A:
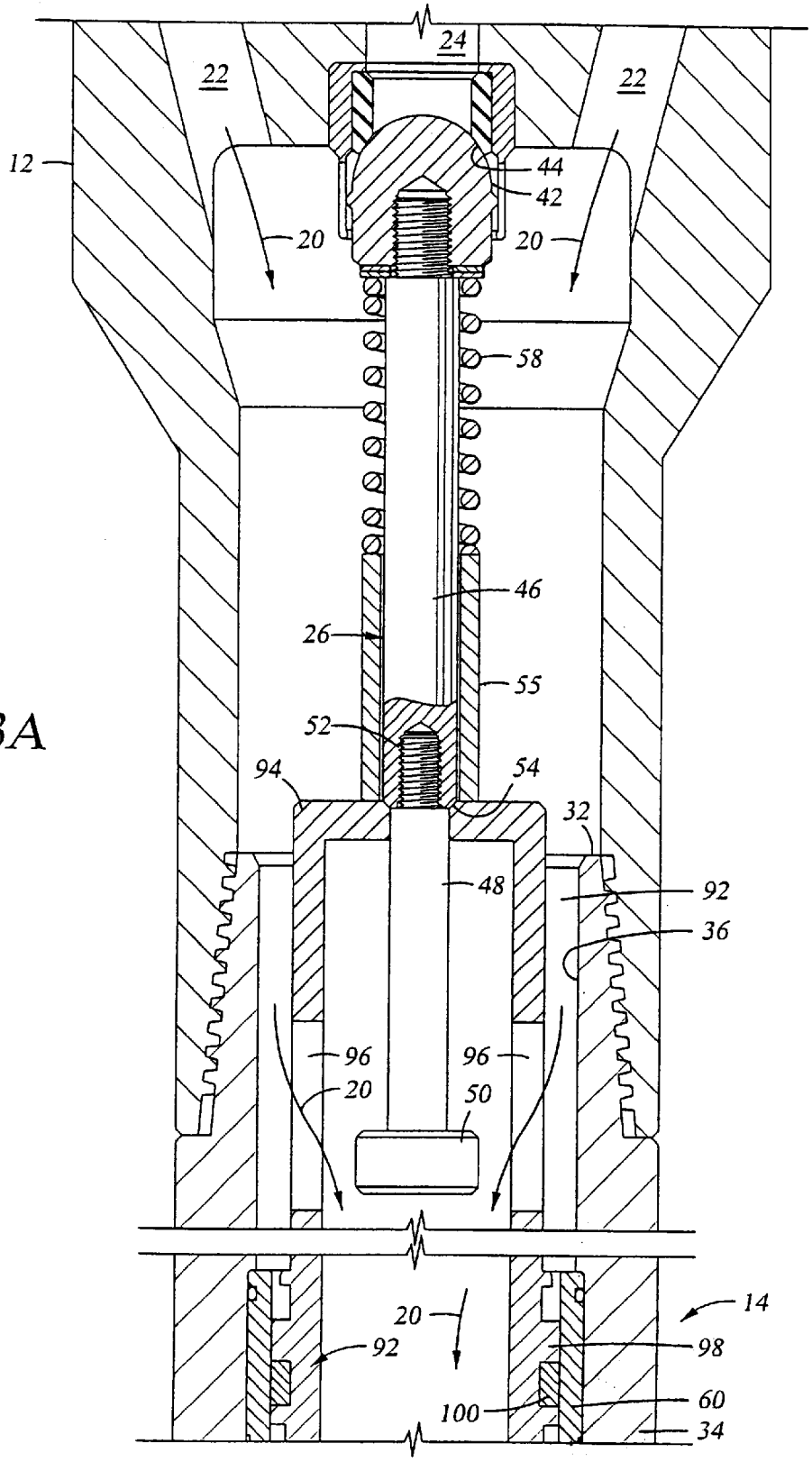
FIGS. 3A, B, C and D illustrate a cross-section of an exemplary flow control assembly constructed in accordance with a first embodiment of the invention. The flow control assembly is shown set in a "flow-through" mode with surface-based fluid pumps turned off.

FIGS. 3A, B, and C depict a flow control assembly 14 configured in a "flow-through" mode wherein fluid pressure within the drill string 10 may be increased or decreased without actuation of the underreamer 12 so as to radially expand and retract the cutting blades 18.

At the upper end of FIG. 3A, the downstream end of the underreamer 12 is shown threadably engaged at 30 with the upper end 32 of the outer housing 34 of flow control assembly 14. The outer housing 34 is cylindrically shaped and defines a flowbore 36 therethrough. Lateral fluid ports 38 (see FIG. 3D) are disposed through the housing 34 to permit fluid communication between the flowbore 36 and the annulus of the wellbore into which the flow control apparatus 14 is disposed. The lower end of the housing 34 features a threaded connection 40 for attachment of a drill bit apparatus, such as drill bit apparatus 16, or another device.

The valve assembly 26 is retained within the flowbore 36 and can be seen in greater detail in FIG. 3A. The valve assembly 26 is made up of an enlarged valve member 42 which is shaped and adapted to seal against valve seat 44 thus blocking fluid flow access into the central passage 24 of the underreamer 12. An elongated upper pin 46 connects the valve member 42 with a lower pin 48 which has a radially enlarged lower end portion 50. The upper pin 46 and lower pin 48 are affixed by a threaded connection 52. The lower pin 48 has a slightly smaller diameter than the upper pin 46 so that a downwardly and outwardly facing shoulder 54 is provided at the lower end of the upper pin 46. The valve assembly 26 also includes a sleeve 56 which surrounds a portion of the upper pin 46. A compressible spring 58 is disposed in a radially surrounding relation about the upper pin 46 between the valve member 42 and the sleeve 56 so as to urge the valve member 42 upward toward the valve seat 44.

Figure 5A:
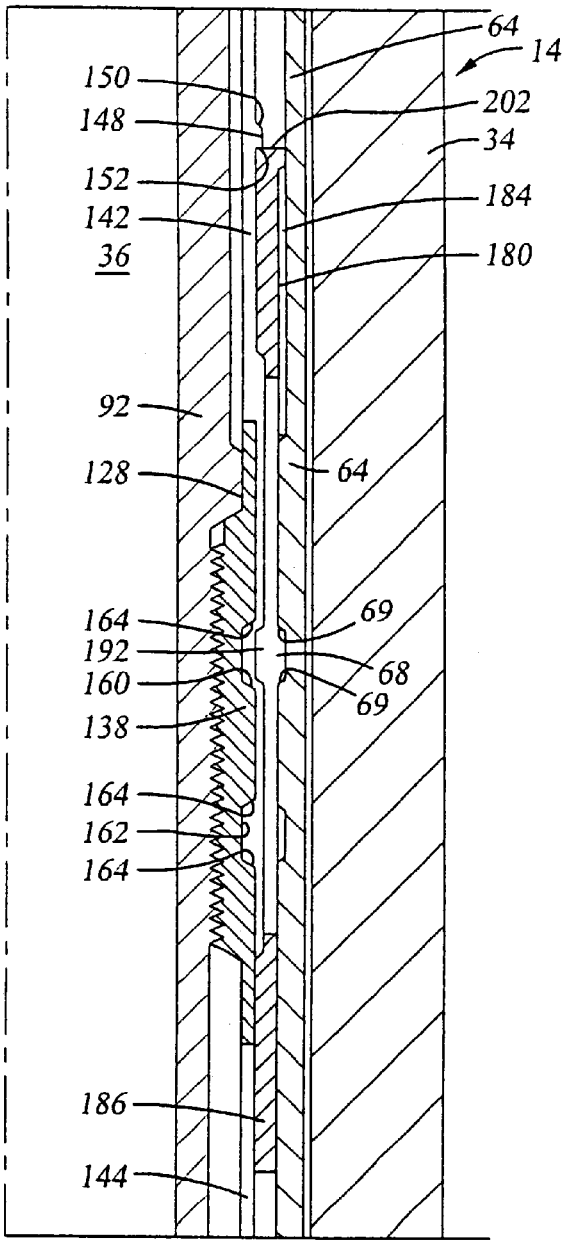

A piston retaining sleeve 60 is disposed within the housing 34 in a tightly-fitting relation. The piston retaining sleeve 60 is affixed at threaded connection 62 to a collet housing 64 that includes an upper interior groove 66 and a lower interior groove 68 (See FIG. 3B). Each of the grooves 66, 68 are provided with angled side walls 69 which are best seen in FIG. 5A. One or more fill ports 70 are disposed within the collet housing 64 below the grooves 66, 68. As shown in FIG. 3C, these fill ports 70 are closed off with plugs during operation.

A flow restrictor ring 72 (see FIG. 3C) is disposed below the collet housing 64 and is affixed to the collet housing 64 by threading 74. One or more jets or flow restricting orifices 76 are disposed through the ring 72. A lower sleeve 78 is also affixed by thread 80 to the lower end of the flow restrictor ring 72 and extends downwardly. A plurality of fluid communication ports 82, shown in FIG. 3D, is disposed through the lower sleeve 78. The lower sleeve 78 is connected by threads (not shown) to an inner mandrel 84. The inner mandrel 84 presents three inwardly projecting flanges 86, 88 and 90.

A hollow inner piston 92 is reciprocably disposed within the flowbore 36. The inner piston 92 includes an upper end 94 which extends inwardly to enclose the lower pin 48 of the valve assembly 26. Lateral fluid flow ports 96 are disposed within the body of the inner piston 92 proximate the upper end 94. A radially extended piston ring 98 extends outwardly from the body of the inner piston 98 and includes seal 100 which prevents fluid within the flowbore 36 from flowing across the piston ring 98. Beneath the ring 98, the piston 92 presents a reduced diameter mandrel 102 which presents outer threads 104. The lower end of the piston 92 tapers radially inwardly (as shown in FIG. 3D) and includes a plug 106 which is secured therewithin and contains a flow restricting nozzle 108. A pair of lateral flow ports 110 are disposed in the piston 92 above the plug 106, and an annular projection 112 projects radially outwardly from the piston 92 at a point below the ports 110. The projection 112 is shaped and sized so that it can pass through each of the inwardly projecting flanges 86, 88 and 90 without contact; however, there is very little space between the projection 112 and flanges 86, 88 or 90 when the projection 112 is aligned with any of these flanges.

A relatively incompressible fluid is retained within upper and lower annular fluid chambers 114, 116. The upper annular fluid chamber 114 is defined on the radial interior by the piston 92 and on the radial exterior by the piston retaining sleeve 60 and the collet housing 64. The upper fluid chamber 114 is enclosed at its upper end by the ring 98 and seal 100, and bounded at its lower end by the flow restrictor ring 72.

The lower annular fluid chamber 116 (see FIGS. 3C and 3D) is defined on the radial interior by the piston 92 and on the radial exterior by the lower sleeve 78. The lower chamber 116 is bounded at its upper end by the flow restrictor ring 72 and enclosed at its lower end by annular outer piston 120. The annular outer piston 120 (see FIG. 3C) is reciprocably retained within the lower fluid chamber 116 and includes radially outer and inner seals 122, 124, respectively which serve to enclose the lower end of chamber 116.

A mud chamber 117 is located below the outer piston 120, the lower end of which is defined by the inner mandrel 84. It is noted that the inner mandrel 84 presents an annular seal 118 which surrounds and seals against the inner piston 92. An annular compressible spring 126 is disposed within the mud chamber 117 between the outer piston 120 and the inner mandrel 84 such that the spring 126 will be compressed by downward movement of the outer piston 120. The fluid chambers 114, 116 and mud chamber 117 collectively provide a fluid storage chamber which is storing fluid in the lower chamber 116 under pressure created by spring 126 and subsequently releasing it back into the upper chamber 114. As fluid stored within the upper chamber 114 is transmitted through the restrictor ring 72 and into the lower fluid chamber 116, thus urging the outer piston downwardly and compressing the spring 126.

Figure 3B:
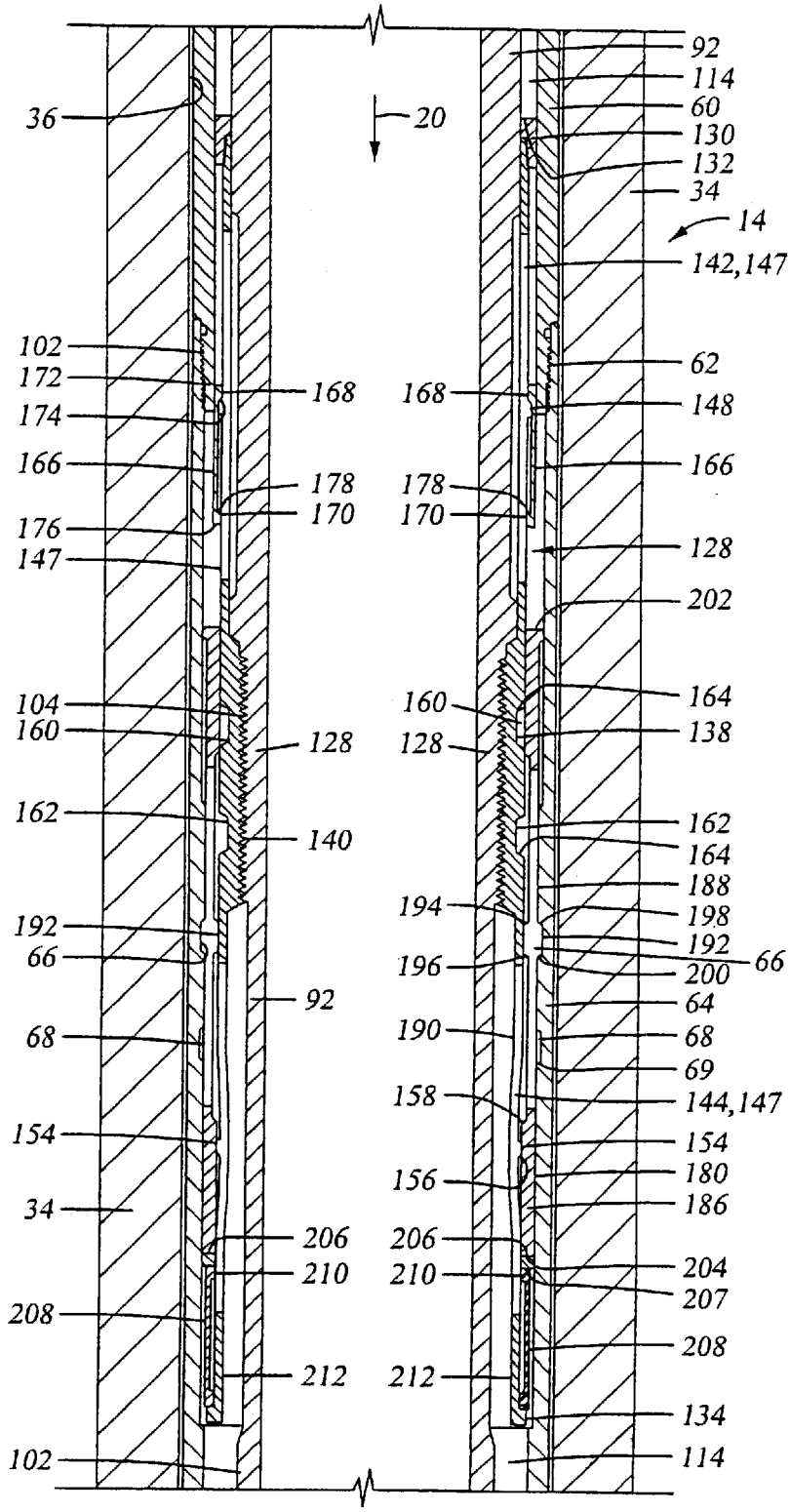
Figure 3C:
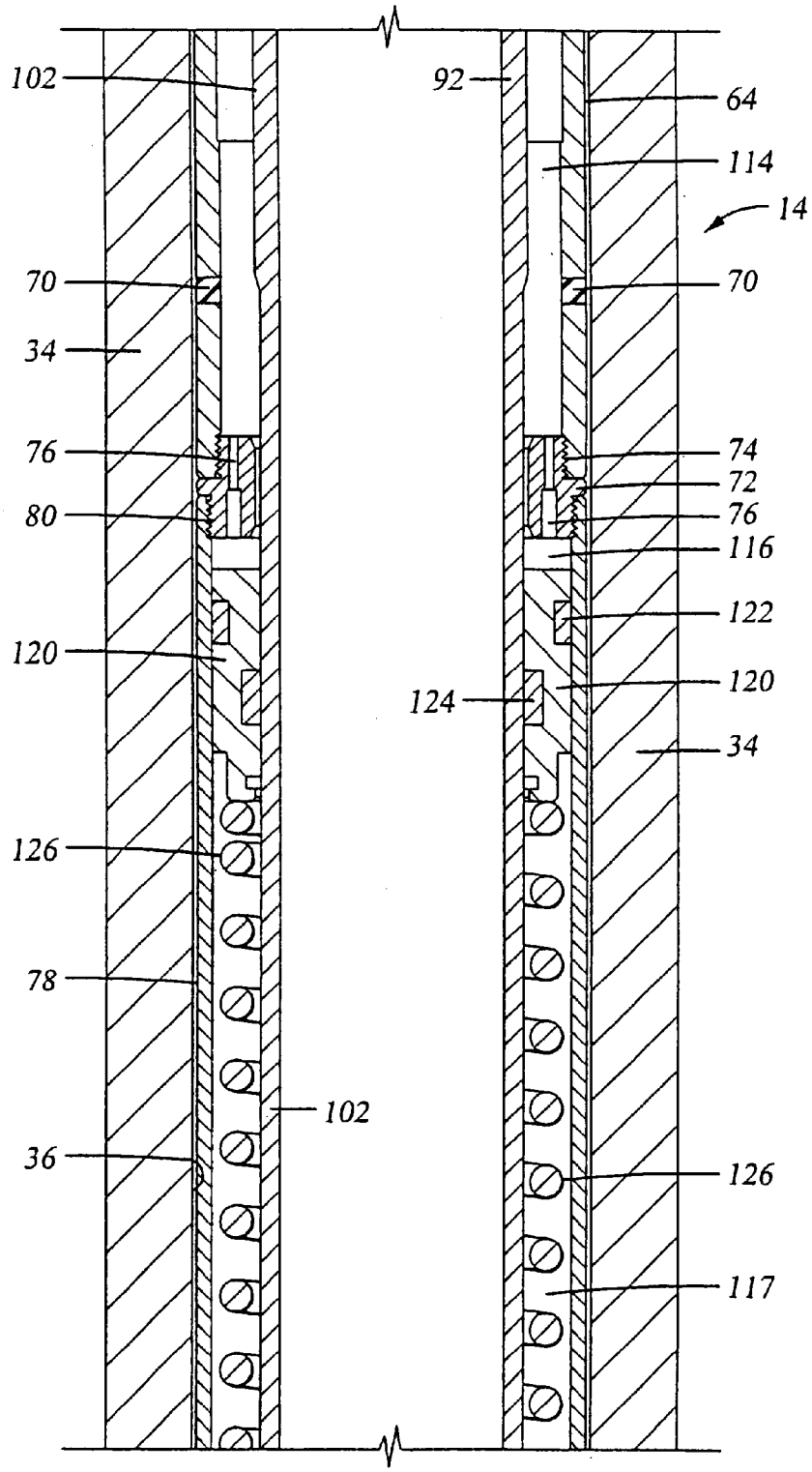
Figure 3D:
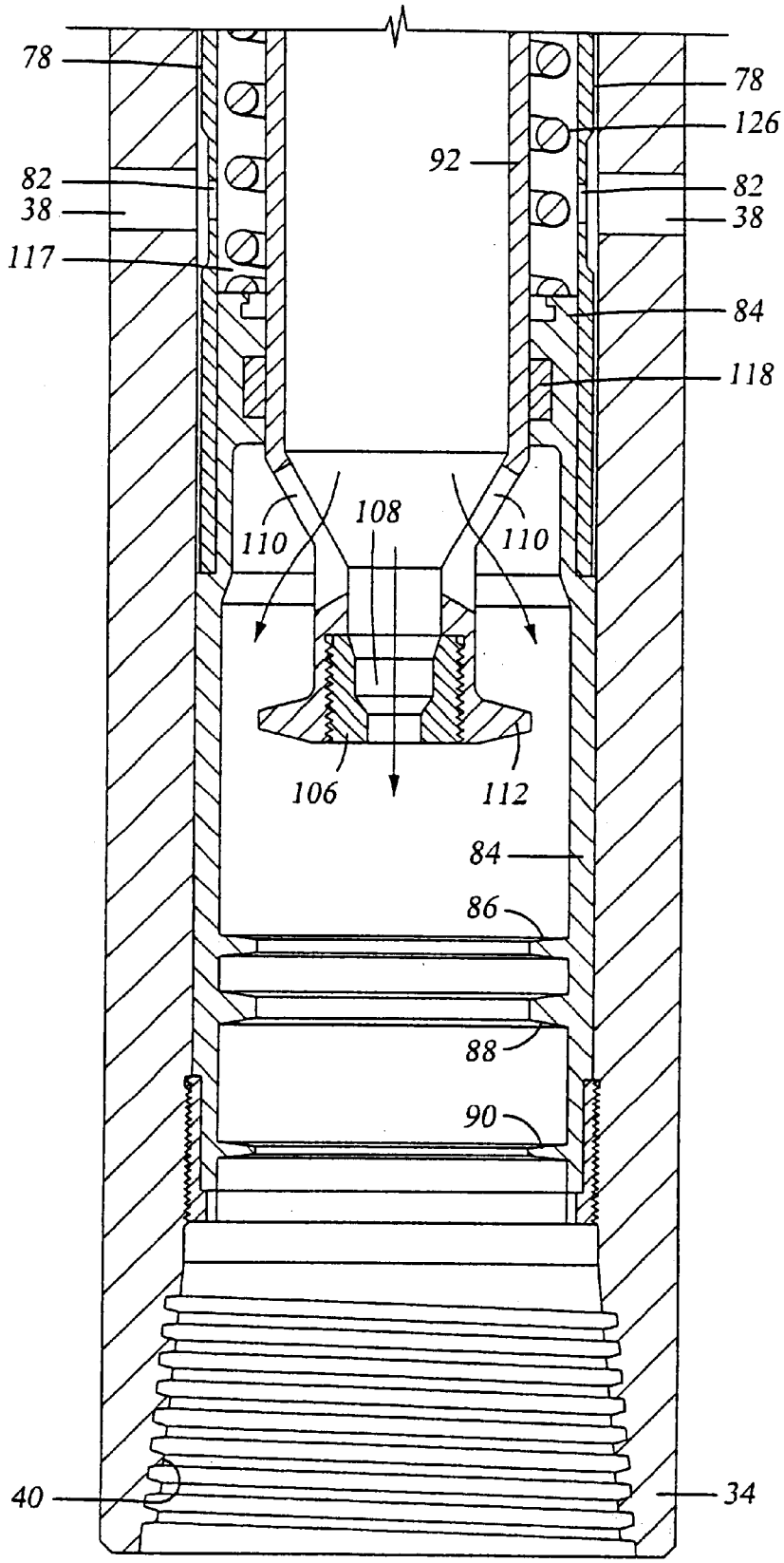
Figure 9:
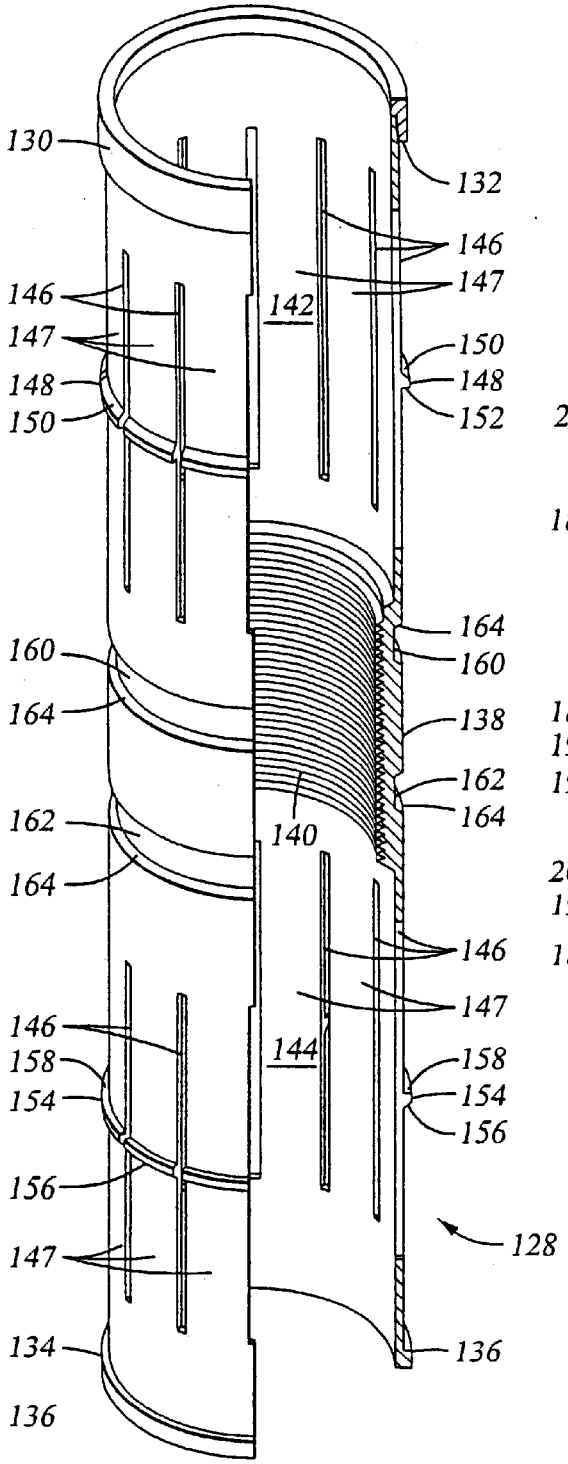
FIG. 9 is a partially cut-away perspective view of an exemplary catch collet which is used within the flow control assembly.

Referring to FIGS. 3B and 9, a fixed cylindrical catch collet 128 is disposed within the upper fluid chamber 114. (See FIG. 3B). The catch collet 128 is shown in greater detail in the isometric view of FIG. 9. An upper annular ring 130 is affixed by threading to the upper end of the catch collet 128 and presents a downward facing axial face 132. The lower end of the catch collet 128 features a radially outwardly projecting flange 134 which presents an upward facing axial face 136. The body of the catch collet 128 also features a central portion 138 which presents interior threads 140 which are shaped and sized to be complimentary to the outer threads 104 on the piston 92. On either side of the central portion 138 are upper and lower slotted sections 142, 144, respectively. Each slotted section 142, 144 contains a number of parallel, longitudinal slots 146 disposed therethrough, which define longitudinal ribs 147 within the slotted sections 142, 144.

The exterior surface of the upper slotted section 142 presents an upper raised annular flange 148 which features an upwardly and outwardly disposed upper shoulder 150 which is angled at approximately 45° from the longitudinal axis of the catch collet 128. The upper flange 148 also features a downward facing stop face 152 which is angled at approximately 90° from the longitudinal axis of the catch collet 128. The exterior surface of the lower slotted section 144 presents a lower raised annular flange 154 which is virtually a mirror image of the upper flange 148 on the upper slotted section 142. The flange 154 presents a downwardly and outwardly disposed lower shoulder 156 which is angled at approximately 45° from the axis of the catch collet 128. An upward facing stop face 158 is angled at approximately 90° from the axis of the catch collet 128.

The exterior radial surface of the central section 138 of the catch collet 128 includes an upper and a lower recessed groove 160, 162. Each groove has side walls 164 which are angled at approximately 45° from the axis of the catch collet 128.

Also disposed within the upper fluid chamber 114 is an upper floating sleeve 166 (see FIG. 3B) which surrounds the upper slotted section 142 of the catch collet 128. The floating sleeve 166 includes inwardly protruding upper and lower annular flanges 168, 170, respectively at either end. The upper flange 168 presents an upward facing stop face 172 and an angled downward and inwardly facing surface 174 which is angled at approximately 45° from the longitudinal axis of the floating sleeve 166. In a mirror image fashion, the lower flange 170, presents a downward facing stop face 176 and an upward and inwardly facing surface 178.

The upstream and downstream ends of the catch collet 128 are designed to "catch" a series of concentrically positioned floating sleeves 166 and 208, a ring 204 and the floating position collet 180. The floating position collet 180, which will be described in further detail shortly, is axially placed between upstream sleeve 166 and downstream ring 204 above sleeve 208. As the inner piston 92 is cycled (moved upwardly or downwardly) within the piston retaining sleeve 60, the catch collet 128 secured thereto moves the floating sleeves 166, 208, the floating position collet 180 and the ring 204 axially downstream a set distance dependent upon whether the flow control assembly 14 is either in or out of a flow-through mode.

Figure 10:
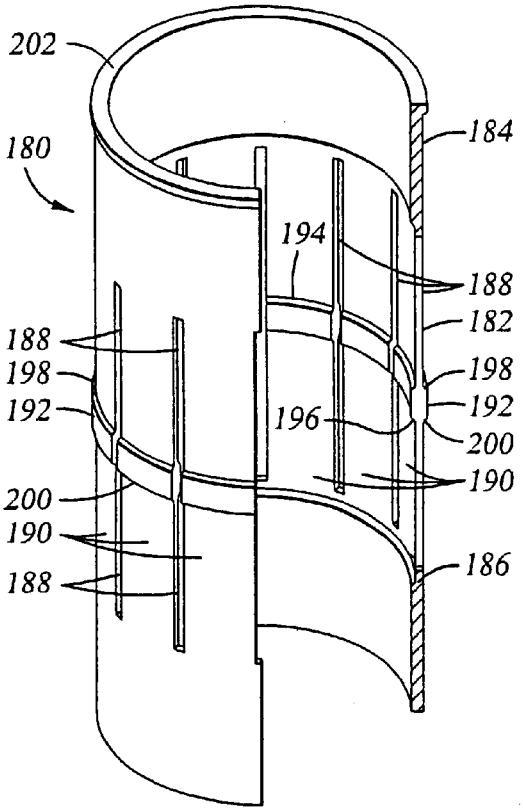
FIG. 10 is a partially cut-away perspective view of an exemplary floating position collet which is used within the flow control assembly.

Referring now to FIGS. 3B and 10, below the upper floating sleeve 166, the floating position collet 180 is disposed in the upper fluid chamber 114. The floating position collet 180 also surrounds the catch collet 128 and is shown in greater detail as an individual component in FIG. 10. The floating position collet 180 features a central slotted section 182 with upper and lower end portions 184, 186, respectively on either side, each having increased thickness as compared to the central section 182. As with the catch collet 128, the slotted section of the floating position collet 180 includes a number of longitudinal slots 188 which define a plurality of longitudinal bands 190. The central slotted section 182 includes an enlarged portion 192 which on the radial interior portion presents an upward, inwardly facing surface 194 and a downward, inwardly facing surface 196, both of which are angled at approximately 45° from the longitudinal axis of the floating position collet 180. The radial exterior portion of the enlarged portion 192 also presents an upward, outwardly facing surface 198 and a downward, outwardly facing surface 200, both of which are angled at approximately 45° from the longitudinal axis of the floating position collet 180. The upper end of the floating position collet 180 also presents an axial stop face 202.

Enlarged portion 192 is affixed to and positioned centrally of the floating position collet 180. The enlarged portion 192 radially extends both inwardly and outwardly of the floating position collet 180. The radial sides of the enlarged portion 192 of the floating position collet 180 are sloped or angled at 198 and 200 to enable the catch collet 128 to move the enlarged portion 192 into one or the other of the annular position grooves 66 and 68, formed in and strategically positioned along the inwardly facing surface of the collet housing 64 and the grooves 160 and 162 formed in the catch collet 128 for clearance. In FIG. 3B, the enlarged portion 192 of the floating position collet 180 is shown in an upper position located in upper groove 66.

Disposed below the floating position collet 180 in the upper fluid chamber 114, annular ring 204 presents an upper face 206. The ring 204 also presents a lower stop face 207 which is angled at approximately 90° from the axis of the assembly 14. A lower floating sleeve 208 lies below the annular ring 204. The lower floating sleeve 208 presents an inwardly projecting upper lip 210 and a lower lip 212.

Operation of the Flow Control Assembly 14 in a Flow-through Mode

Figure 4A:
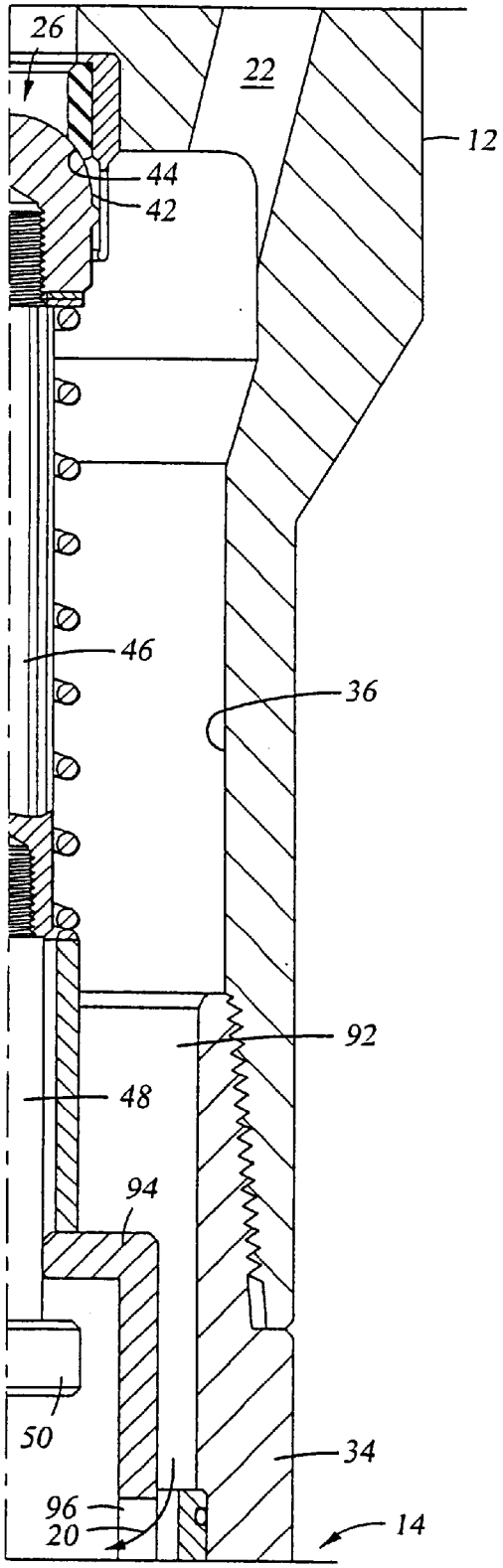
FIGS. 4A, B, C and D depict a partial cross-section of the flow control assembly in a flow-through mode with the pumps on and the fluid flowing through the assembly.

Operation of the flow control assembly 14 in a flow control mode is illustrated with reference to FIGS. 3A–3D. Assuming the flow control assembly 14 is in the position depicted in FIGS. 3A, B, C and D, actuation of surface-based fluid pumps (not shown) will pump drilling fluid downward through passages 22 into flowbore 36 in the direction of arrows 20. Fluid entering the piston 92 through fluid passages 96 will flow downward through the interior of the inner piston 92, then radially outward from the inner piston 92 through ports 110 and ultimately downward through the lower end 34 of the assembly 14. Upon application of fluid pressure from the turning on of surface-based pumps, the inner piston 92 will be urged downwardly, as shown in FIGS. 4A, B, C and D.

As the inner piston 92 moves downwardly within the housing 34, the upper fluid chamber 114 will begin to shrink in size due to downward movement of the ring 98 and seal 100. As a result, the fluid within the upper fluid chamber 114 will be placed under increased pressure and, thus, be forced through the fluid restrictors 76 of the fluid restrictor ring 72 and into the lower fluid chamber 116. As the fluid enters the lower fluid chamber 116, it will urge the annular piston 120 downward, thus compressing spring 126. Wellbore fluids present within the mud chamber 117 below the piston 120 will be displaced into the wellbore annulus through ports 82 and 38 as the piston 120 descends. The transfer of substantially incompressible fluid from the upper chamber 114 into the lower chamber 116 serves to slow the downward movement of the inner piston 92 within the housing 34 since the fluid must be metered through the flow restrictor ring 72.

Due to the threaded connection of the inner piston 92 with the catch collet 128, the catch collet 128 is moved downwardly along with the inner piston 92 as fluid pressure is increased within the flowbore 36. The lower raised annular flange 154 of the catch collet 128 is thus moved down below the annular ring 204 (see FIG. 4C), the angled lower shoulder 156 of the flange 154 moving over the upper face 206 of the annular ring 204. Further downward movement of the inner piston 92 moves the flange 154 below the upper lip 210 of the lower floating sleeve 208.

The downward limit of movement for the inner piston 92 occurs when the axial face 132 of the upper ring 130 engages the upper end of the floating sleeve 166. Once the downward limit of movement for the inner piston 92 has been reached, the surface-based pumps may then be turned off so that the inner piston 92 is returned to its upper position. The pumps may be turned on and off in this manner as many times as needed to actuate other tools incorporated into the drill string 10 without causing actuation of the valve assembly 26 because the upper end 94 of the piston 92 will not contact the enlarged portion 50 of the valve assembly 26.

Although not depicted, it should be understood that, in the flow-through mode, the presence of an angled lower shoulder 156 will permit the lower annular flange 154 to be moved downward past the ring 204 and, as the inner piston 92 moves downward further, over the upper lip 210 of the lower floating sleeve 208. Specifically, the angled lower shoulder 156 permits the annular flange 154 to slip downward over the ring 204 and the upper lip 210 of the lower floating sleeve 208 as the inner piston 92 moves downwardly within the housing 34. Due to the presence of the slots 146, the longitudinal ribs 147 will deflect inwardly to assist passage of the flange as the angled shoulder 156 past the ring 204 and upper lip 210. As the surface pumps are stopped, the inner piston 92 can once more rise with respect to the housing 34, and the lower annular flange 154 will slip upward, in a similar fashion, over the angled upper lip 210 of the lower floating sleeve 208 and then over the ring 204.

Movement of the Flow Control Assembly 14 Out of A Flow-Through Mode

Referring now to FIGS. 4A–4D as well as 5A and 5B, portions of the flow control assembly 14 are shown in greater detail to illustrate a preparatory configuration for movement of the assembly 14 out of the flow-through mode and into a valve control mode which will permit the valve assembly 26 to be selectively actuated. The catch collet 128 is located adjacent the floating position collet 180 such that the enlarged portion 192 is disposed both in the upper inwardly-directed groove 66 of the collet housing 64 and the upper outwardly-directed groove 160 of the catch collet 128. Further, the downward-facing stop face 152 of the catch collet 128 engages the axial stop face 202 of the floating position collet 180. In this configuration, fluid pressure within the flowbore 36 from turning on of surface-based fluid pumps will cause downward movement of the floating position collet 180 as the inner piston 92 is urged downwardly. Alignment of the enlarged portion 192 with the outwardly directed groove 160 permits the enlarged portion 192 to deflect radially inwardly due to the room provided by the groove 160, thereby allowing the floating position collet 180 to be translated axially downwardly and the enlarged portion to be moved out of the upper inwardly directed groove 66. Upon a fluid pressure increase within the drill string 10 and flowbore 36 will, therefore, cause the floating position collet 180 to be moved downwardly within the housing 34 so that the enlarged portion 192 of the floating position collet 180 is moved into the lower inwardly-directed groove 68.

Figure 4B:
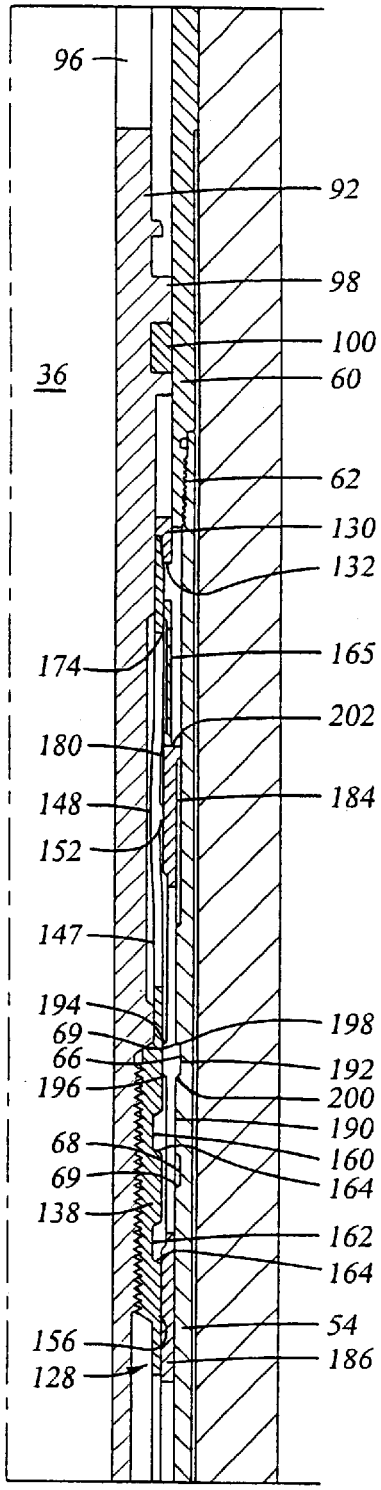
Figure 4C:
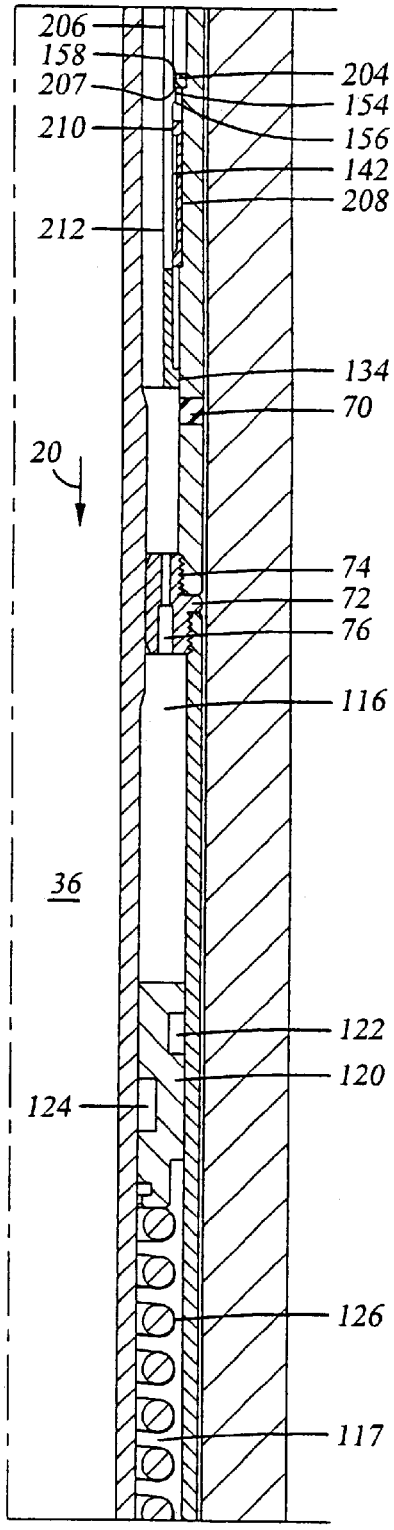
Figure 6C:
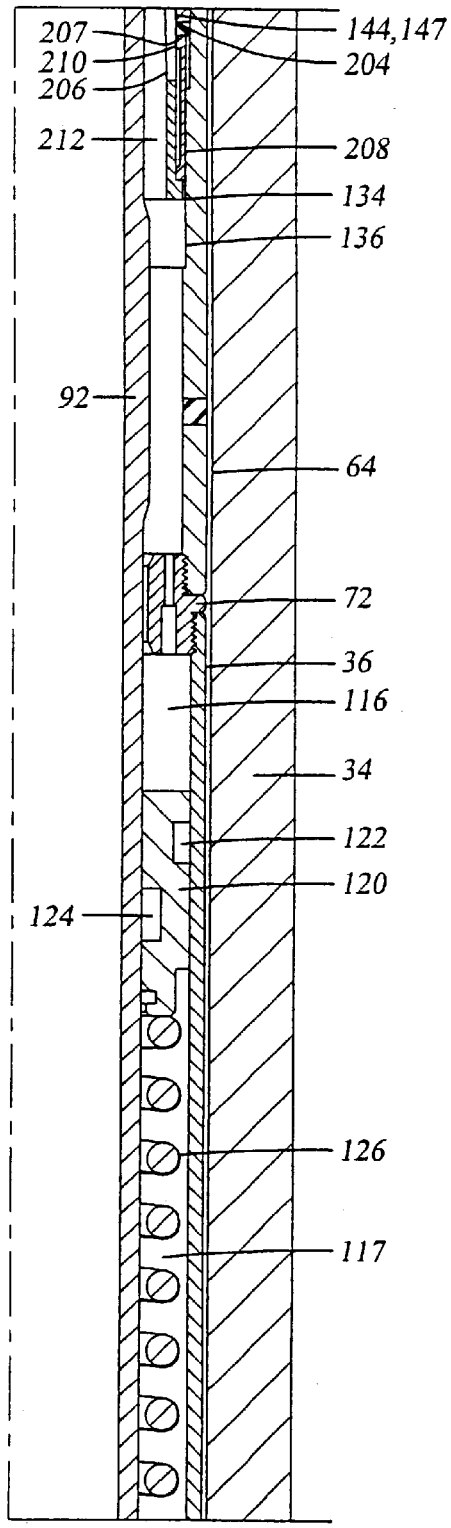
Figure 4D:
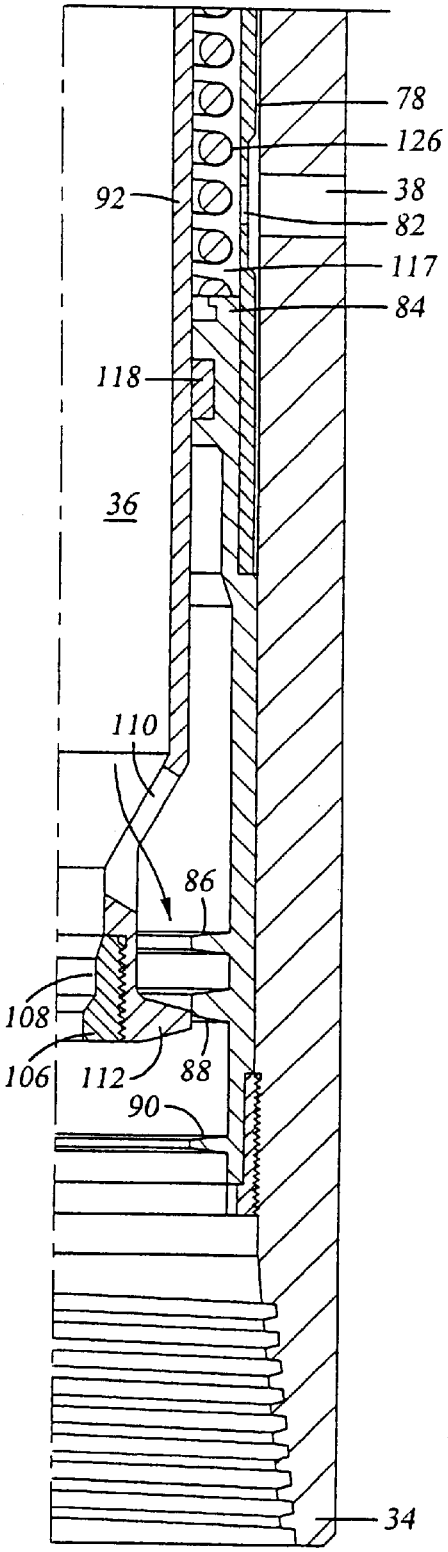
Figure 6D:
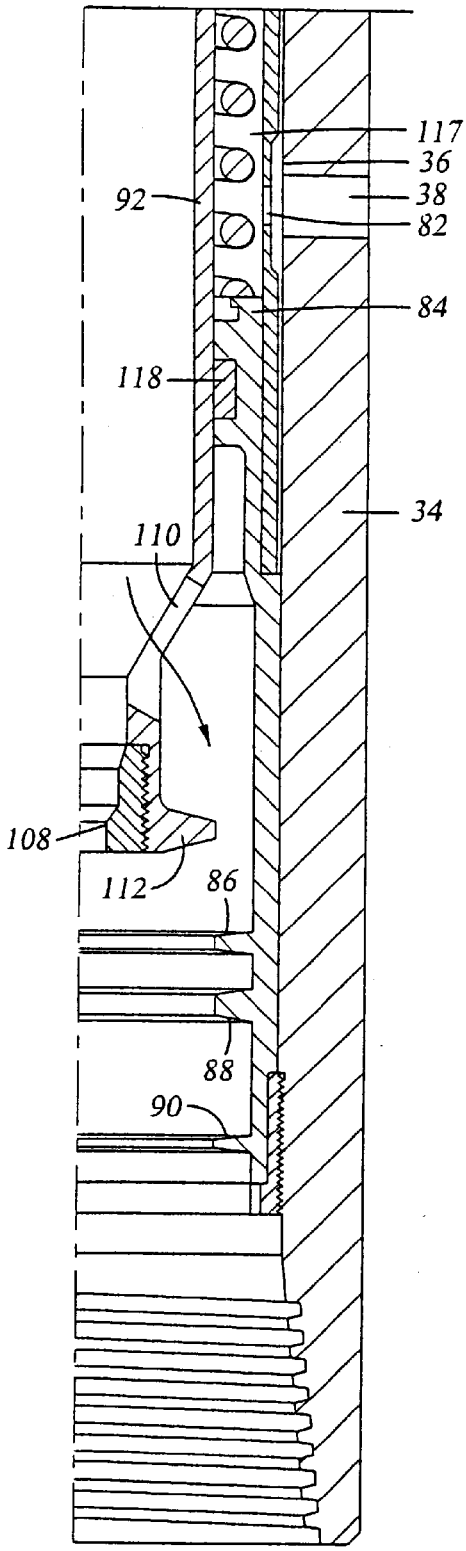
Figure 5B:
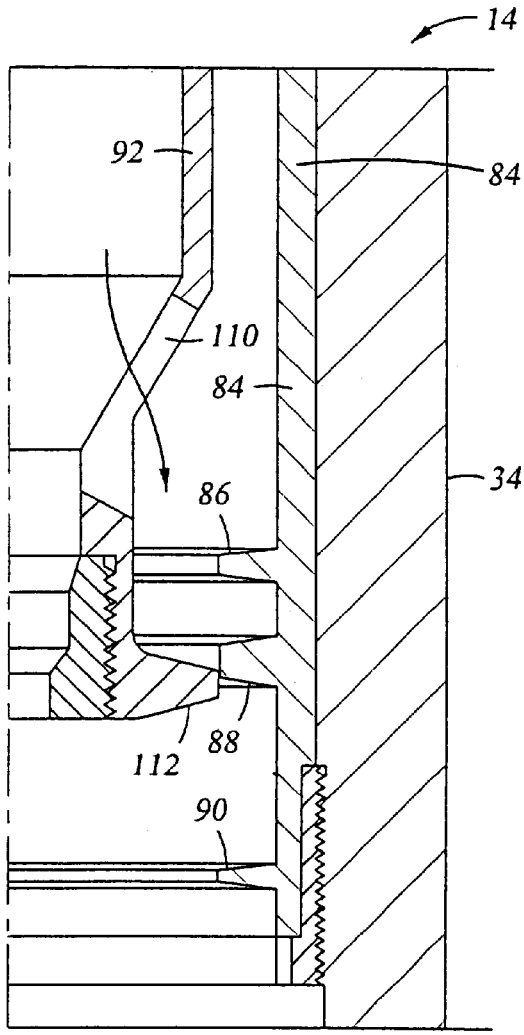

The alignment position depicted in FIGS. 5A–5B can only be achieved if the surface-based pumps are shut off once the inner piston 92 is located so that the raised lower flange 154 is located between the ring 204 and the upper lip 210 of the floating sleeve 208. This position is depicted in FIG. 4C. With the lower flange 154 located below the ring 204, shutting off of the pumps will cause the inner piston 92 to move upwardly. The upward facing stop face 158 engages the lower face 207 of the annular ring 204. Because there are no angled shoulders to create a camming action, the lower flange 154 is trapped below the ring 204. Shutting off of the surface-based pumps at this time will cause upward movement of the inner piston 92 so that the ring 204 is dragged upwardly within the collet housing 64 by the lower flange 154. Upward movement of the inner piston 92 will thus be limited by an engagement of the upper face 206 of the ring 204 with the lower end 186 of the position collet 180. With the lower flange 154, ring 204 and lower end 186 thus engaged, when pumps are started again, the upper groove 160 of the catch collet 128 will become substantially aligned with the enlarged portion 192 of the position collet 180.

Figure 6A:
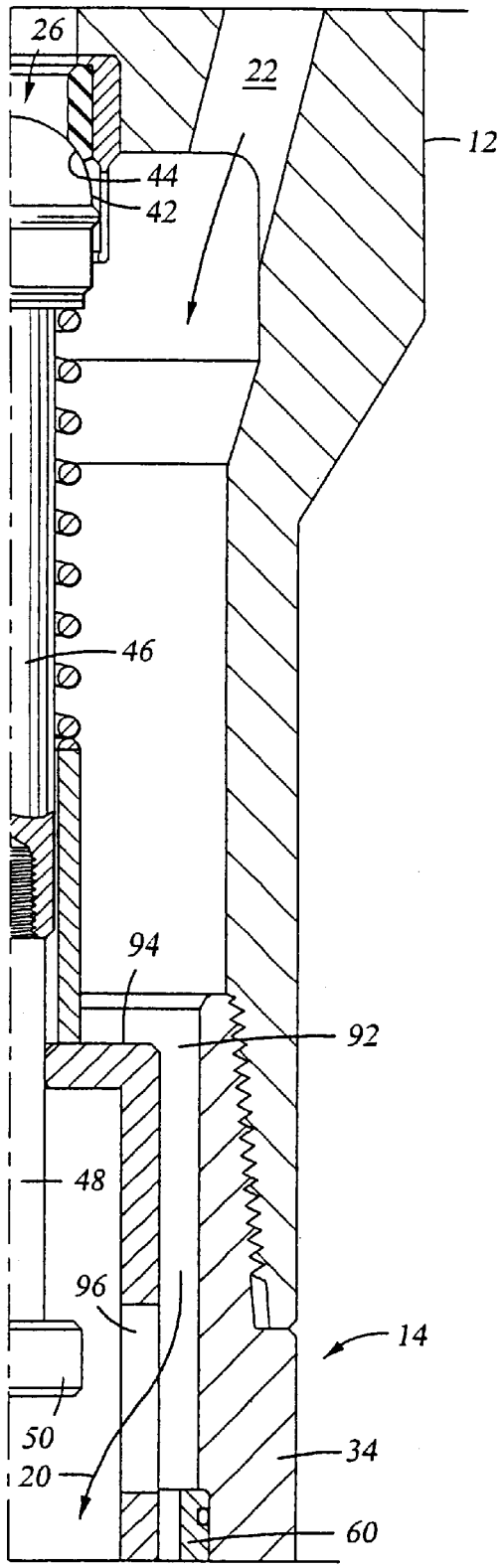
FIGS. 6A, B, C and D show a cross-section of the flow control assembly in a valve control mode and with the surface-based pumps shut off.
Figure 6B:
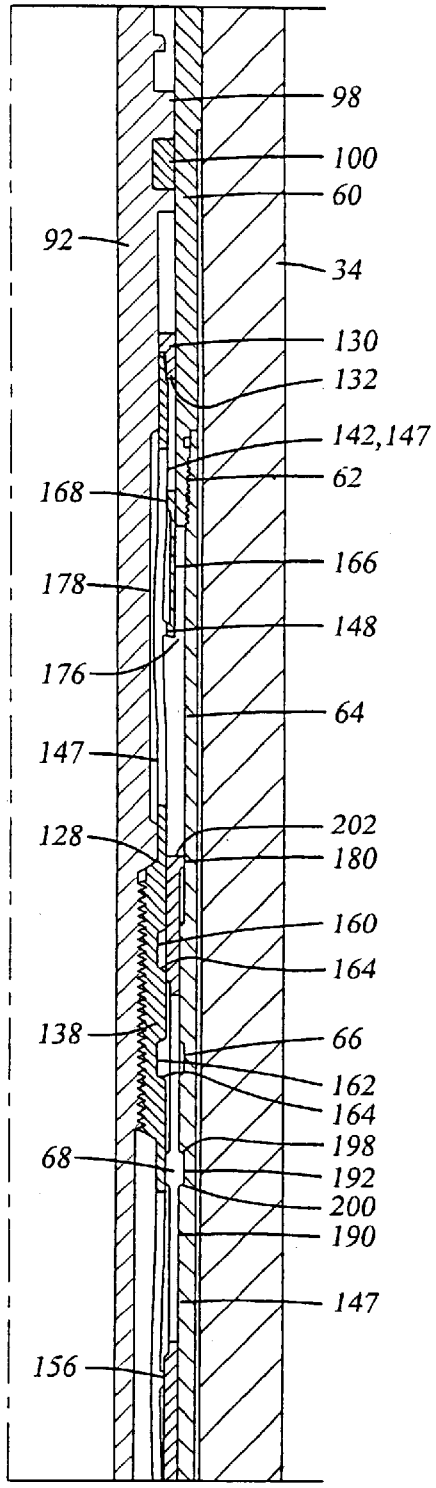

Referring now to FIGS. 6A, B, C and D, the floating position collet 180 is shown located within the housing 34 so that the enlarged portion 192 of the floating position collet 180 is disposed within the lower outwardly-directed groove 68 and the floating position collet 180 is, as a whole, moved lower within the housing 34. The surface-based fluid pumps have been turned off at this point. Thus, FIGS. 6A–D depict the flow control assembly 14 having been moved out of a "flow-through" mode and placed into a mode where increases in fluid pressure within the drill string 10 will cause the valve assembly 26 to be actuated. The valve assembly 26 can now be actuated because the inner piston 92 can be moved further downward within the housing 34 than it could in the flow-through mode.

Operation of the Flow Control Assembly 14 in a Valve Operating Condition

Figure 7A:
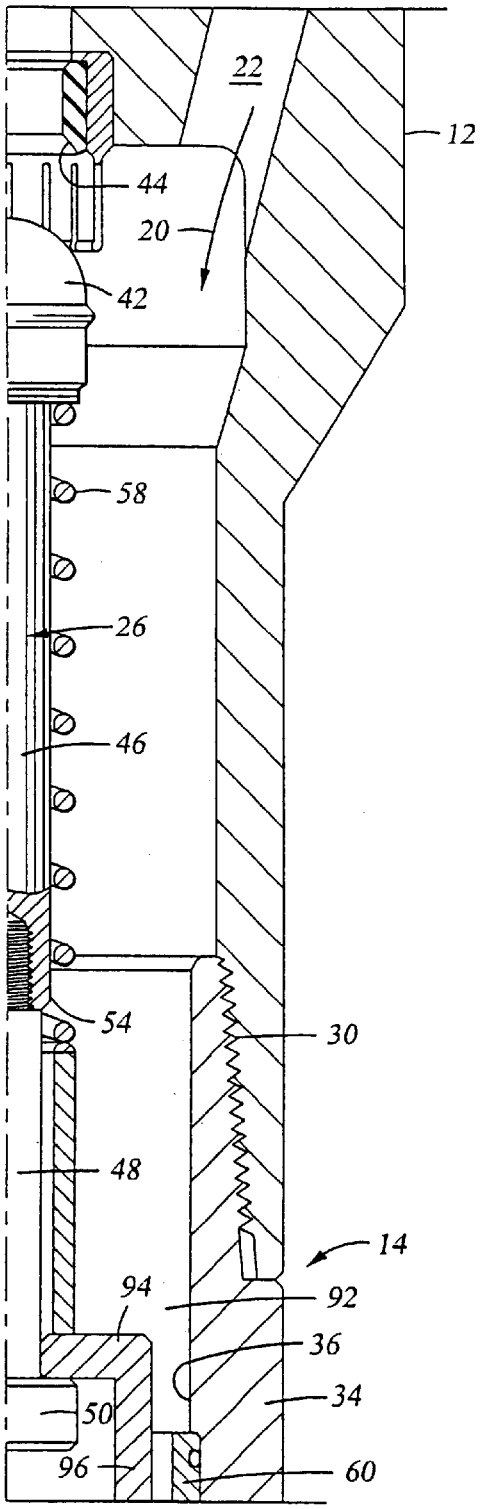
FIGS. 7A, B, C and D illustrate a partial cross-section of the flow control assembly with the surface-based pumps turned on, and the valve assembly of the flow control device opened for hydraulic actuation of the upstream underreamer.
Figure 8A:
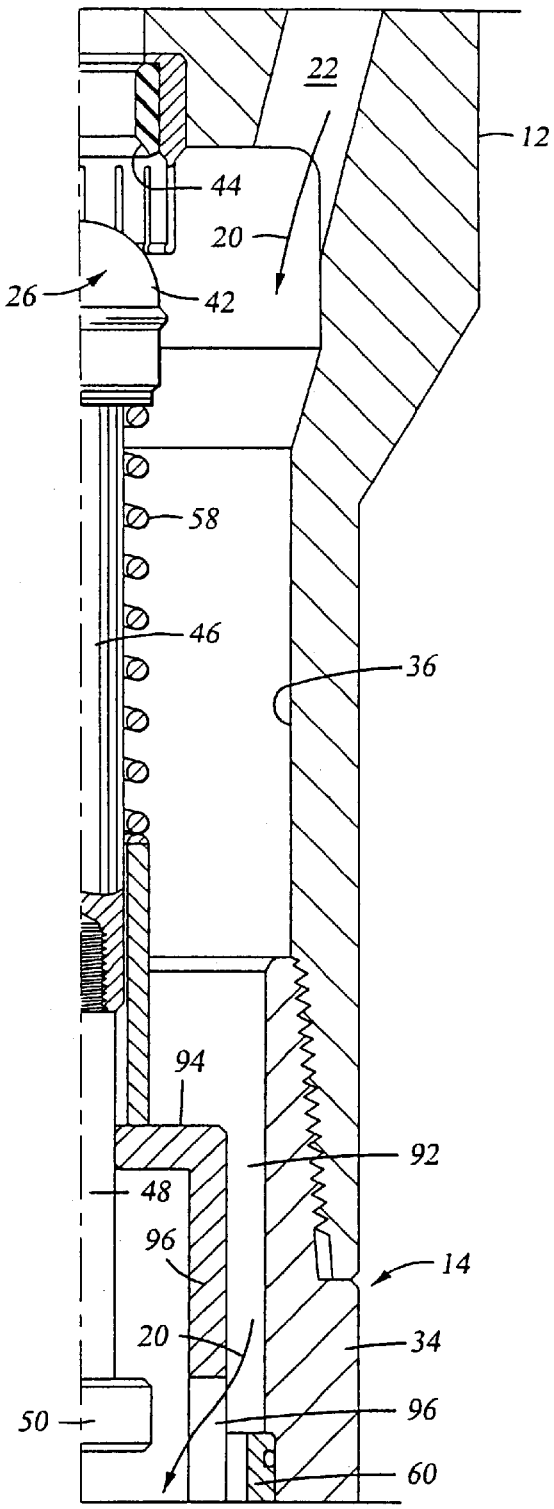
FIGS. 8A, B, C and D depict a partial cross-section of the flow control assembly in preparation to return from a valve control mode to a flow-through mode when the surface-based pumps are shut off.
Figure 7B:
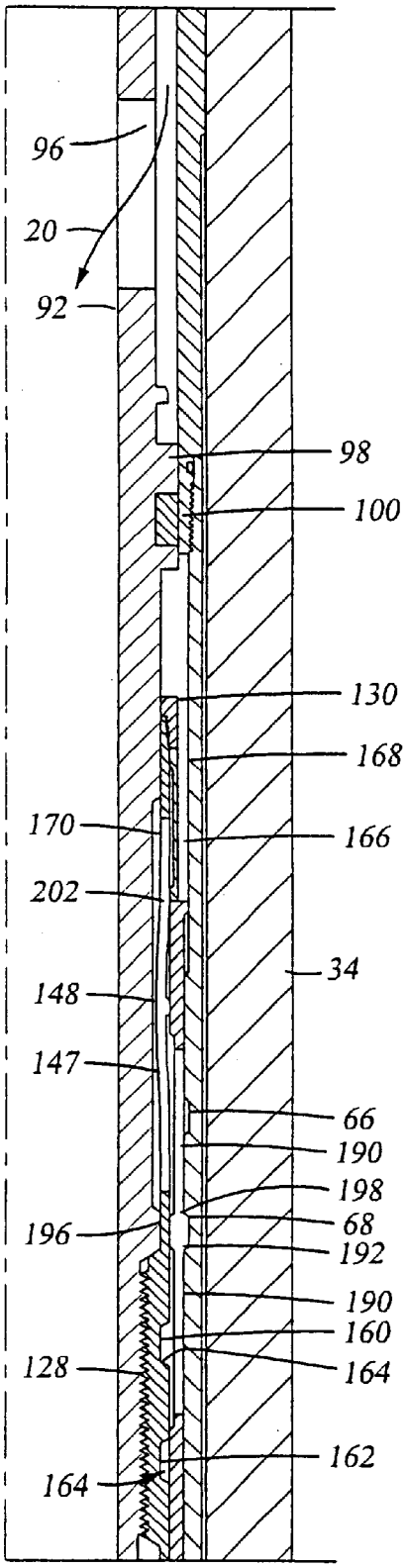
Figure 8B:
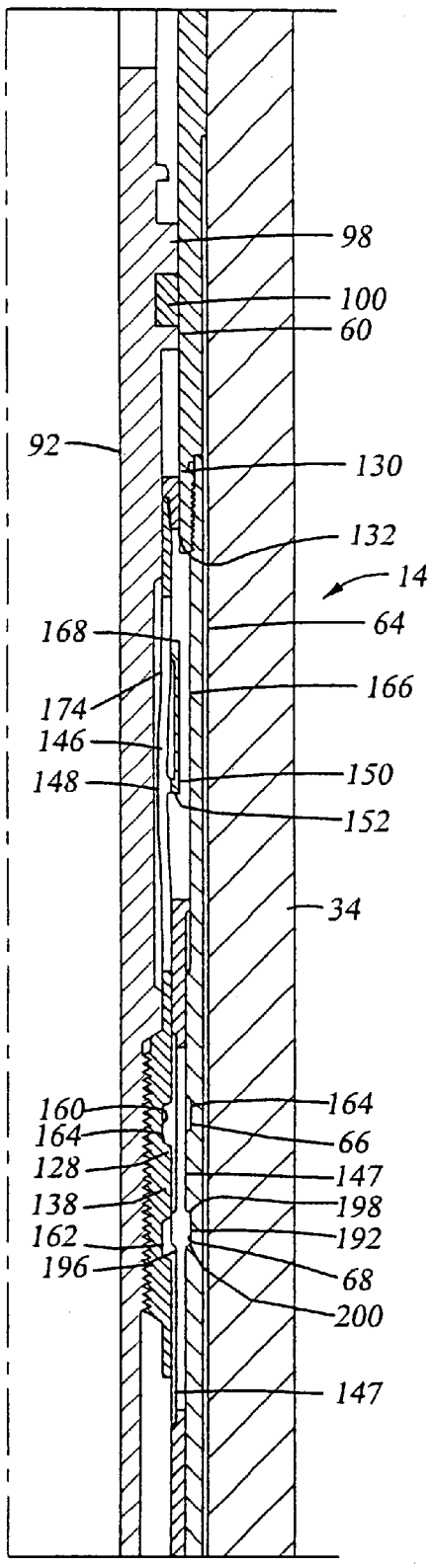
Figure 7C:
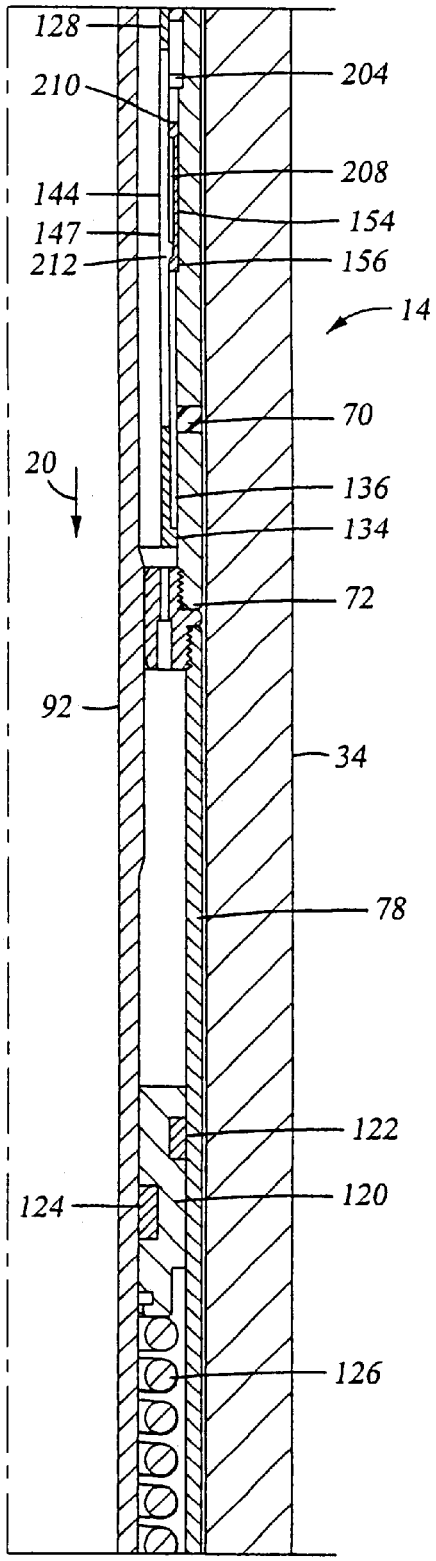
Figure 8C:
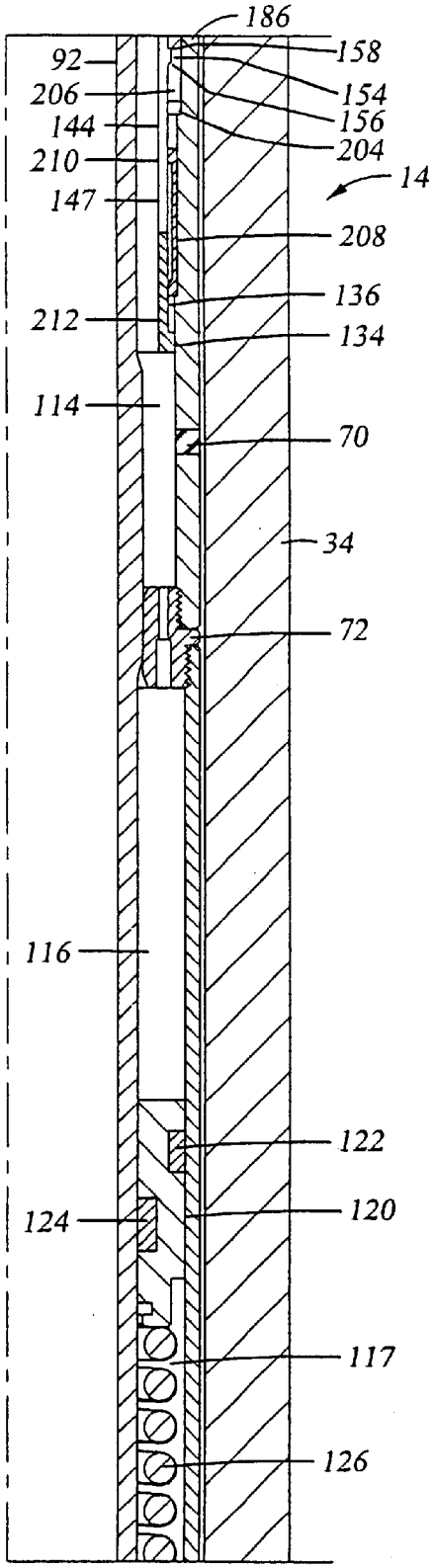

FIGS. 7A, B, C and D illustrate action of the flow control assembly 14 with the surface-base pumps turned on, the assembly having been taken out of a flow-through mode and placed into a valve control mode wherein the valve assembly 26 will be opened and closed by manipulation of the surface-based pumps. Increases in fluid pressure within the drill string 10 and flowbore 36 cause the inner piston 92 to move downwardly within the housing 34 so that the upper end 94 of the piston 92 engages the enlarged portion 50 of the valve assembly 26 thus lifting the valve member 42 from the valve seat 44. Fluid within the flowbore 36 is now able to enter the central passage 24 and actuate the underreamer 12. Because the valve spring 58 biases the valve 46 against its seat 44 to assure a tight seal, shutting off the surface-based pumps will close the valve assembly 26. The valve 46 will reopen when the pumps are reactivated as long as the flow control assembly 14 is still in the valve control mode.

It is noted that, in the valve control mode, fluid flow and pressure within the drill string 10 and flowbore 36 may be increased and decreased to selectively actuate the underreamer 12 a repeated number of times. The increases and decreases in fluid pressure resulting from the turning on and off of the surface-based fluid pumps should not cause the flow control assembly 14 to move back into a flow-through mode.

Return of the Flow Control Assembly 14 to a Flow-through Mode

From the valve control mode, the floating position collet 180 may be moved upwardly within the collet housing 64 so that the flow control assembly 14 is returned from the valve control mode to a flow-through mode. Referring to FIG. 8A–D, the flow control assembly 14 is depicted in a configuration which will cause the assembly to be moved out of the valve control mode and returned to a flow-through mode when the surface-based pumps are turned off. The enlarged portion 192 of the floating position collet 180 is substantially aligned with the lower groove 68 of the collet retaining sub 64 and the lower groove 162 of the catch collet 128. This alignment allows space necessary for the enlarged portion 192 to be moved out of the lower groove 68 and moved upwardly to the upper groove 66.

The lower flange 154 of the catch collet 128 is disposed between ring 204 and the lower end 186 of the floating position collet 180. When the surface-based pumps are shut off, the flange 154 will engage the lower end 186 of the floating position collet 180 and translate the collet 180 upward within the collet housing 64 until the enlarged portion 192 becomes disposed within the upper groove 66 of the collet housing 64.

Further upstream movement of the inner piston 92 with the pump off will force the lower flange 154 to flex and overlap the floating position collet 180. This happens when lower end 134 of the catch collet 128 forces the lower floating collar 208 against the ring 204 which in turn will push ramped surface 206 formed on ring 204 against ramped surface 156 formed on flange 154. This interaction moves the catch ring over the inner cylindrical surface of the floating position collet 180 thus allowing the inner piston 92 to proceed further upstream without disturbing the floating position collet 180 locked into the upper groove 66. Thus, in FIGS. 8A–8D, the flow control assembly 14 is depicted in a position from which it can be returned to a flow-through mode by stopping of the surface-based fluid pumps.

As surface-based pumps are stopped, fluid pressure within the flowbore 36 will be reduced. The spring 126 urges the annular piston 120 upward, transferring fluid from the lower chamber 116 into the upper chamber 114 through the restrictor ring 72. As fluid flows into the upper chamber 114, the inner piston 92 is moved upwardly with respect to the housing 34. Engagement of the lower flange 154 and lower end 186, described above, ensures that the position collet 180 will be moved upwardly with the inner piston 92. Upward movement of the position collet 180 is assisted by the alignment of the lower groove 162 with the enlarged portion 192. During upward translation of the position collet 180, the ribs 147 of the position collet 180 will flex radially inwardly so that the enlarged portion 192 will reside partially within the lower groove 162. The ability of the ribs 147 to flex inwardly in this manner permits the enlarged portion 192 to move out of the lower groove 68 of the sub 64 and then be moved upwardly and into the upper groove 66.

By translating the floating position collet 180 upwardly within the housing 34 in this fashion, the flow control assembly 14 is returned to the flow-through mode which is depicted in FIGS. 3A–3D and 4A–4D.

As is apparent from the above description, placement of the floating position collet 180 in an upper position within the assembly 14, such that the enlarged portion 192 is disposed within the upper groove 66, places the assembly 14 in a flow-through mode wherein reciprocation of the inner piston 92 will not result in the valve assembly 26 being operated. Conversely, placement of the floating position collet 180 in a lower position within the assembly 14, such that the enlarged portion 192 is disposed within the lower groove 68, places the assembly 14 in a valve control mode wherein reciprocation of the inner piston 92 will result in the valve assembly 26 being selectively actuated.

Operator Control of the Flow Control Assembly

Above is a description for operation and mechanical manipulation of the flow control assembly 14 between a flow-through mode and a valve operation mode. An exemplary technique for controlling and accomplishing this mechanical manipulation will now be described. This control technique utilizes fluid pressure readings obtained from a standpipe pressure gage of a type widely known in the art for reading fluid pressures in a wellbore. The control technique is assisted by the fact that travel of the inner piston 92 is slowed by fluid transfer between the upper and lower fluid chambers 114, 116. Slowing of the movement of the inner piston 92 permits additional time for the operator at the surface to control the surface-based pumps.

Figure 2:
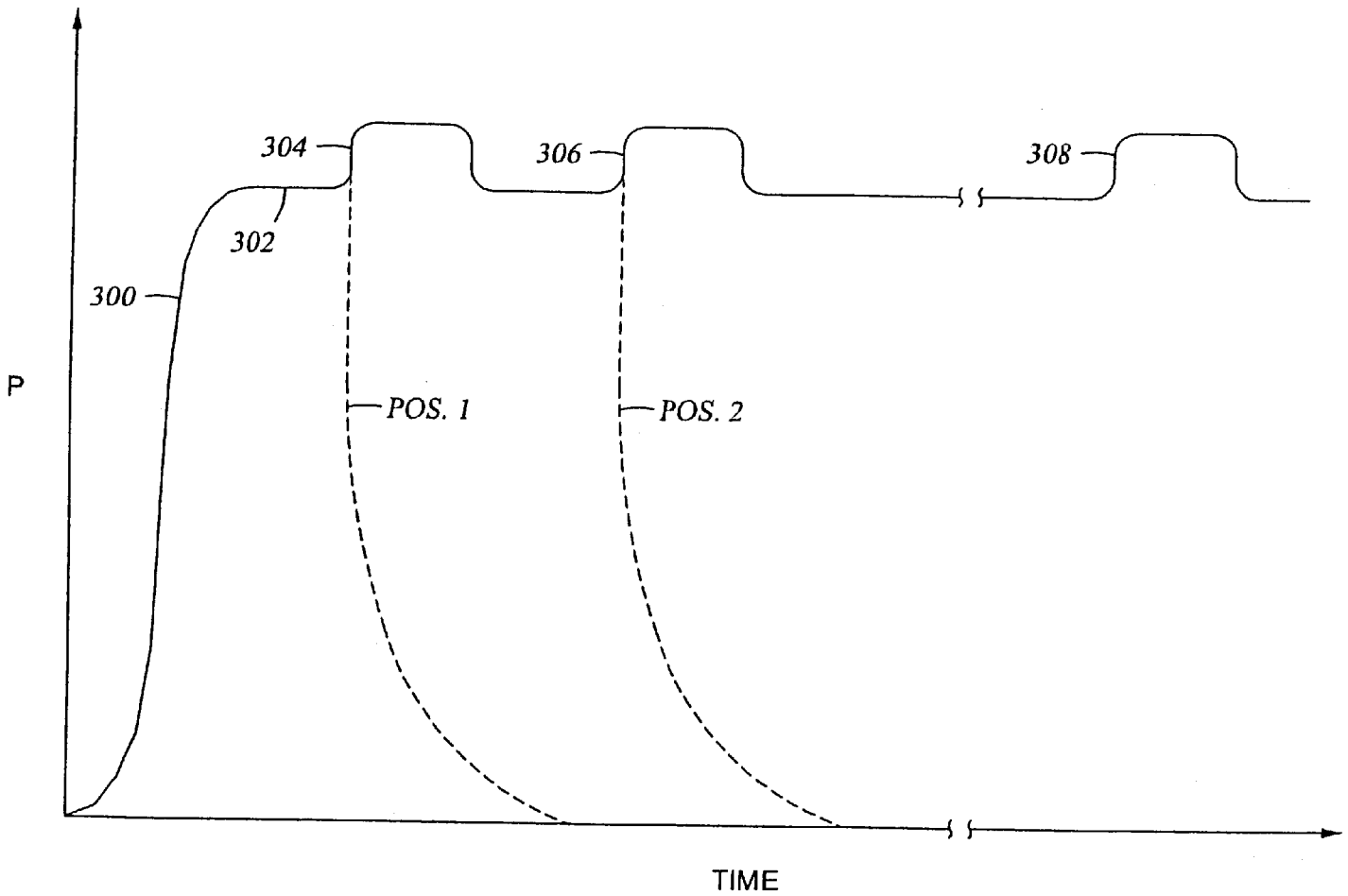

The control methods associated with the present invention are further understood with reference to FIG. 2 which depicts an exemplary readout from an oilwell standpipe pressure gauge of a type known in the art. The graph provides a readout of the fluid pressure ("P" on the Y-axis) within the drill string 10 over time ("T" on the X-axis). As hydraulic fluid is flowed into the drill string 10 by the hydraulic pump, the pressure reading increases as shown at 300 on the graph to eventually level out at a baseline pressure 302. During operation of the drill bit 16, the standpipe pressure should remain at or around the baseline pressure 302. Three pressure spikes 304, 306 and 308 are shown which indicate a significant increase in standpipe pressure above the baseline pressure 302. For example, for a system having a baseline pressure of 2500–3000 PSI, the pressure spikes will be increases on the order of 500 PSI. The duration of these spikes is typically between 15–30 seconds to allow time for the pressure variance to be transmitted through the system and to permit the operator to react. The pressure spikes 304, 306 and 308 serve as indicators to the rig operator as to whether the assembly 14 is in a flow-through mode or a valve control mode. The spikes are also signals to the rig operator which indicate when the assembly 14 is properly configured for movement between the flow-through mode and the valve control mode.

Figure 8D:
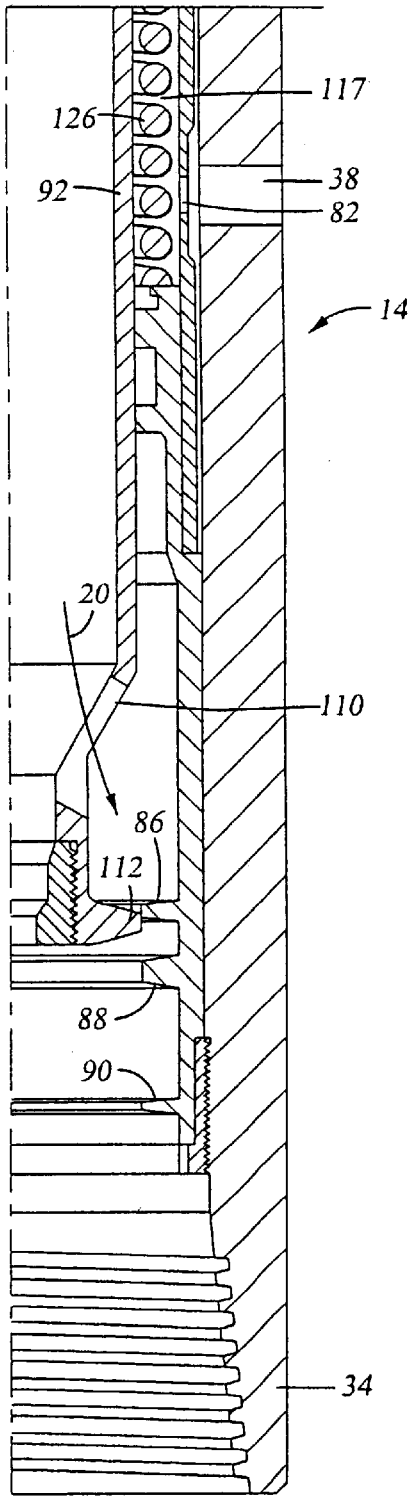

The pressure spikes 304, 306 and 308 result from changes in the standpipe fluid pressure which occur as the inner piston 92 is moved upwardly or downwardly with the housing 34 of the assembly 14. For example, as the inner piston 92 moves downwardly to the point where the annular projection 112 is adjacent the uppermost flange 86, the fluid pressure within the drill string 10 increases dramatically due to blockage of the fluid's downward passage toward the drill bit 16 by alignment of the annular projection 112 with the upper flange 86. Such an alignment is depicted in FIG. 8D. As noted previously, there are three such inwardly-directed flanges 86, 88 and 90 located within the inner mandrel 84. Alignment of each of these three flanges with the annular flange 112 of inner piston 92 will result in each of the three pressure spikes 304, 306 and 308, respectively.

Figure 7D:
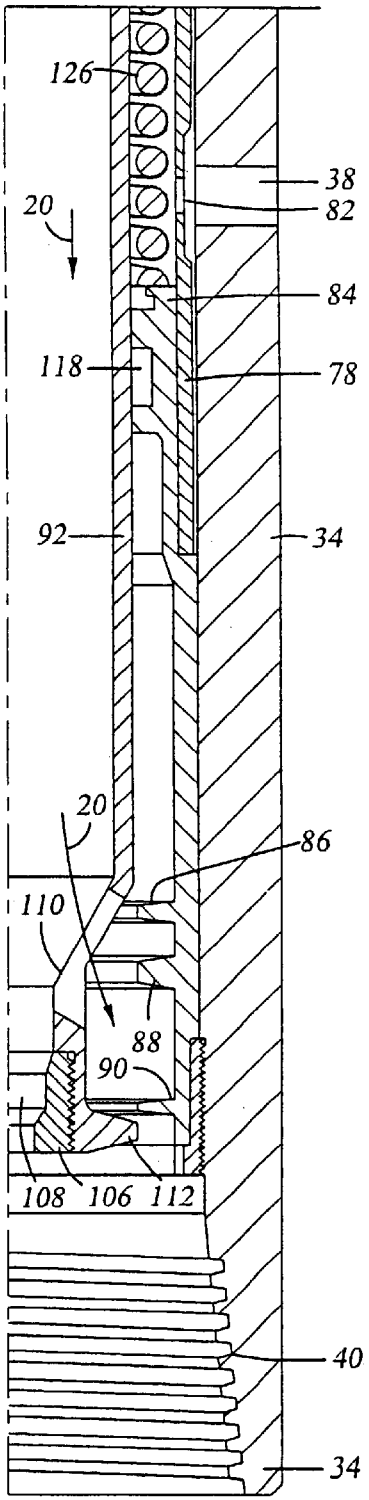

When the pump is turned on with the assembly 14 is in a valve control mode (FIGS. 7A–D), the inner piston 92 can be cycled downwardly to the point where the annular projection 112 can move past the lowest flange 90 (FIG. 7D).

As a result, the presence of the third spike 308 in the standpipe pressure readout indicates to the well operator that the assembly is in a valve control mode rather than a flow-through mode. When the assembly 14 is in a flow-through mode, however, and the pump is turned on, the inner piston 92 can not travel far enough downward to move annular projection 112 past the lowest spike producing flange 90 (see FIG. 4D). Thus, the absence of the third spike 308 visually indicates to the rig operator that the flow control assembly 14 is in the flow-through mode.

FIGS. 4A–4D and 5A–5B illustrate that the annular flange 112 on the inner piston 92 becomes aligned with the second flange 88 when the upper groove 160 of the catch collet 128 is substantially aligned with the enlarged portion 192 of the position collet 180 or, as explained above, when the assembly 14 is configured to be moved out of its flow-through mode and into a valve control mode. Hence, the second spike 306 serves as a signal to the rig operator to turn the surface based-pump off during the second spike 306 in order to move the assembly 14 out of the flow-through mode and into the valve control mode. The first spike 304 serves as a "warning" spike to the operator that he should prepare to manipulate the pump to so change the operating mode of the assembly 14.

FIGS. 8A–8D illustrate that the annular flange 112 on the inner piston 92 is aligned with the first flange 86 when the lower groove 162 of the catch collet 128 is substantially aligned with the enlarged portion 192 of the position collet 180. In other words, the annular flange 112 will align with the first flange 86, thus producing the first spike 304 when the assembly 14 is configured to be moved back from the valve control mode to the flow-through mode.

The floating position collet 180 may only be moved into or out of the flow-through mode through manipulation of the pump (turning the flow pump off) in conjunction with the visual readout of the pressure spikes.

It should be apparent from the above description that the floating position collet 180 serves as an operating mode sleeve which can be shifted between upper and lower positions. Placement of the position collet 180 into either of these positions enables the flow control assembly 14 to operate in one of two operating modes: a flow-through mode or a valve control mode.

It should also be apparent from the description provided above that a remote signal generator is provided by the system of generally complimentary flanges which are adapted to be aligned with one another in order to generate acoustic signals within the wellbore fluid. This remote signal generator is useful for providing signals to a rig operator which are indicative of the status of the flow control assembly 14 (i.e., whether the assembly 14 has been placed in a flow-through mode or a valve control mode). The remote signal generator also functions to provide a signal to a rig operator indicating that the inner piston has reached an alignment position so that the flow control assembly 14 can be moved between one of these modes and the other. Further, the remote signal generator provides warning signals to a rig operator which indicate that the inner piston is approaching an alignment position such that a change between these modes can occur. These warning signals provide valuable time to a rig operator to prepare to turn the surface-base fluid pump off, as appropriate, to alter the mode of operation of the flow control assembly 14 or maintain the assembly 14 in its present operating mode.

Structure of the Bypass Valve Assembly 500

Figure 11A:
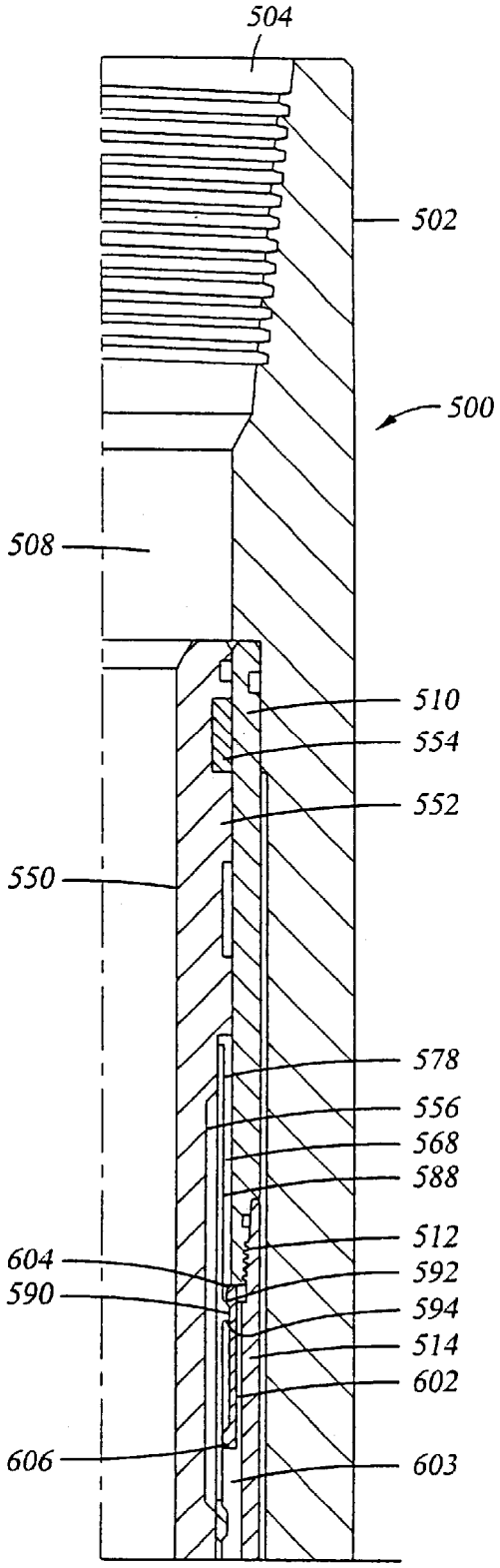
FIGS. 11A, B, C and D illustrate a partial cross-section of an exemplary bypass valve assembly. The valve assembly is shown in a flow-through mode with the bypass valve of the assembly open and with surface-based fluid pumps turned off.
Figure 12A:
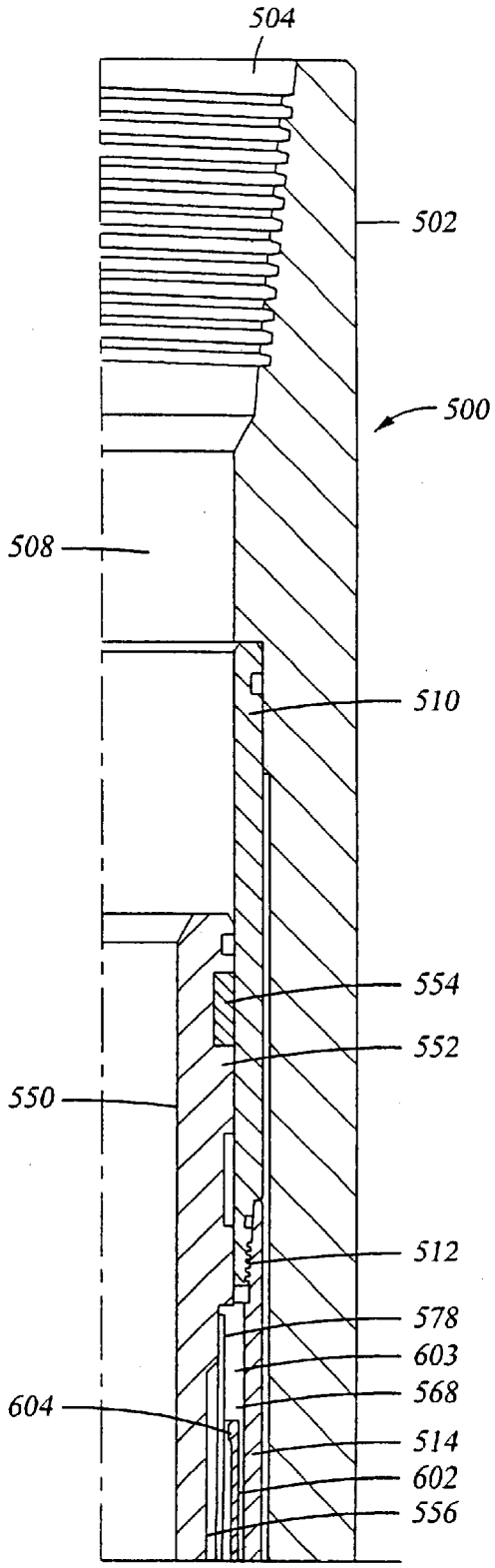
Figure 11B:
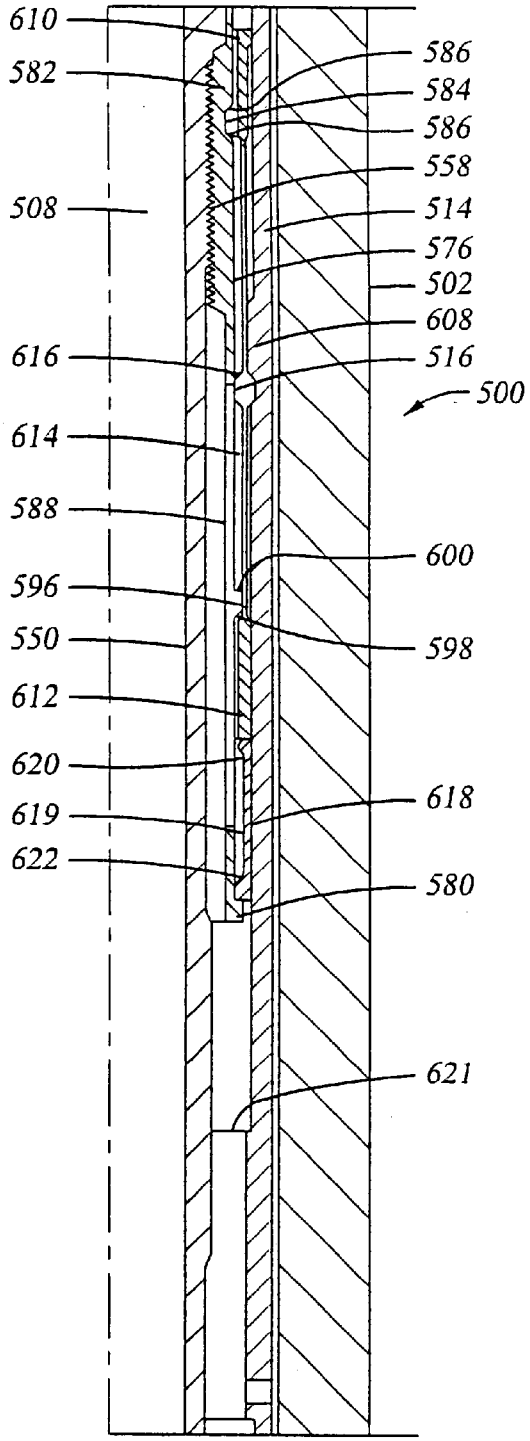
Figure 12B:
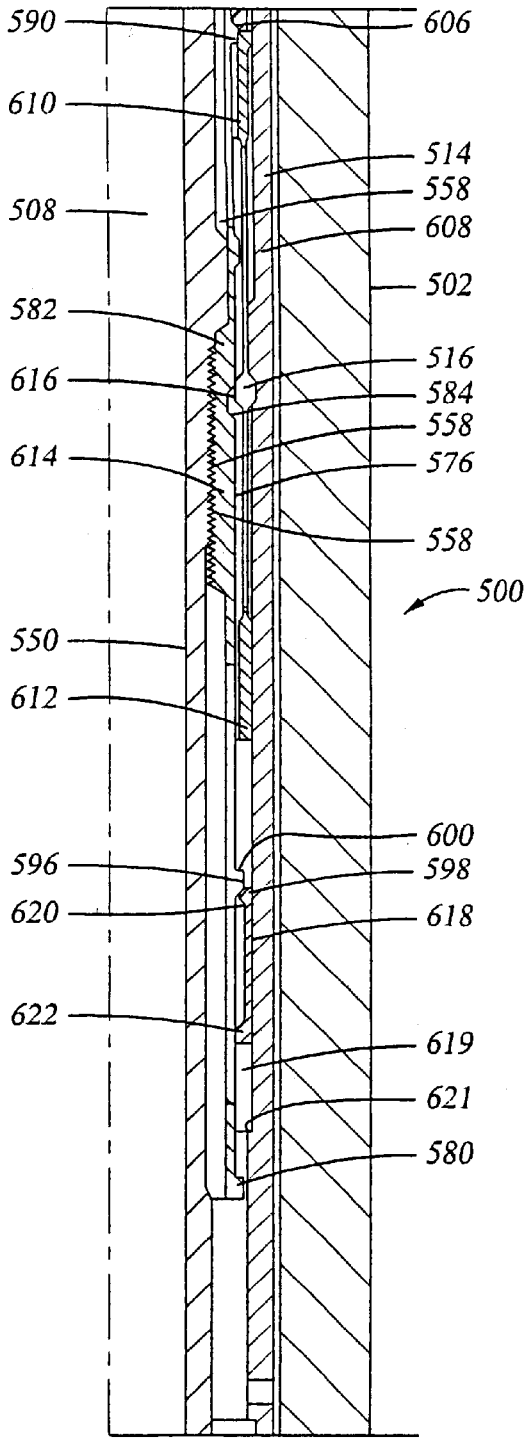

Referring now to FIGS. 11A, B, C and D, a second embodiment of the invention is described. A bypass valve assembly 500 is depicted which is similar in many respects to the flow control apparatus 14 described earlier. The bypass valve assembly 500 includes an outer housing 502. As shown in FIGS. 11A–11D, the outer housing 502 is a single piece. However, the housing may be composed of several different subs which are affixed together. The upper portion of the housing 502 includes a threaded end 504 for attachment to the lower end of a drill string (not shown). The lower portion of the housing 502 also includes a threaded end 506 for attachment to lower portions of a drill string. The housing 502 is tubular and defines a longitudinal flowbore 508 throughout its length. A fluid communication port 505 is disposed through the housing 502, and a bypass valve port 507 is also disposed through the housing 502 below the fluid communication port 505. Each of these ports is adapted to communicate fluid between the flowbore 508 within the housing 502 and the annulus of the drill string which surrounds the housing 502.

The housing 502 encloses a piston retaining sleeve 510 which is affixed by a thread 512 at its lower end to collet housing 514. A single inwardly directed annular groove 516 is disposed along the inner surface of the collet housing 514. A flow restrictor ring 518 is affixed by threaded connection 520 to the lower end of the collet housing 514. A plurality of fluid restrictors 522 are disposed through the ring 518.

Figure 11C:
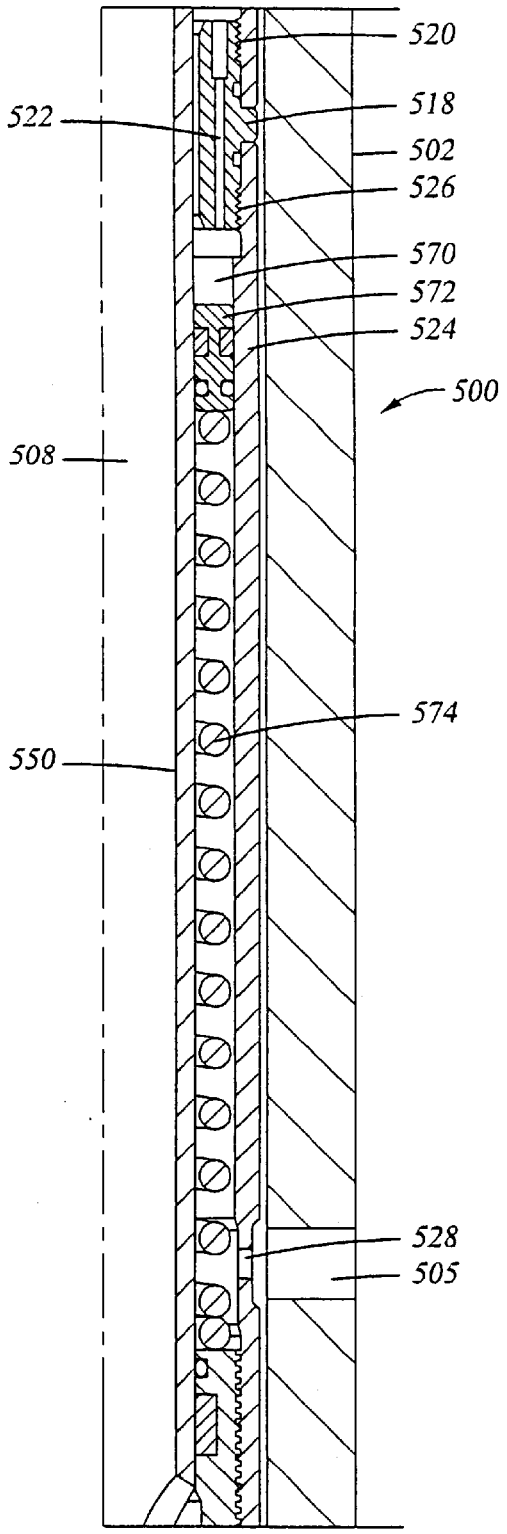
Figure 12C:
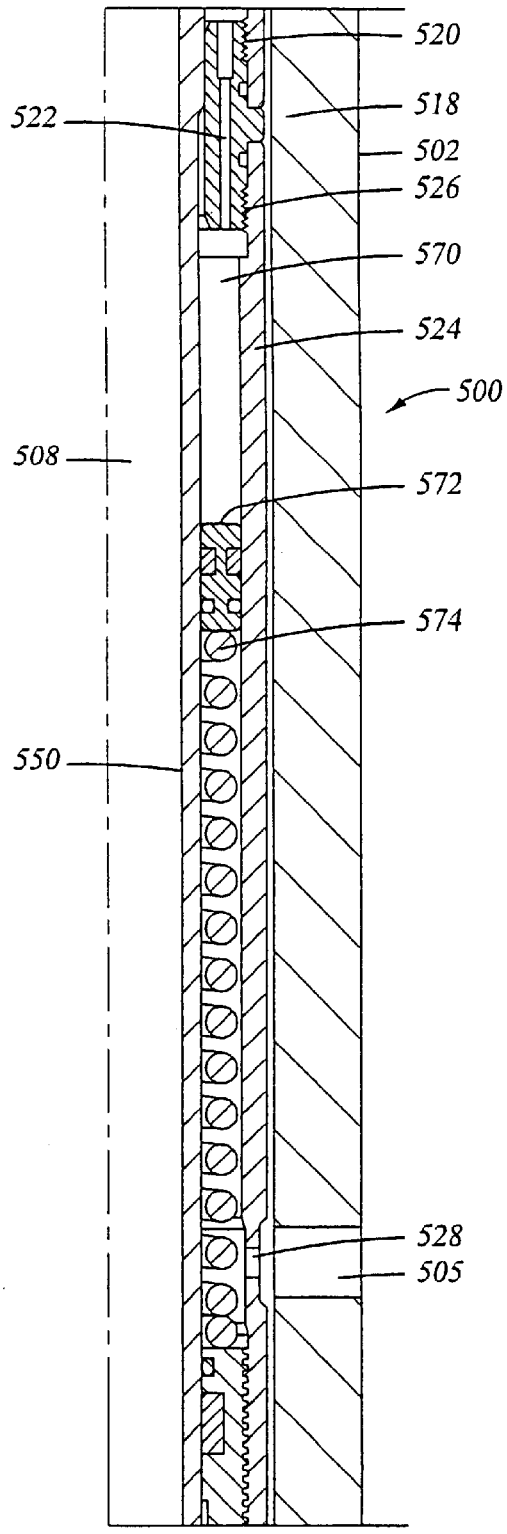
Figure 11D:
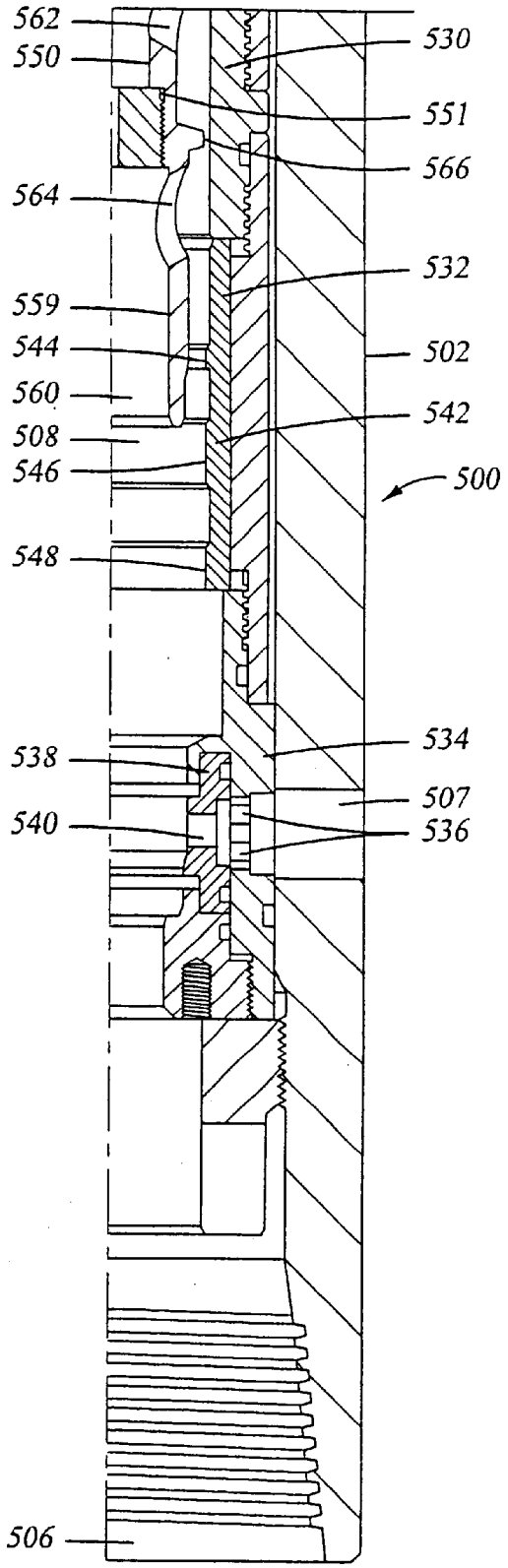
Figure 12D:
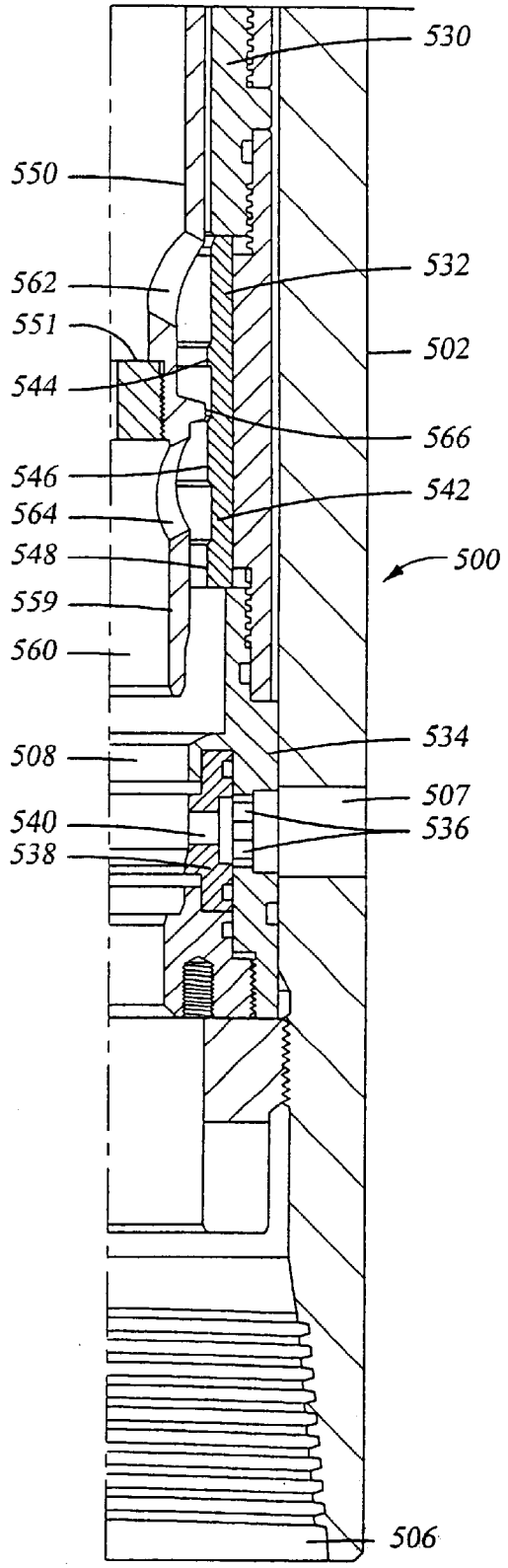
Figure 13A:
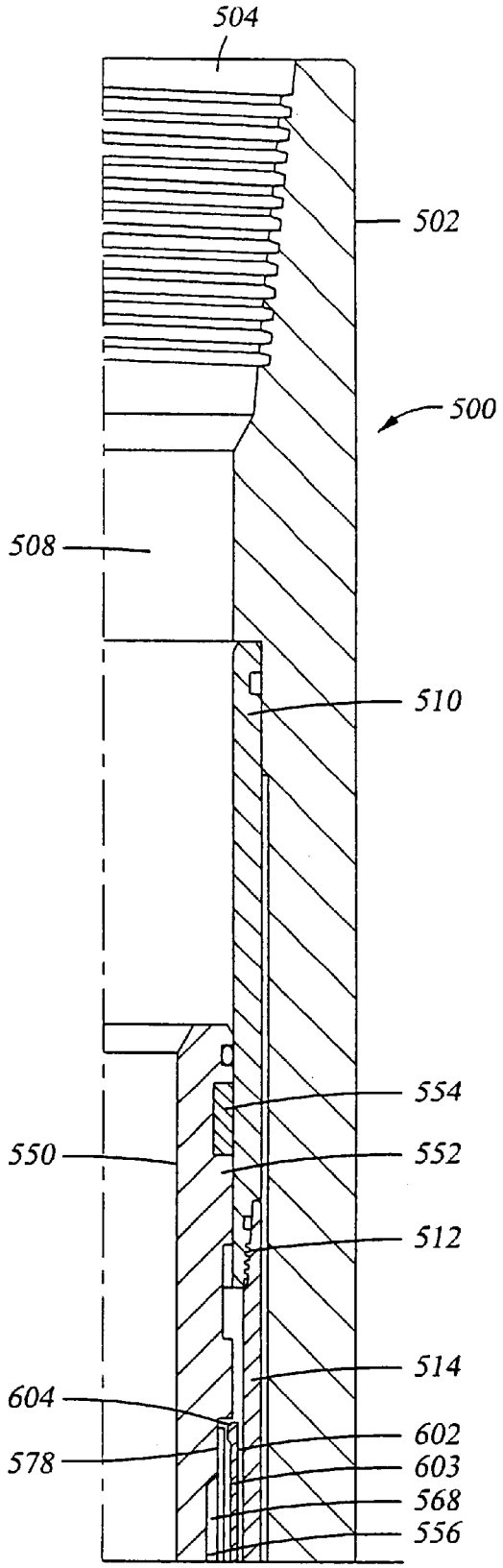
FIGS. 13A, B, C and D depict the bypass valve assembly of FIGS. 11A, B, C and D in partial cross-section, still in a flow-through mode, after the pumps have caused the assembly to be fully stroked.
Figure 14A:
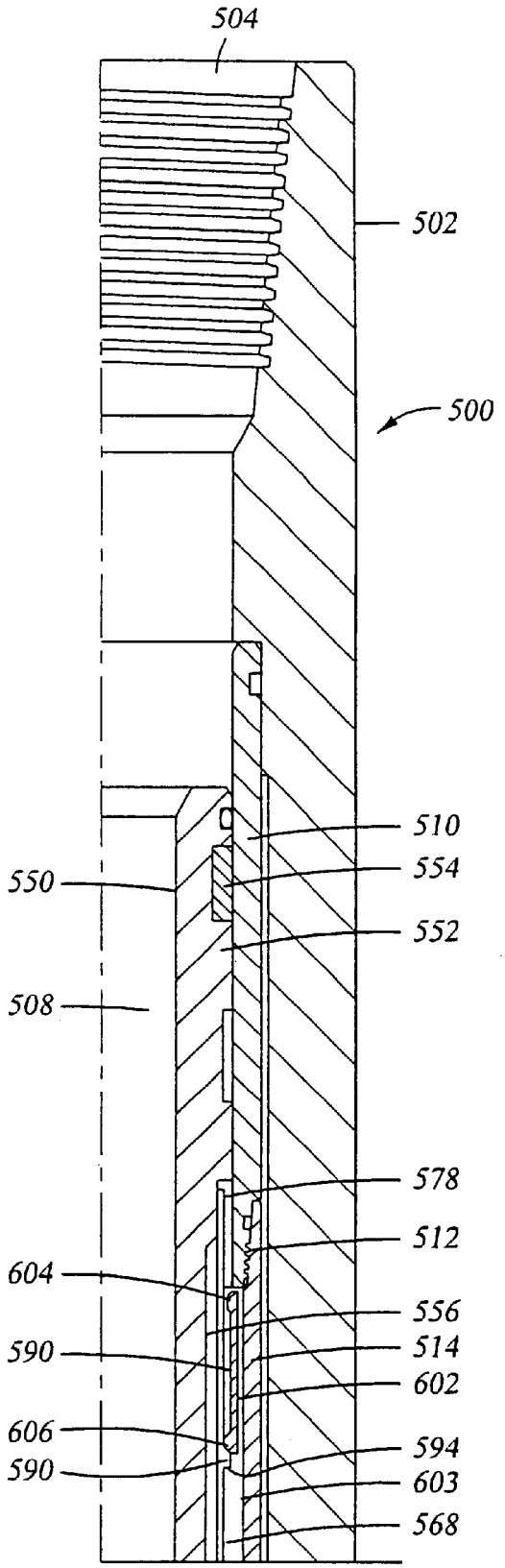
FIGS. 14A, B, C and D depict a partial cross-section of the bypass valve assembly of FIGS. 11A, B, C and D after surface-based pumps have been turned off during a prior pressure spike to permit operation of the bypass valve.
Figure 13B:
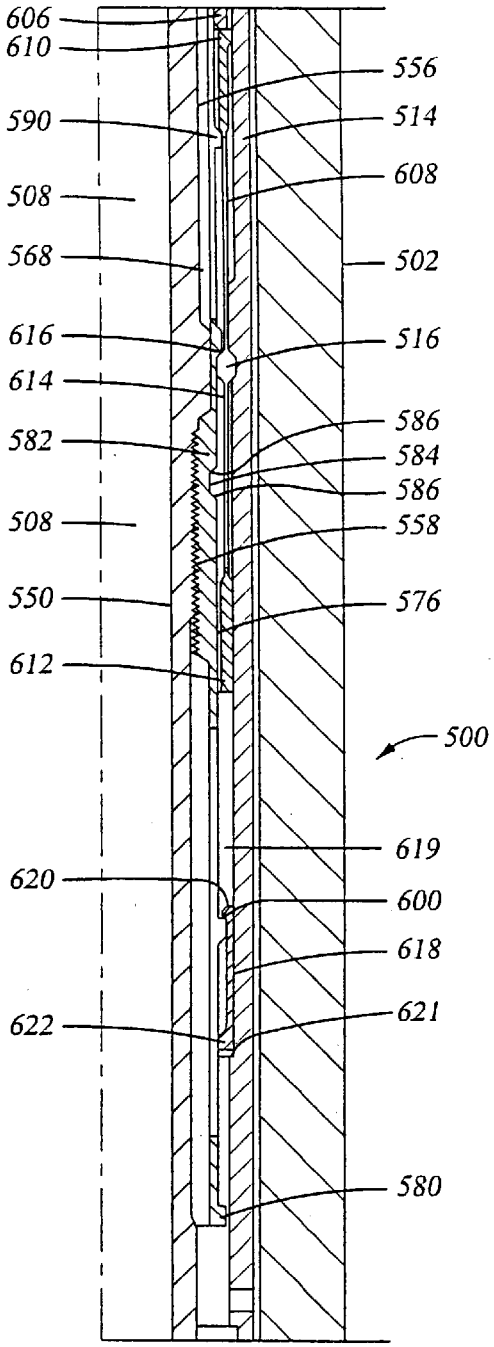
Figure 14B:
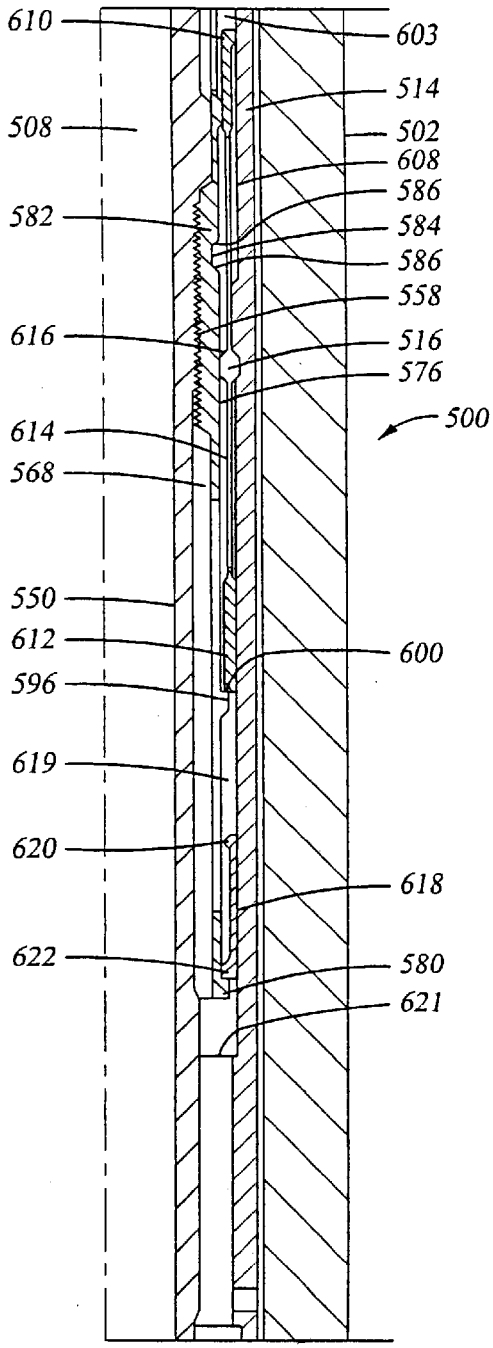
Figure 13C:
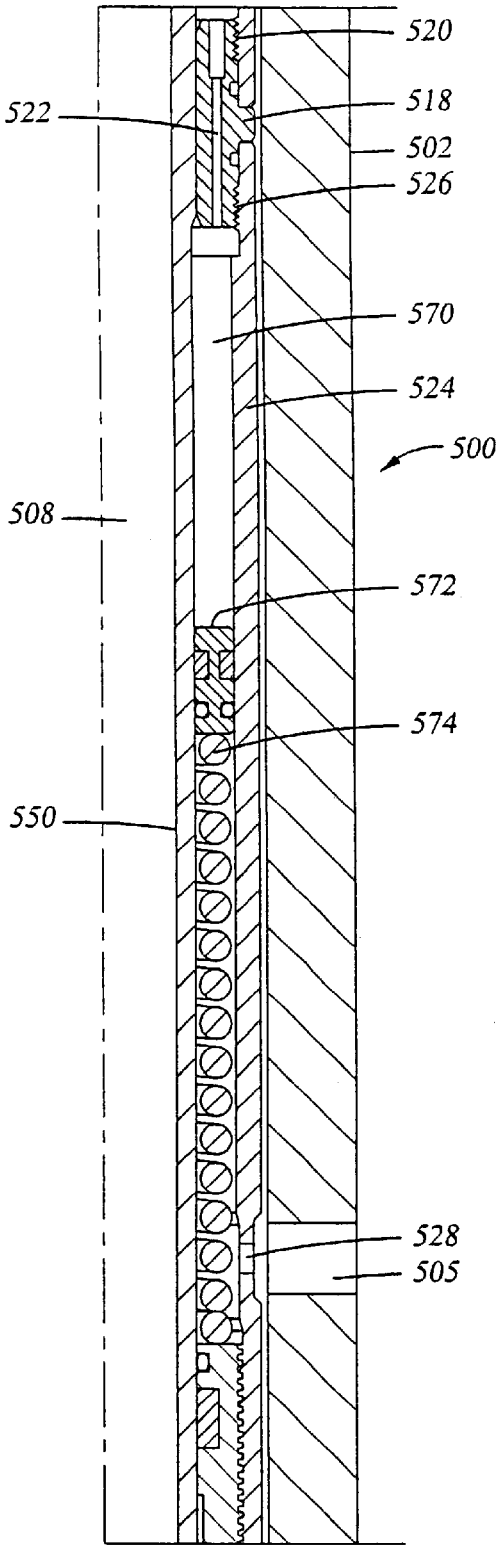
Figure 14C:
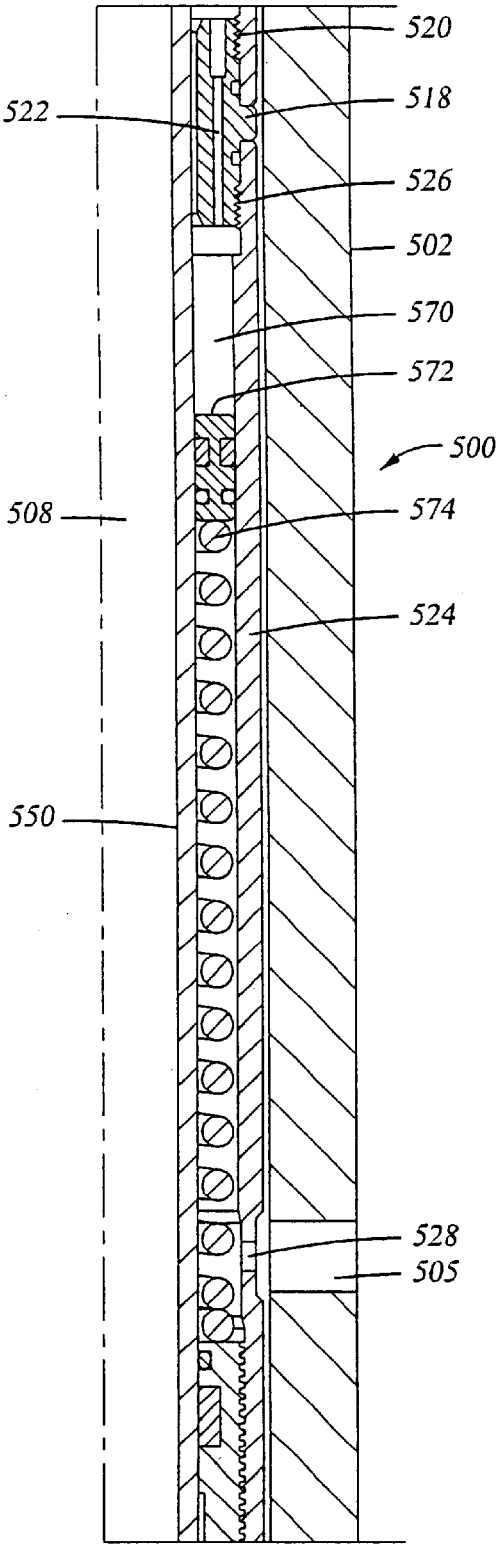
Figure 13D:
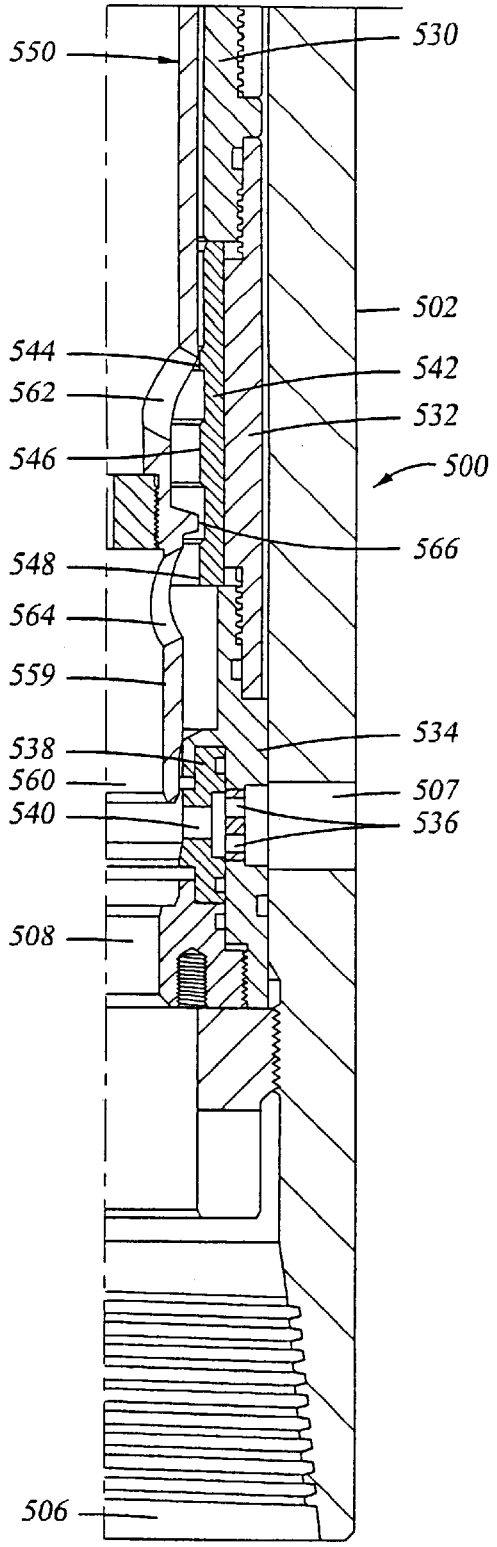
Figure 14D:
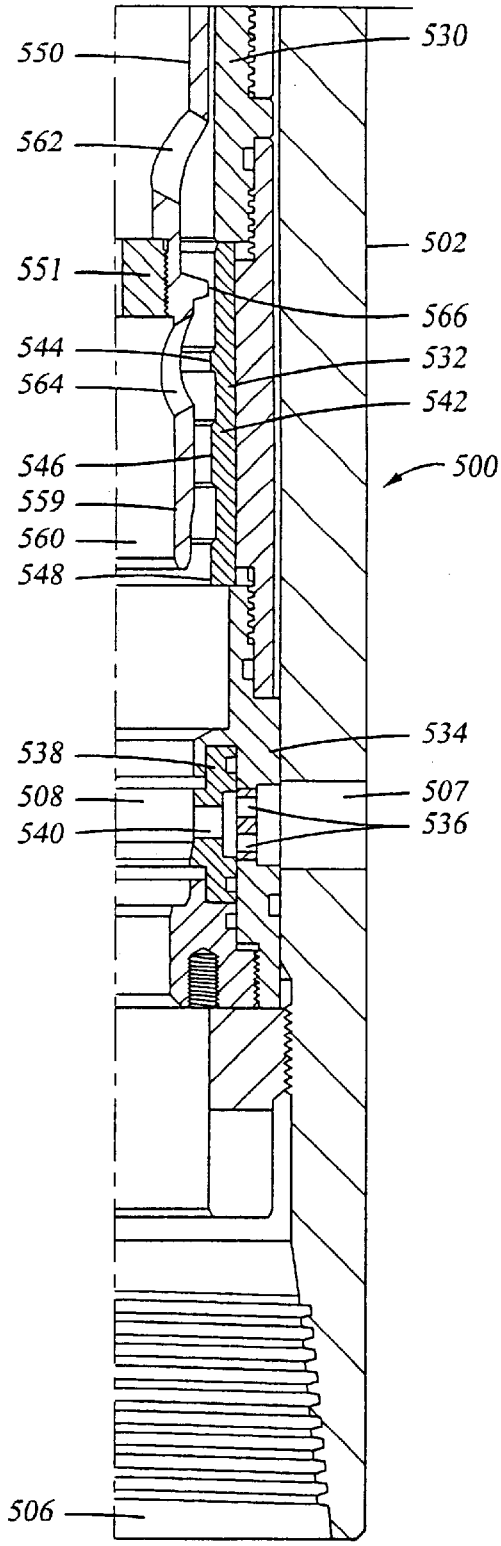

A lower sleeve 524 is also affixed by threading 526 to the lower end of the flow restrictor ring 518 and extends downwardly. A fluid communication port 528, shown in FIG. 11C, is disposed through the lower sleeve 78 and is approximately aligned with the fluid communication port 505 of housing 502. The lower sleeve 524 is threadedly connected to a connector sub 530. The connector sub 530 is threadedly affixed, at its upper end, to the lower sleeve 524 and, at its lower end to a ring sub 532. The ring sub 532, in turn, is attached by threaded connection to a bypass valve housing 534. The bypass valve housing 534 contains a plurality of lateral apertures 536. Bypass valve plug 538 lies radially inside of the bypass valve housing 534 and includes a bypass valve passage 540. The bypass valve passage 540 is aligned with apertures 536 and 528.

A flow control mandrel 542 is disposed radially within the ring sub 532. The inner surface of the flow control mandrel 542 presents three inwardly projecting annular flanges 544, 546 and 548.

An inner piston 550 is reciprocably disposed within the flowbore 508. A nozzle assembly 551 (see FIG. 11D) is retained within the lower portion of the inner piston 550. The nozzle assembly 551 serves to restrict fluid flow-through the inner piston 550, thus, essentially providing a fluid pressure receiving area for the inner piston 550. A radially extended piston ring 552 extends outwardly from the body of the inner piston 550 and includes outer annular seal 554. Beneath the ring 552, the inner piston 550 presents a reduced diameter mandrel 556 which presents outer threads 558. The lower end of the inner piston 550 provides a cylindrical wall 559 which defines an axial opening 560 through which fluid can flow. The lower end also includes upper and lower lateral flowports 562, 564 with an annular shoulder 566 disposed between. It is noted that the cylindrical wall 559 is shaped and sized to effectively close off the valve passage 540 against fluid flow when moved downward within the housing 508 to a point where the wall 559 is located adjacent the passage 540.

An upper annular fluid chamber 568 is defined on the radial interior by the inner piston 550 and on the radial exterior by the piston retaining sleeve 510 and the collet housing 514. The upper chamber 568 is bounded at its upper end by the ring 552 and at its lower end by the flow restrictor ring 518.

A lower annular fluid chamber 570 is defined on the radial interior by the inner piston 550 and on the radial exterior by the lower sleeve 524. The lower chamber 570 is bounded at its upper end by the flow restrictor ring 518 and at its lower end by the connector sub 530. An annular outer piston 572 is disposed within the lower chamber 570 and seals against both the inner piston 550 and the lower sleeve 524. Fluid can be communicated into and out of the lower fluid chamber 570 through the fluid communication ports 505 and 528. A compressible spring 574 is disposed below the outer piston 572 within the lower chamber 570 so that the spring 574 is compressed against the connector sub 530 as the outer piston 572 is moved downwardly within the lower chamber 570. Like the lower fluid chamber 116 described earlier, the lower chamber 570 and its associated components functions as a fluid spring which stores and releases fluid under pressure.

The upper fluid chamber 568 houses a fixed cylindrical catch collet 576 which is similar to the fixed cylindrical catch collet 128 described with respect to the flow control assembly 14 described earlier. The catch collet 576 includes a relatively flat cylindrical upper end 578 and an enlarged cylindrical lower end 580. The central portion 582 of the collet 576 includes an outwardly disposed groove 584 with angled side walls 586. A number of slotted ribs 588 extend between the central portion 582 and the upper and lower ends 578, 580 of the collet 576. The ribs 588 are similar in construction to the ribs 147 described earlier. There is an upper outwardly projecting annular flange 590 disposed upon the upper set of ribs 588 that has an angled upper surface 592 and a flat, downwardly projecting lower surface 594. A lower outwardly projecting annular flange 596 is disposed upon the lower set of ribs 588. The lower flange 596 presents an angled lower surface 598 and a flat, upwardly projecting surface 600.

Radially outside of the catch collet 576 is an upper floating sleeve 602 that presents upper and lower inwardly-directed annular ridges 604, 606. The ridges 604, 606 have angled surfaces and are shaped and sized to permit the flange 590 to slip over the ridges 604, 606 when the catch collet 576 is moved upwardly or downwardly.

A position collet 608 is disposed below the upper floating sleeve 602. Like the position collet 180 described earlier, the position collet 608 functions as an operating mode sleeve, has upper and lower annular ends 610, 612 and a slotted central section 614. The central slotted section 614 includes an enlarged portion 616 which is similar to the enlarged portion 192 described with respect to the flow control assembly 14. The enlarged portion 616 is shaped and sized to fit within the groove 516 in the collet housing 514 as well as the groove 584 of the catch collet 576.

Below the position collet 608 is a lower floating sleeve 618. The lower floating sleeve 618 is identical in construction to the upper floating sleeve 602, having upper and lower inwardly-directed annular ridges 620, 622.

The upper floating sleeve 602 is reciprocably disposed within a radial gap 603 which is bounded at its upper end by the lower end of the piston retaining sleeve 510, and at its lower end by the upper end 610 of the position collet 608. The lower floating sleeve 618 is reciprocably disposed within a radial gap 619 which is bounded at its upper end by the lower end 612 of the position collet 608 and at its lower end by an annular shoulder 621.

Operation of the Bypass Valve Assembly 500

FIGS. 11A, B, C and D illustrate the bypass valve assembly 500 in a "flow-through" mode such that fluid flowing downward from within a drill string (not shown) into the housing 502 will pass into the flowbore 508, be disposed downward within the inner piston 550 and nozzle 551, pass through axial opening 560, and exit the assembly 500 through the lower threaded end 506. A portion of the fluid passing through the axial opening 560 will flow laterally outward through the valve assembly made up of the bypass valve passage 540, apertures 536 and bypass valve port 507. The bypass valve assembly 500 will remain in a flow-through mode so long as the enlarged portion 616 of the position collet 608 is retained within the groove 516 of the collet housing 514. Therefore, the valve passage 540 cannot be closed off against fluid flow when the bypass valve assembly 500 is in a flow-through mode.

As surface-based fluid pumps (not shown) are turned on, and fluid pressure is increased within the flowbore 508, the inner piston 550 is moved downwardly within the flowbore 508. Due to the threaded connection 558, downward movement of the inner piston 550 within the flowbore 508 will cause the catch collet 576 to move downward as well. Fluid within the upper chamber 568 will be compressed by downward movement of the ring 552 within the piston retaining sleeve 510. As a result, fluid within the upper chamber 568 will be metered through the fluid restrictors 522 and into the lower chamber 570.

FIGS. 12A–12D depict the bypass assembly 500 after the fluid pump has been turned on to stroke the inner piston 550 partially downward. FIGS. 13A–13D show the bypass assembly 500 after the inner piston 550 has been stroked fully downward in the flow-through mode. As the piston 500 moves downwardly, the upper flange 590 of the catch collet 608 passes over the lower ridge 606 of the upper floating sleeve 602 and is disposed within the upper end 610 of the position collet 608. See FIG. 12B. Thus, the position collet 608 is not shifted downward within the housing 502 along with the catch collet 576, and the enlarged portion 616 remains disposed within the groove 516 of the collet housing 514. The lower flange 596 of the catch collet 576 engages the lower floating collar 618 and moves it downwardly within the radial gap 619 (see FIG. 12B) until the lower floating collar 618 abuts the shoulder 621 and can move no further downward. The lower flange 596 will then be moved over the upper ridge 620 of the lower floating collar 618. See FIG. 13B. It is noted that, in the fully downward position depicted by FIGS. 13A–13D, the annular flange 566 of the inner piston 550 will not be disposed low enough within the housing 502 to become substantially aligned with the central flange 546 of the housing 502.

FIGS. 14A–14D illustrate the bypass assembly 500 after fluid pressure within the flowbore 508 is subsequently reduced by turning the surface-based pump off. Fluid stored within the lower fluid chamber 570 will be urged upwardly through the fluid restrictors 522 by the annular piston 572 and into the upper fluid chamber 568. The inner piston 550 and catch collet 576 move upwardly within the housing 502. This upward movement causes the upper flange 590 of the catch collet 576 to move above the upper end 610 of the position collet 608 and engage the lower ridge 606 of the upper floating collar 602, thus lifting the upper floating collar 602.

The lower flange 596 of the catch collet 576 is slipped over the upper ridge 620 of the lower floating sleeve 618. Further upward movement of the catch collet 576 brings the flat upwardly-projecting surface 600 of the lower flange 600 into mating engagement with the lower end 612 of the position collet 608, thus halting further upward movement of the inner piston 550. Because the upper flange 590 is located below the upper floating collar 602, downward movement of the inner piston 550 and catch collet 576 at this point will result in the upper flange 590 becoming engaged in a mating relationship with the upper end 610 of the position collet 608. As the groove 584 of the catch collet 576 becomes aligned with the enlarged portion 616 of the position collet 608 during this downward movement, the ribs 614 will be able to flex outwardly permitting the enlarged portion 616 to be recessed into the groove 584 and be moved out of the groove 516 in the collet housing 514.

Figure 15A:
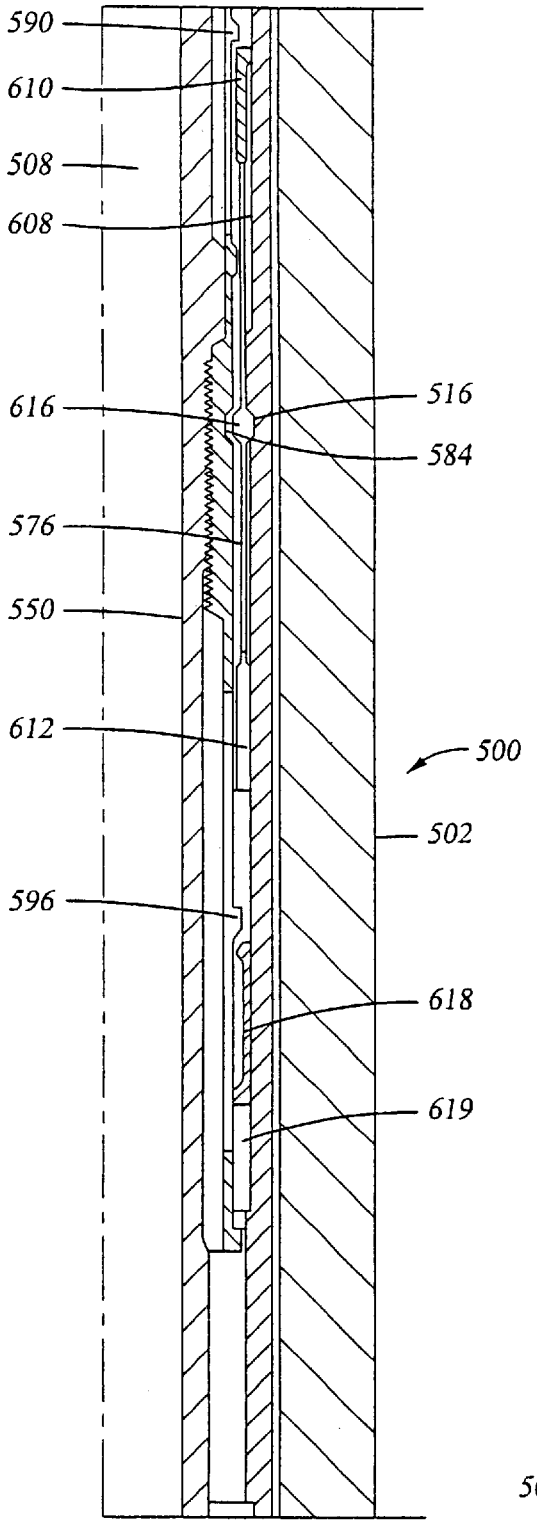
FIGS. 15A and B show portions of the bypass valve assembly configured for movement out of a flow-through mode and into a valve control mode.
Figure 15B:
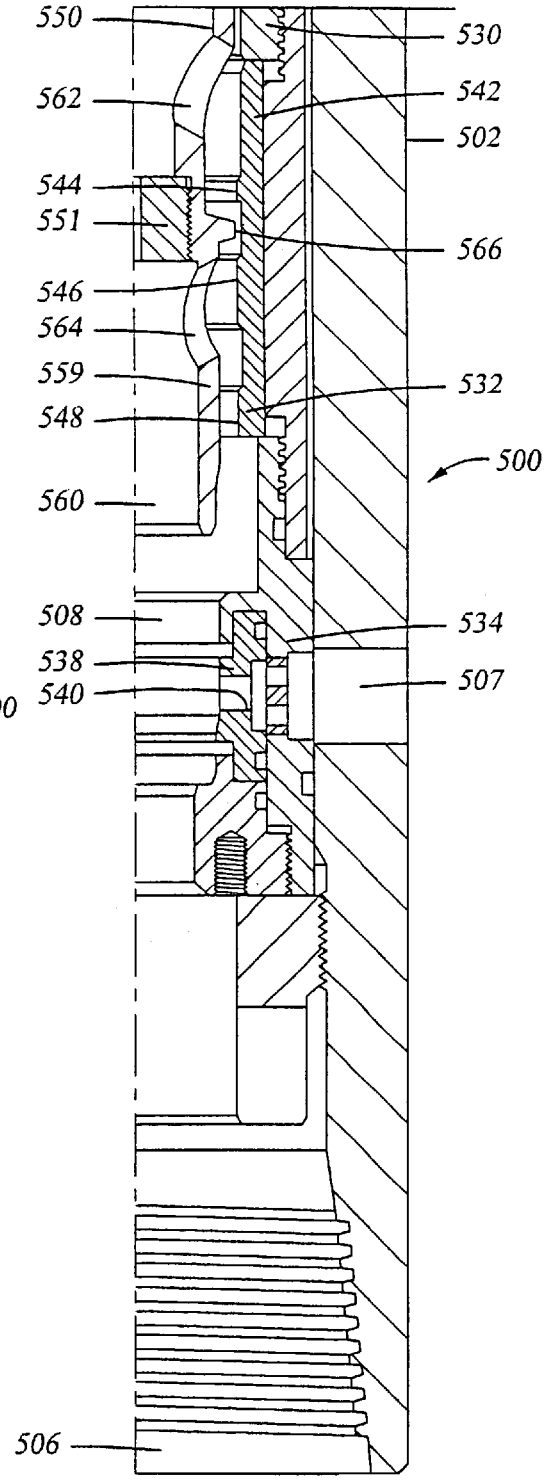
Figure 16A:
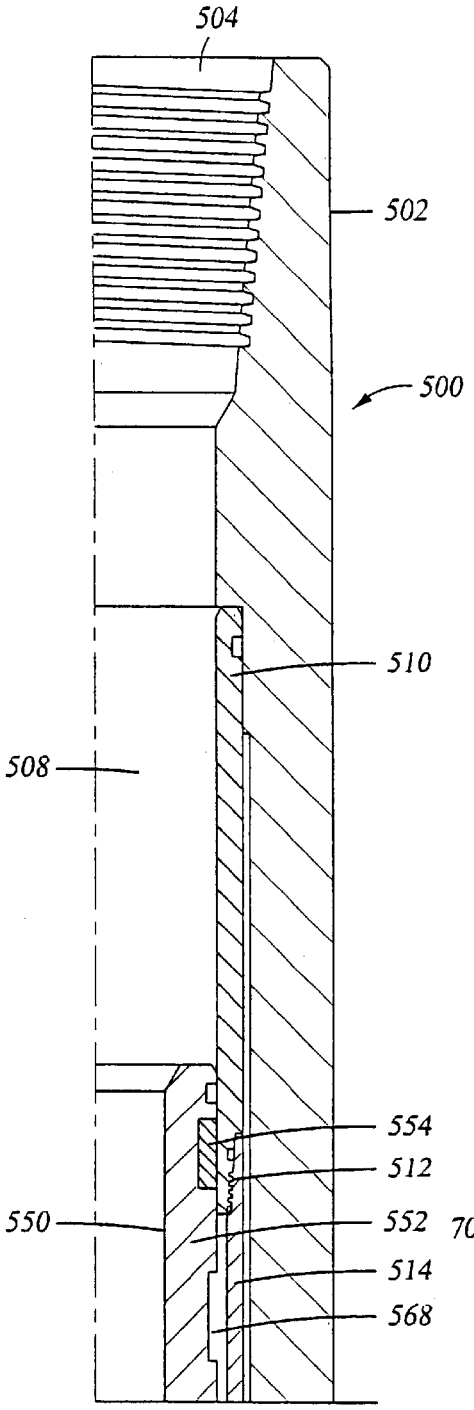
FIGS. 16A, B, C and D depict a partial cross-section of the bypass valve assembly of FIGS. 11A, B, C and D moved into a valve control mode. Surface-based fluid pumps have been turned on, and the bypass valve is closed.

In FIGS. 15A and 15B, portions of the bypass valve assembly 500 are shown with the inner piston 550 in an alignment position such that an increase in fluid pressure within the flowbore 508 will move the assembly 500 out of the flow-through mode and into a valve control mode. As depicted, the upper flange 590 of the catch collet 576 is in a mating engagement with the upper end 610 of the position collet 608. Also, the groove 584 of the catch collet 576 is aligned with the enlarged portion 616. As FIG. 15B shows, this location of the inner piston 550 within the housing 502 results in the annular flange 566 of the piston becoming generally aligned with the central flange 546 of the housing 502. In the manner described earlier with respect to the flow control assembly 14, a pressure pulse is created which is indicative of placement of the inner piston 550 in an alignment position such that manipulation of the fluid pumps will result in the bypass valve assembly 500 being moved out of the flow-through mode and into a valve control mode.

Figure 16B:
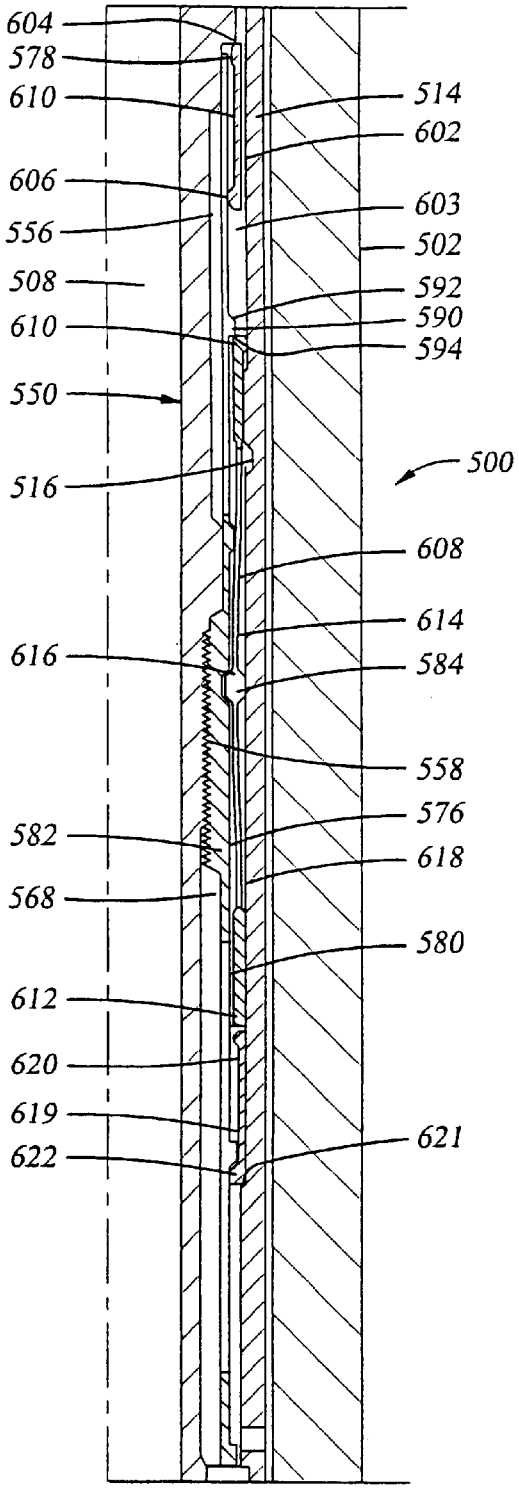

Referring now to FIGS. 16A–16D, the bypass valve assembly 500 is depicted in a configuration wherein the assembly 500 has been moved out of the flow-through mode and into a valve control mode. As FIG. 16B shows, the lower face 594 of the upper flange 590 is engaged with the upper end 610 of the position collet 608. The cylindrical wall 559 has been moved downwardly within the housing 508 to a position wherein it is adjacent the valve passage 540, thereby closing the passage 540 to fluid flow therethrough. Upon a decrease in fluid pressure within the flowbore 508, i.e., by turning off the fluid pump, the inner piston 550 can move upwardly within the housing 502, thus opening the valve passage 540 to fluid flow once again.

Operator Control of the Bypass Valve Assembly 500

Because the housing 502 of the bypass valve assembly 500 is provided with three flanges 544, 546 and 548, there are three potential pressure pulses which can be generated by the assembly 500. One such pulse should occur when the annular flange 566 of the inner piston 550 is substantially aligned with the upper flange 544. A second occurs when the annular flange 566 is substantially aligned with the central flange 546, and a third when the flange 566 is substantially aligned with the lower flange 548. As with the flange arrangements in the flow control assembly 14, the pulses occur as a result of fluid restriction caused when the flanges align themselves.

Referring once more to FIGS. 15A and 15B, it is noted that the rig operator should actuate fluid pumps or increase fluid pressure within the flowbore 508 as the annular flange 566 of the inner piston 550 becomes substantially aligned with the central flange 546 of the housing 502. As an acoustical signal, or pressure pulse, is generated by this alignment of the flanges 566 and 546, it should be apparent that the presence of this pulse serves as an indicator to the rig operator that the bypass valve assembly is configured to be shifted out of a flow-through mode and into a valve control mode by turning off the pumps.

As noted previously, in the flow-through mode, the bypass valve assembly 500 cannot be actuated to move the inner piston 550 downward far enough so that the annular flange 566 of the inner piston 550 will align with the lower flange 548 of the housing 502. Therefore, a rig operator will only be able to detect two pressure pulses during movement of the inner piston 550 while the bypass valve assembly 500 is in the flow-through mode. When the bypass valve assembly 500 is in the valve control mode, however, the inner piston 550 is capable of moving downward sufficiently so that the annular flange 566 can align with the lower flange 548. As a result, a rig operator would be able to detect three pressure pulses during movement of the inner piston 550 while the bypass valve assembly 500 is in the valve control mode. Thus, the presence of the third pulse operates as a signal to indicate that the bypass valve assembly is in the valve control mode.

The pulse resulting from alignment of the annular flange 566 with the upper flange 544 should primarily serve as a "warning" pulse or signal to provide the rig operator advance notice that, as the inner piston 550 moves further downward, it will reach an alignment position within the housing, during which further movement downward will cause the position collet 608 to move downwardly as well, so that the enlarged portion 616 is removed from the groove 516.

Movement of the bypass valve assembly 500 from the valve control mode to the flow-through mode occurs when the inner piston 550 is moved upwardly sufficiently so that the enlarged portion 616 of the position collet 608 is moved back into the groove 516. Due to the spring bias created from the inward bias of the bands 614, the enlarged portion 616 should snap into engagement with the groove 516. As FIGS. 15A and 15B illustrate, this should occur when the annular flange 566 of the inner piston 550 is substantially aligned with the central flange 546 of the housing 502. Thus, if the fluid pump is turned off at the time that the valve passage 540 is closed against fluid flow by the cylindrical wall 559, upward movement of the inner piston 550 will open the valve passage 540 to permit fluid flow therethrough. Alignment of the annular flange 556 of the inner piston 550 with the lower flange 548 of the housing 502 will result in an additional warning pulse signifying that the bypass ports will be closed if pump flow is continued.

It can, therefore, be seen that the present invention provides methods for operating a valve within a well bore to selectively open or close the valve, whether that valve is the valve assembly 26, bypass valve assembly 500 or other valve arrangements.

It can also be seen that the present invention provides methods for remotely altering the operational mode of a component within a well bore, whether the component is the flow control assembly 14, the bypass valve assembly 500 or another suitable device. The invention permits the operational mode of the component to be changed between a first operational mode, such as the flow-through mode and a second operational mode, such as the valve control mode. Accordingly, the component may be disposed within the well and placed in the first operational mode. A first moveable member within the component, such as the inner piston 92 of the flow control assembly 14 or the inner piston 550 of the bypass valve assembly 500, is then moved to a predetermined position. When the first moveable member is located at this predetermined position, the well operator is afforded a window of opportunity for changing the operational mode of the component. In order to provide the operator notice of the window of opportunity, the component generates a signal, such as a fluid pulse, which indicates that the operator can change the operational mode of the component. The fluid pulse created by the component is transmitted through fluid within the well bore to a receiver that is conventionally located at or near the surface of the well bore. As described earlier, the receiver can be an oil well standpipe pressure gauge of a type known in the art. The methods of the present invention also describe changing the operational mode of the component by moving a second moveable member within the component. This second moveable member has been described as the floating position collet 180 of the flow control assembly 14 and the floating position collet 608 of the bypass valve assembly 500.

Structure of the Bypass Valve Assembly 700

Referring now to FIGS. 17A–17F as well as 18–25, an alternative embodiment for a bypass valve assembly of the present invention is depicted. Bypass valve assembly 700 is similar in many respects to bypass valve assembly 500 and, where components of the two embodiments are alike, like reference numerals are used in the description. In FIGS. 17A–17F, the bypass valve assembly 700 is depicted with the valve assembly open so that the valve passage 540 (FIGS. 17E and 17F) is open to fluid flow. As with the bypass valve assembly 500, the assembly 700 is capable of being operated in either a flow through mode or a valve control mode, as will be hereinafter described. It is noted that, at present, the use of a ratchet assembly, as illustrated by the embodiment depicted in FIGS. 17A–17F is the most preferred embodiment of the invention.

Figure 17A:
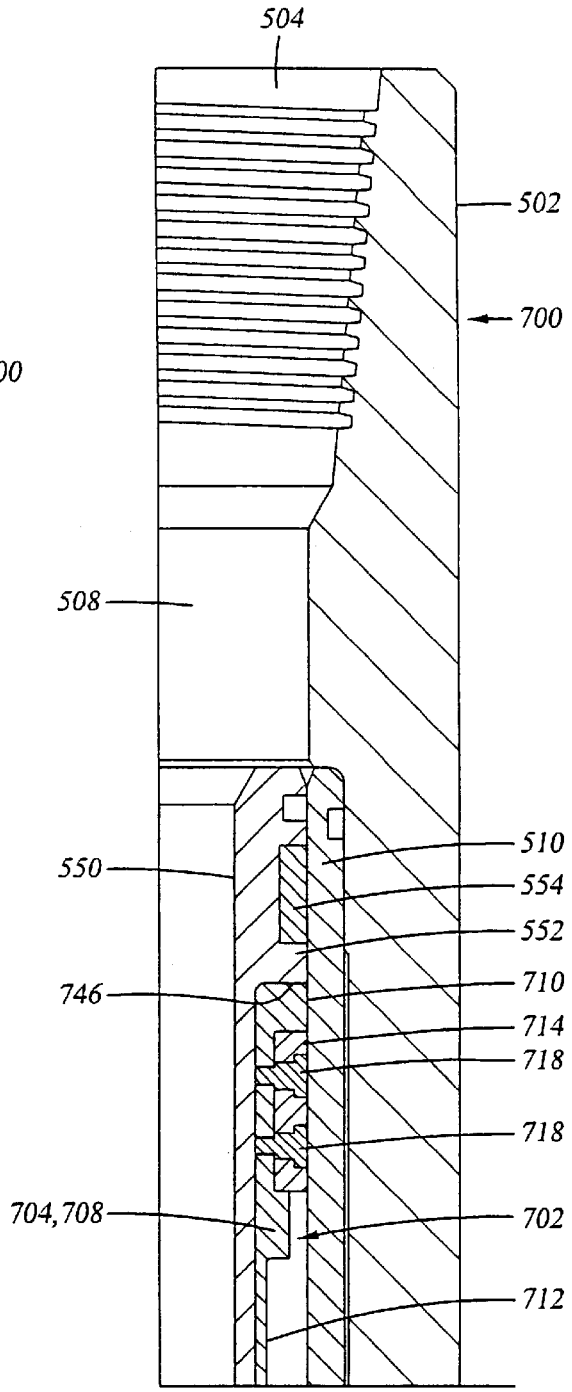
FIGS. 17A–17F are a partial cross-section depicting an alternative embodiment of a bypass valve assembly constructed in accordance with the present invention.
Figure 17B:
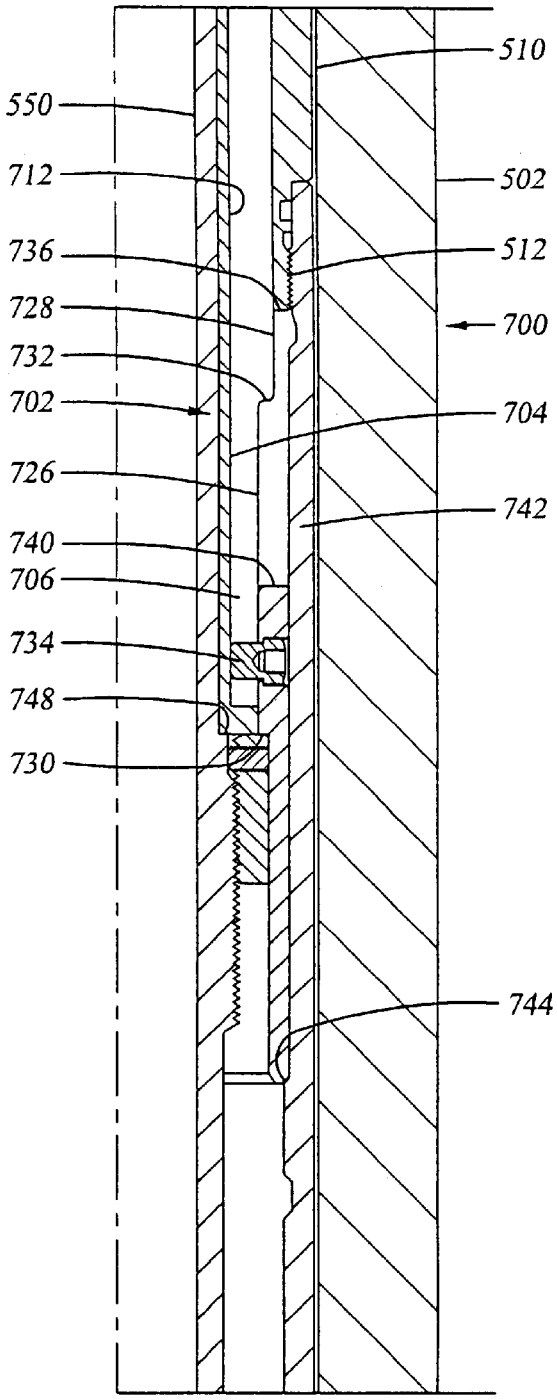
Figure 16C:
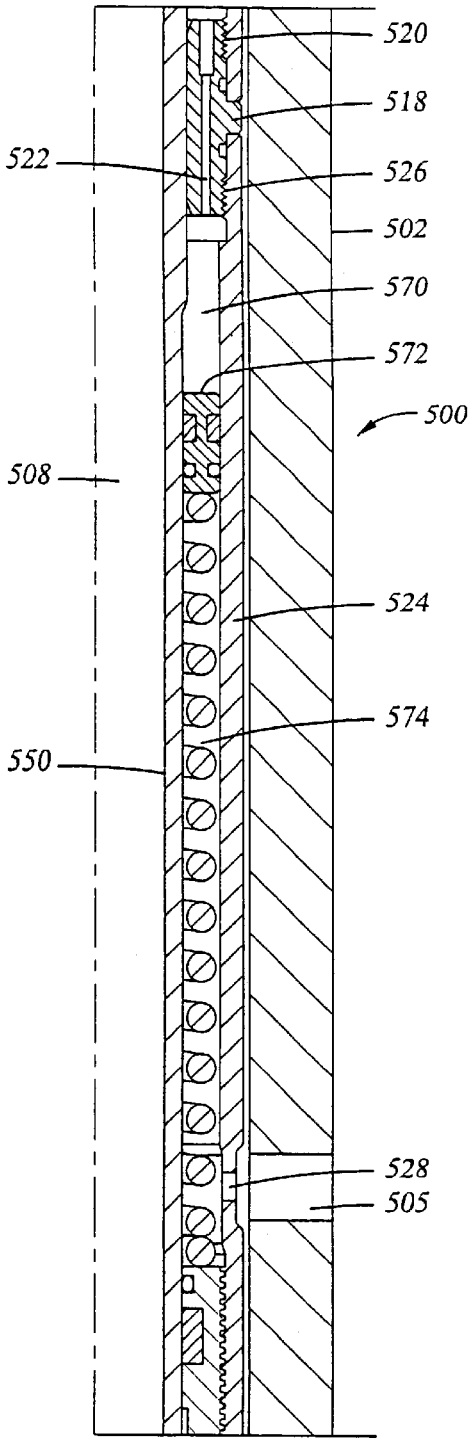
Figure 17C:
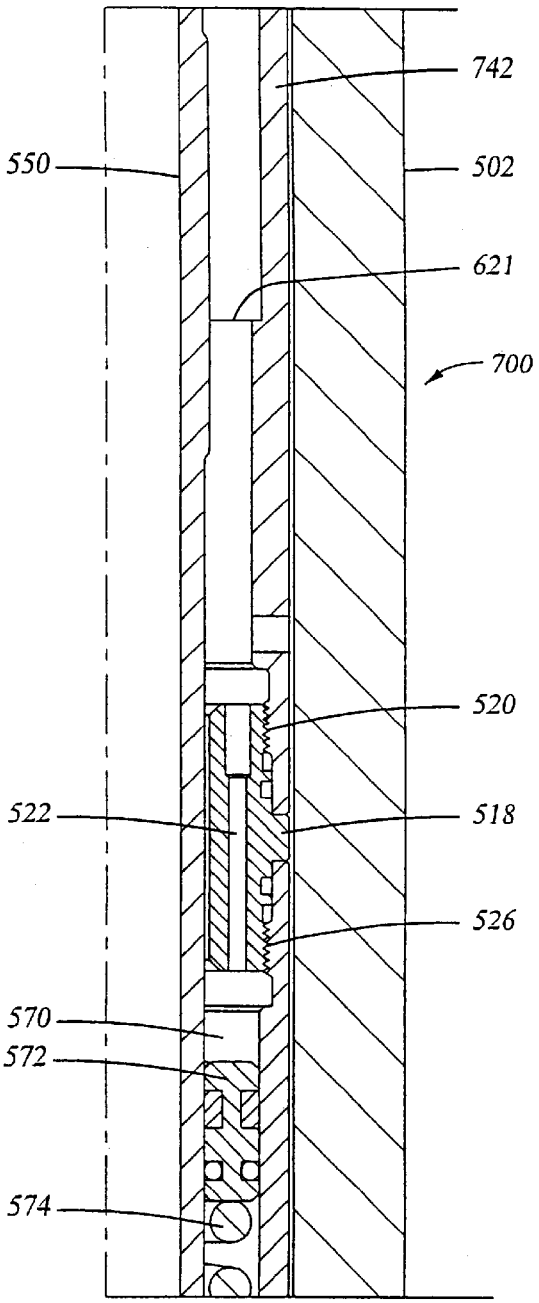
Figure 16D:
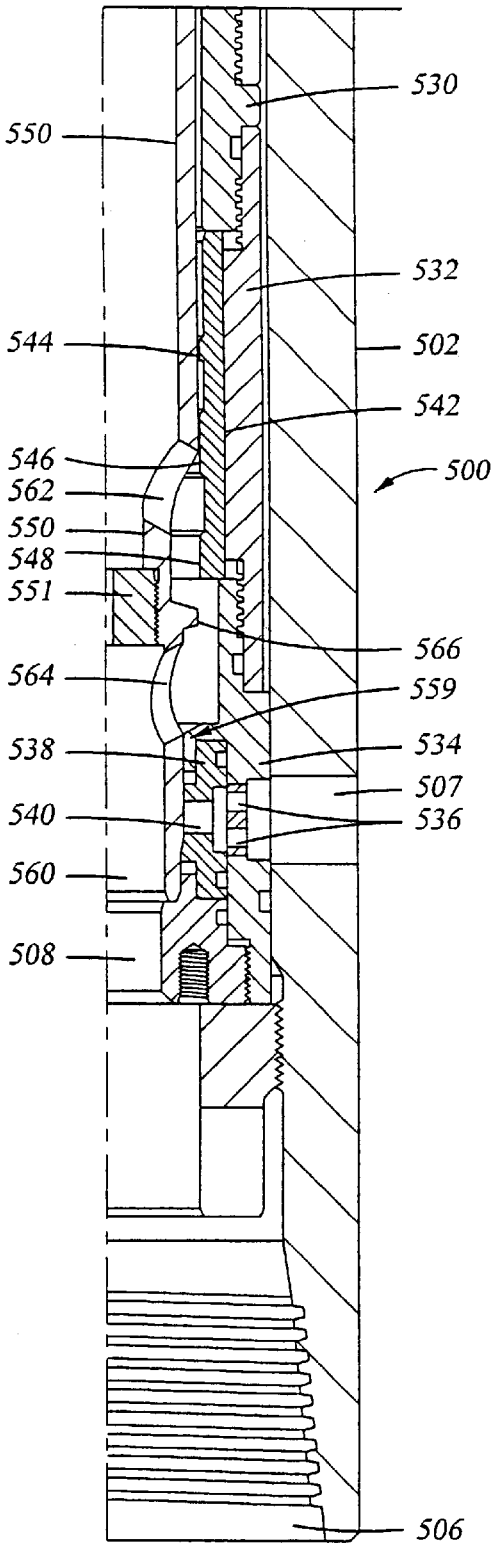
Figure 17D:
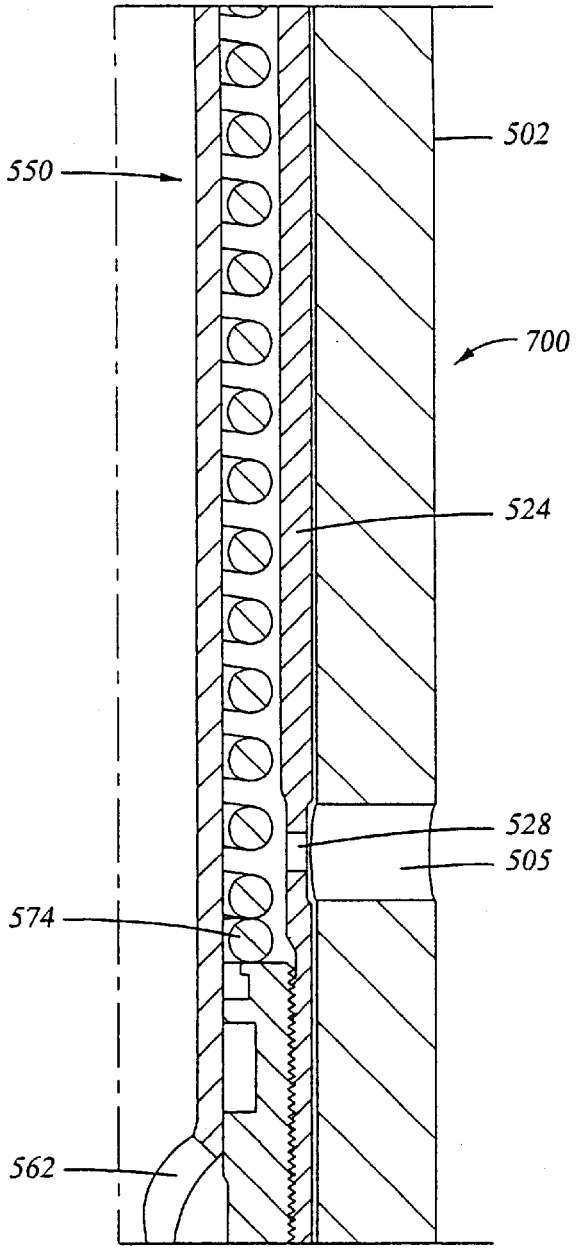
Figure 17E:
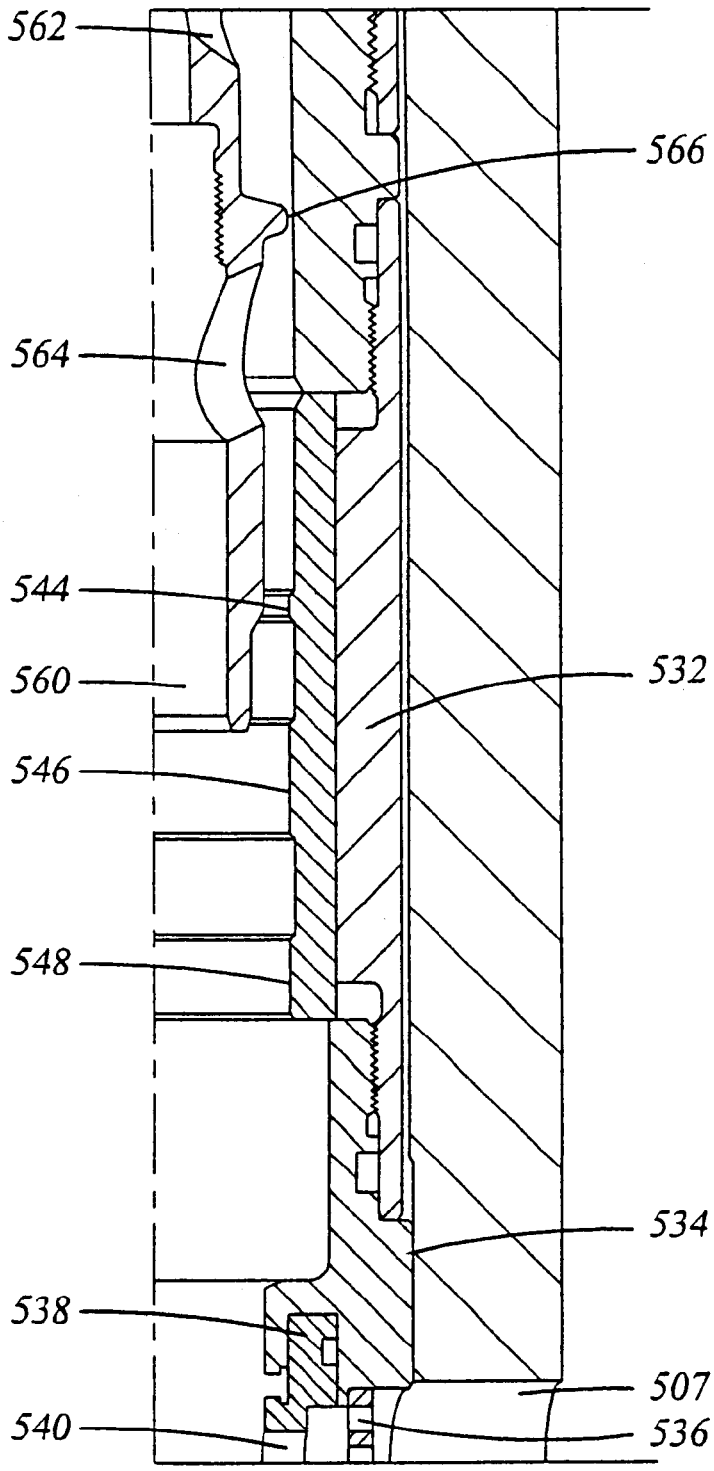
Figure 17F:
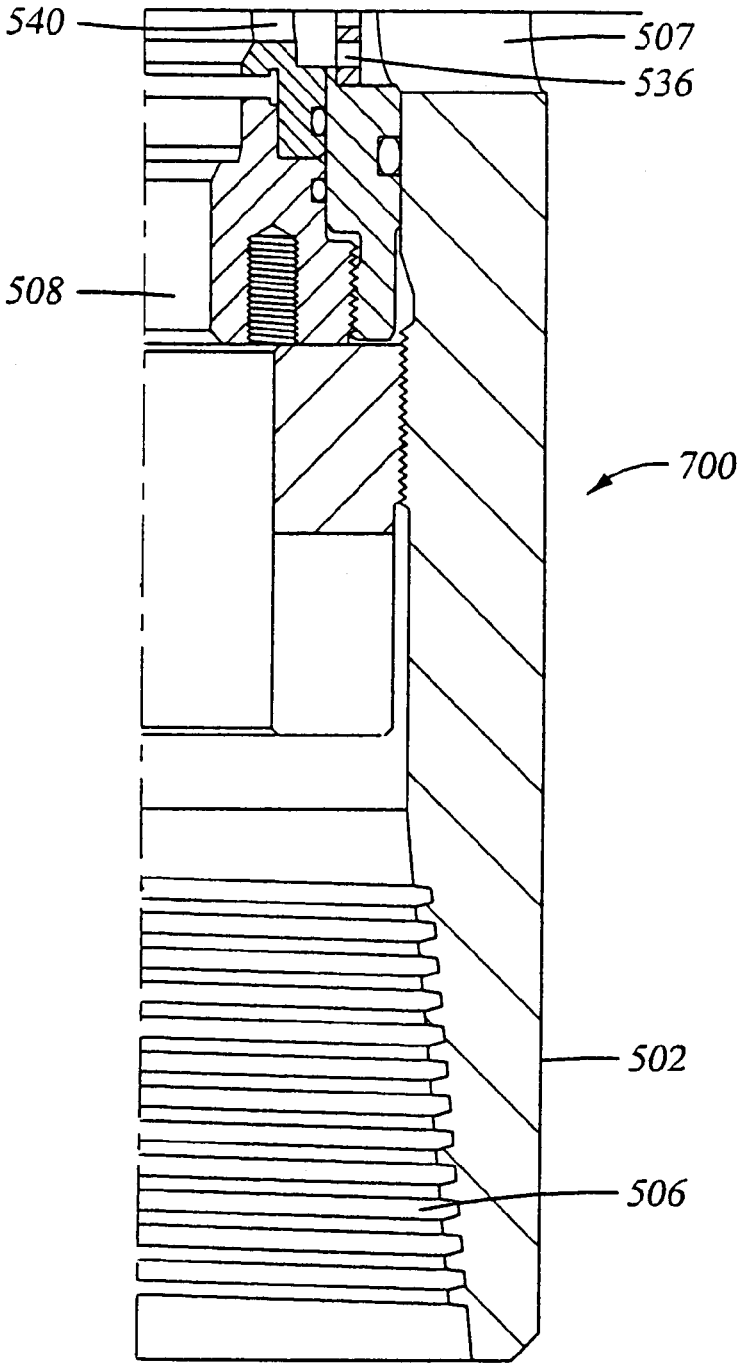
Figure 18:
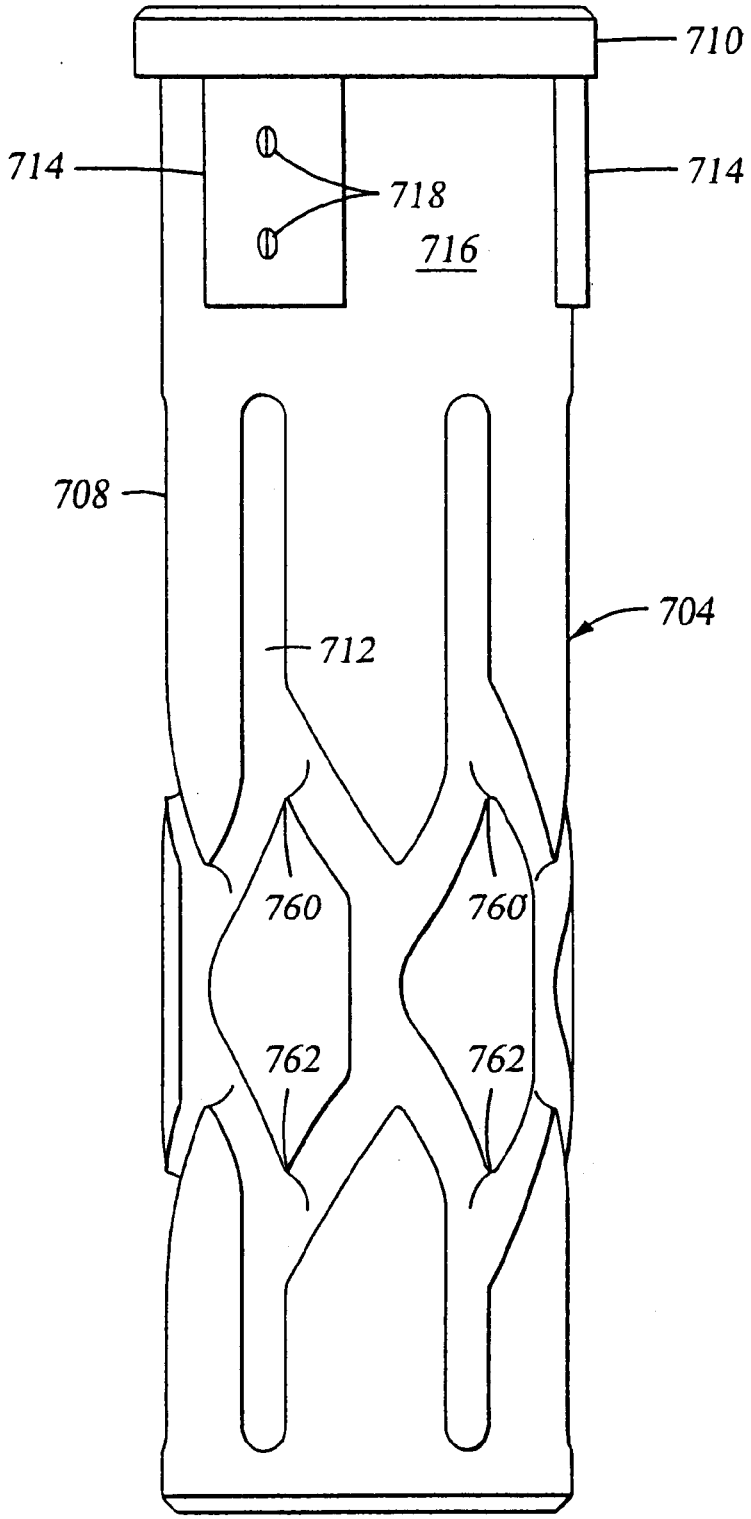
FIG. 18 is an external side view of an exemplary ratchet path sleeve for use in the bypass valve assembly of FIGS. 17A–17F.

As best seen in FIGS. 17A and 17B, the inner piston 550 houses a ratchet assembly 702 which connects the piston 550 to the housing 502. The ratchet assembly 702 includes a ratchet path sleeve 704 and a ratchet lug sleeve 706. These components are depicted in greater detail in FIGS. 18–25. The ratchet path sleeve 704 includes a reduced diameter elongated tubular body 708 with an outwardly projecting annular lip 710 at the upper end. The body 708 includes a ratchet path 712 which is formed by milling out portions of the outer surface of the body 708. The ratchet path 712 is hereinafter described in greater detail. A plurality of generally rectangular metal plates 714 are affixed to the body 708 of the ratchet path sleeve 704. In currently preferred embodiments, three plates 714 are affixed to the body spaced from each other 120° about the circumference of the body 708 such that spaces or gaps 716 are left between each pair of the plates 714. Flat-headed screws 718 may be used to affix the plates 714 to the body 708.

Figure 19:
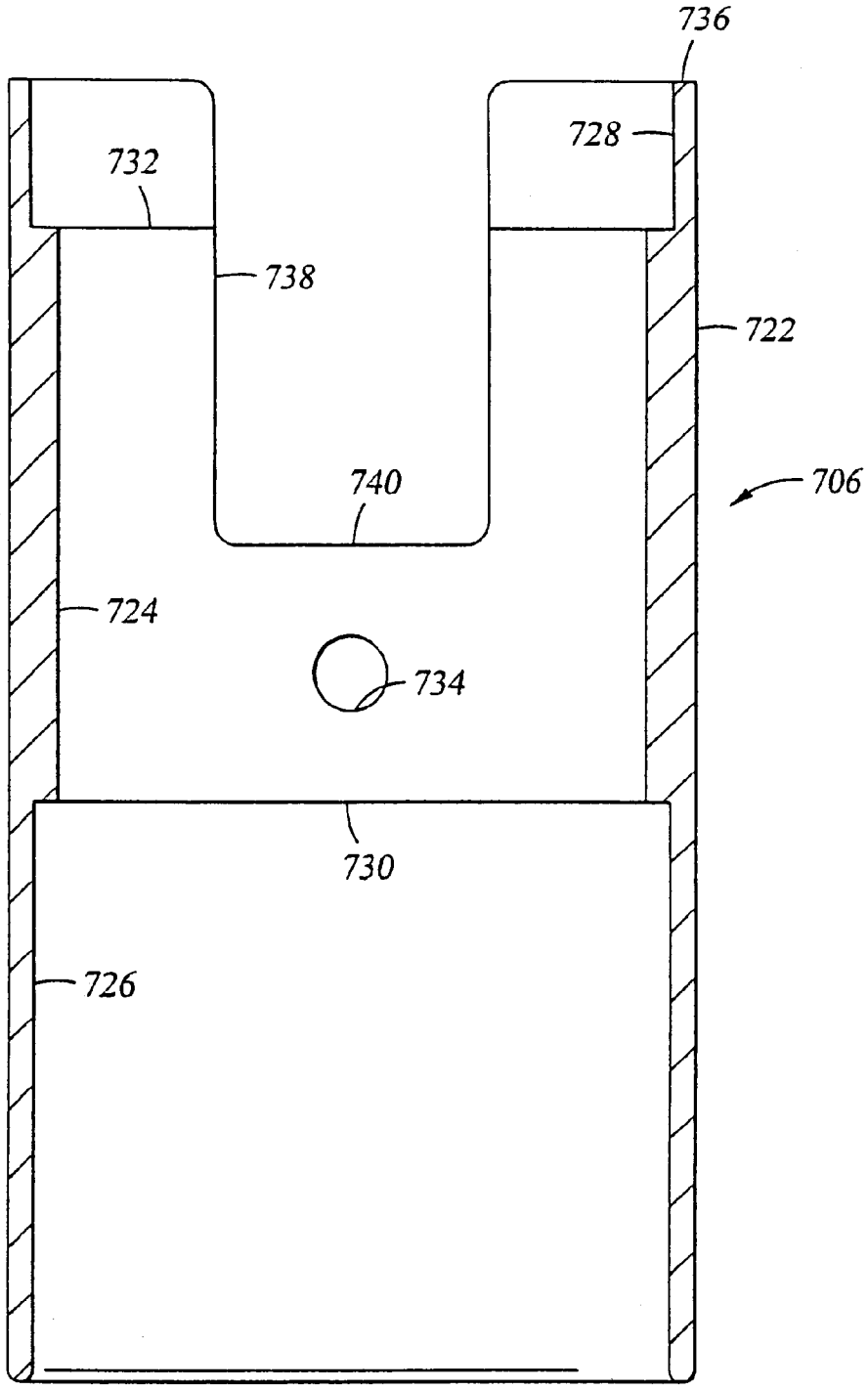
FIG. 19 is a cross-sectional view of an exemplary ratchet lug sleeve for use in the bypass valve assembly of FIGS. 17A–17F.

Details of the ratchet lug sleeve 706 may be appreciated by reference to the cross-sectional view of FIG. 19 as well as FIGS. 17A, 17B, 20, 21 and 22. The ratchet lug sleeve 706 includes a generally tubular body 722 which defines a reduced diameter central bore 724, radially enlarged lower bore 726 and radially enlarged upper bore 728. A downward-facing annular shoulder 730 is formed between the central and lower bores 724, 726, and an upward-facing annular shoulder 732 is formed between the central and upper bores 724, 728. An inwardly-projecting lug 734 is located within the central bore 724, as best shown in FIG. 19. The body 722 presents an upper end 736 which has a number of windows 738. There are preferably three such windows 738 which are equally radially spaced so as to be located 120° from one another. The lower edge of each window 738 provides a sill 740.

With reference to FIGS. 17A and 17B again, it can be seen that the ratchet lug sleeve 706 is retained within ratchet housing 742 between the lower end of the piston retaining sleeve 510 and inwardly, upwardly-directed shoulder 744 which is located on the inner diameter of the ratchet housing 742. The ratchet path sleeve 704 is disposed upon the outer surface of the inner piston 550 between an upper stop face 746 (see FIG. 17A) and a lower, upwardly-directed face 748 (see FIG. 17B). The ratchet path sleeve 704 is disposed within the ratchet lug sleeve 706 so that the lug 734 of the lug sleeve 706 resides within the ratchet path 712 of the ratchet path sleeve. It is pointed out that the ratchet path sleeve 704 can rotate substantially freely about the central axis of the tool 700 with respect to the inner piston 550. Further, the ratchet lug sleeve 706 is also capable of rotating about the central axis of the tool 700 within the ratchet housing 742.

Figure 23:
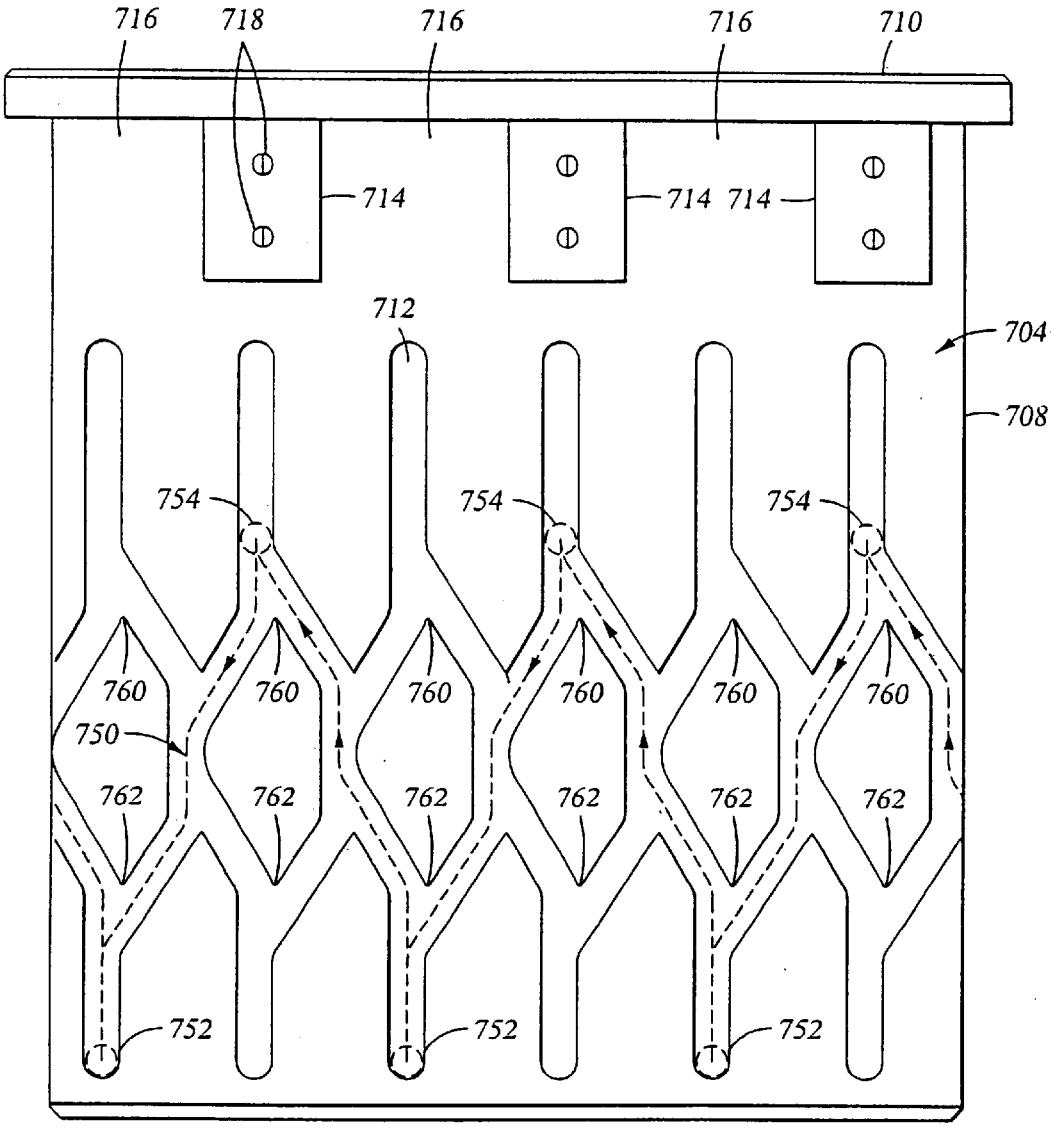
FIG. 23 shows an "unrolled" view of an exemplary ratchet path sleeve with a first path for ratchet operation being shown.
Figure 24:
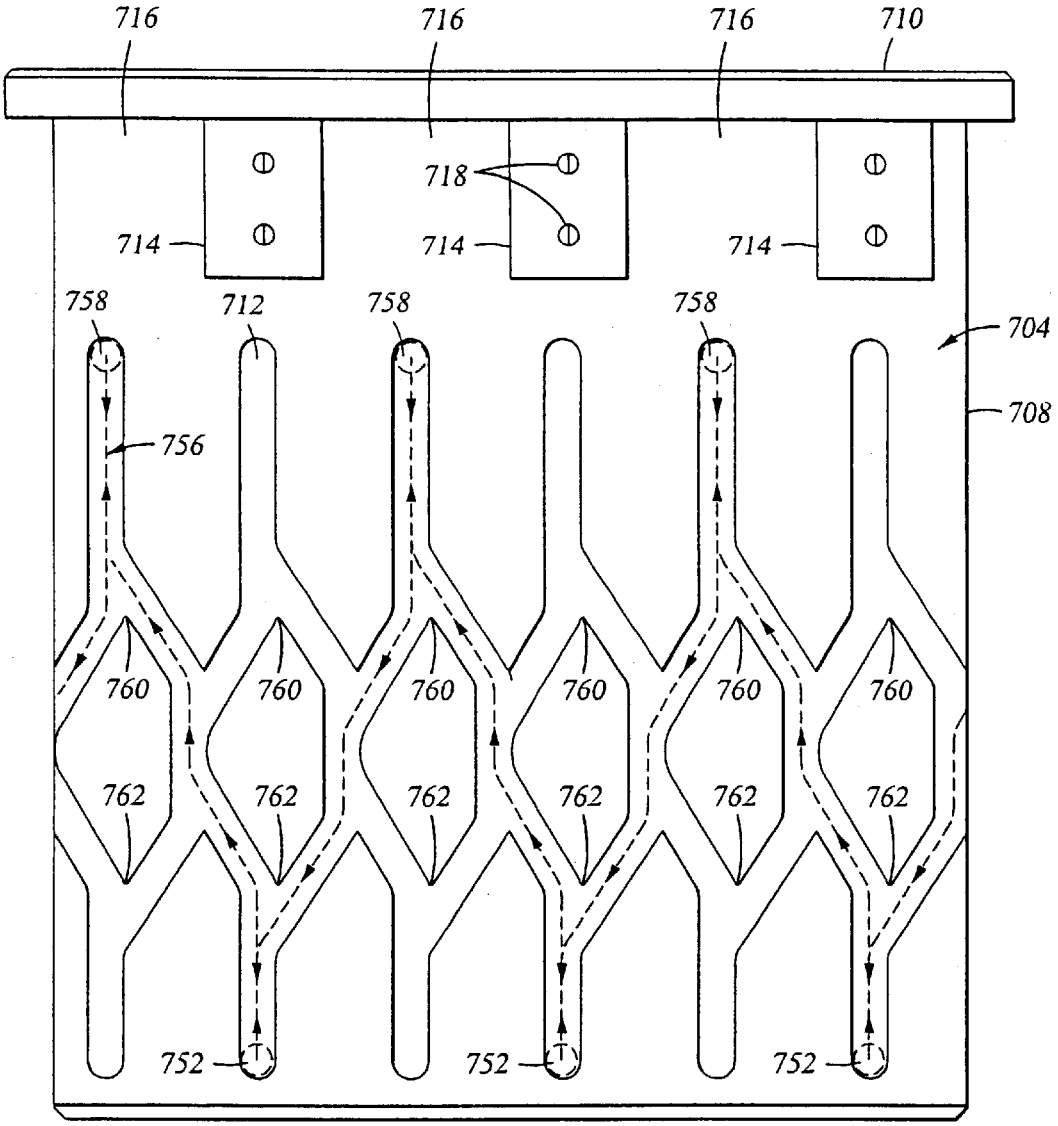
FIG. 24 shows an "unrolled" view of the ratchet path sleeve with a second path for ratchet operation being shown.
Figure 25:
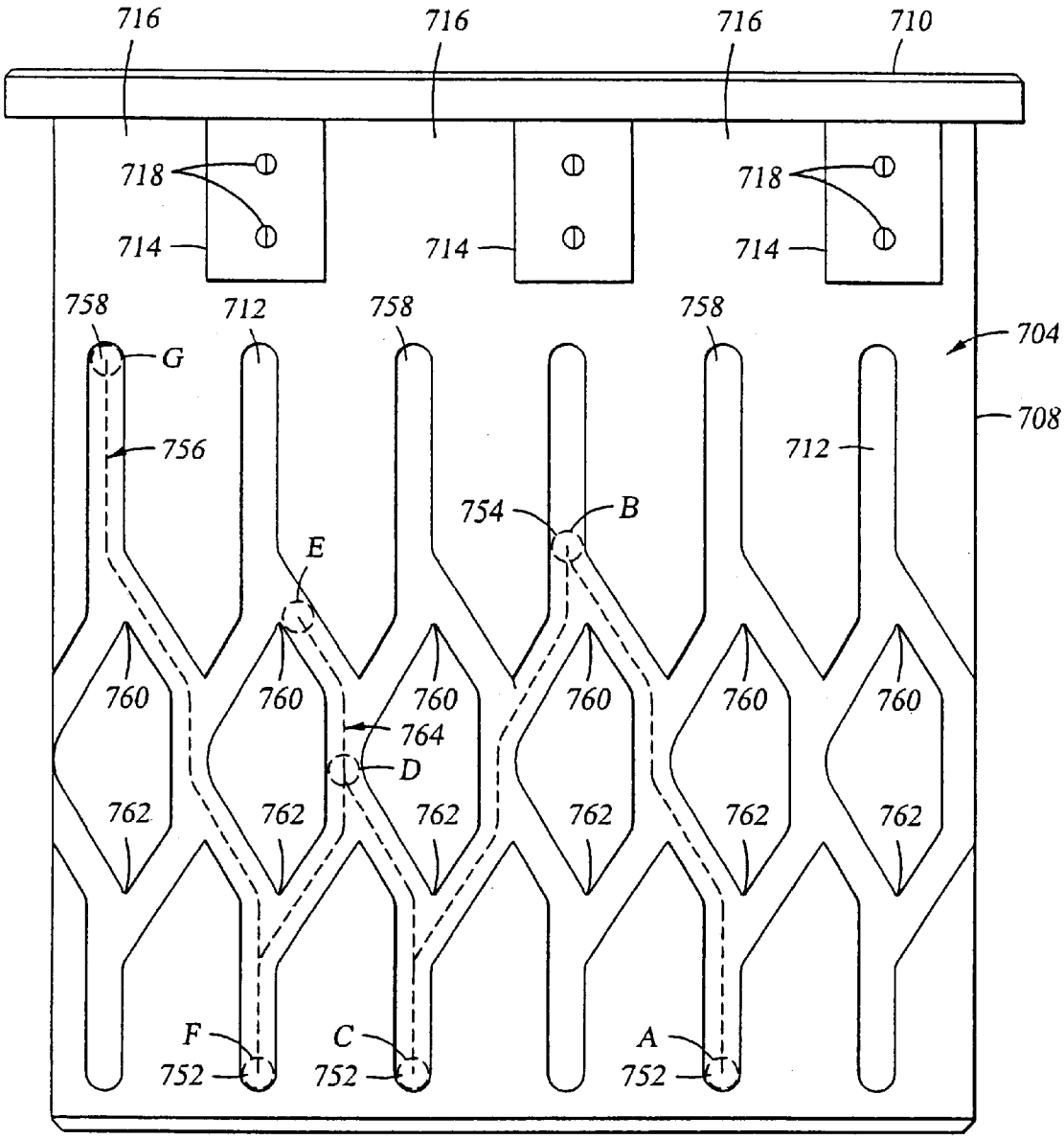
FIG. 25 is also an "unrolled" view of the ratchet path sleeve wherein movement of a lug from the first operation path to the second operation path is illustrated.

FIGS. 23, 24 and 25 all show the ratchet path sleeve 704 in a planar view as if a single lengthwise cut were made in the sleeve 704 and the sleeve 704 were then flattened or "unrolled." This has been done in order to better depict the complete ratchet path 712. FIG. 23 depicts, in phantom lines, a first operational mode path 750 within ratchet path 712 in which potential locations for the lug 734 of the lug sleeve 706 are also depicted in phantom. Specifically, the first mode path 750 includes a number of lower positions 752 for the lug 734 and intermediate-upper positions 754. The intermediate-upper positions 754 are located above the comers 760 on path 712. The lower positions 752 and intermediate-upper positions 754 are interconnected by the first mode path 750 which permits movement of the lug 734 between them in the directions illustrated by the arrows in FIG. 23. The bypass valve assembly 700 is operated in a flow-through mode when the lug 734 travels within the first mode path 750 since relative positioning of the ratchet path sleeve 704 and ratchet lug sleeve 706 does not permit the inner piston 550 to move downwardly sufficiently to close the valve passage 540 to fluid flow. It is pointed out that corners 760 and 762 in the ratchet path 712 ensure that the lug 734 will only move along the path 712 in the unidirectional manner shown by the phantom lines and arrows.

A second operational mode path 756 is illustrated in phantom lines in FIG. 24. This second mode path includes the lower lug positions 752 present in the first mode path 750. Far upper positions 758 are used in the second path 756 and replace the intermediate-upper positions 754 of the first path 750. The bypass valve assembly 700 is operated in a valve control mode when the lug 734 travels within the second mode path 756 because relative positioning of the ratchet path sleeve 704 and ratchet lug sleeve 706 will permit the inner piston 550 to move downwardly so as to close the valve passage 540 to fluid flow. Specifically, the passage 540 will be closed when the lug 734 is located at any of the far upper positions 758 within the ratchet path 712. Again, corners 760 and 762 in the ratchet path 712 ensure that the lug 734 will only move along the path 712 in the unidirectional manner shown by the phantom lines and arrows.

FIG. 25 depicts a transfer of the lug 734 from the first mode path 750 to the second mode path 756. Lug positions in FIG. 25 are designated by consecutive letters to aid in the understanding of the sequence involved. Lug positions A and B are located on the first operational path 750 such that when the lug 734 is moved between these two positions, the ratchet assembly 702 is moved from the configuration depicted in FIG. 20 to the configuration depicted in FIG. 21. As the lug 734 is moved from position B to C, also along the first operational path, the ratchet assembly 702 is moved back again from the configuration shown in FIG. 21 to the configuration shown in FIG. 20.

Lug positions D and E represent the approximate edges of a "window of opportunity" generally shown at 764 within which the lug 734 may be moved out of the first operational mode path 750 and into the second operational mode path 756. It is noted that the window of opportunity 764 is also located between upper corner 760 and lower corner 766. If the wellbore is depressurized by shutting the pumps off while the lug 734 is located within the window of opportunity, the corner 766 deflects the lug 734 along alternate path 768 and to lug position 752, thus redirecting the lug 734 into the second operational mode path 756. It is pointed out that such a window of opportunity 764 is present along every pathway between a lower lug position 752 and intermediate-upper position 754. It should also be understood that similar windows of opportunity are present along the second operational mode path 756 between every lower lug position 752 and far upper lug position 758, thus permitting the lug 734 to be redirected out of the second operational path 756 and back into the first operational path 750.

Operation of the Bypass Valve Assembly 700

Figure 20:
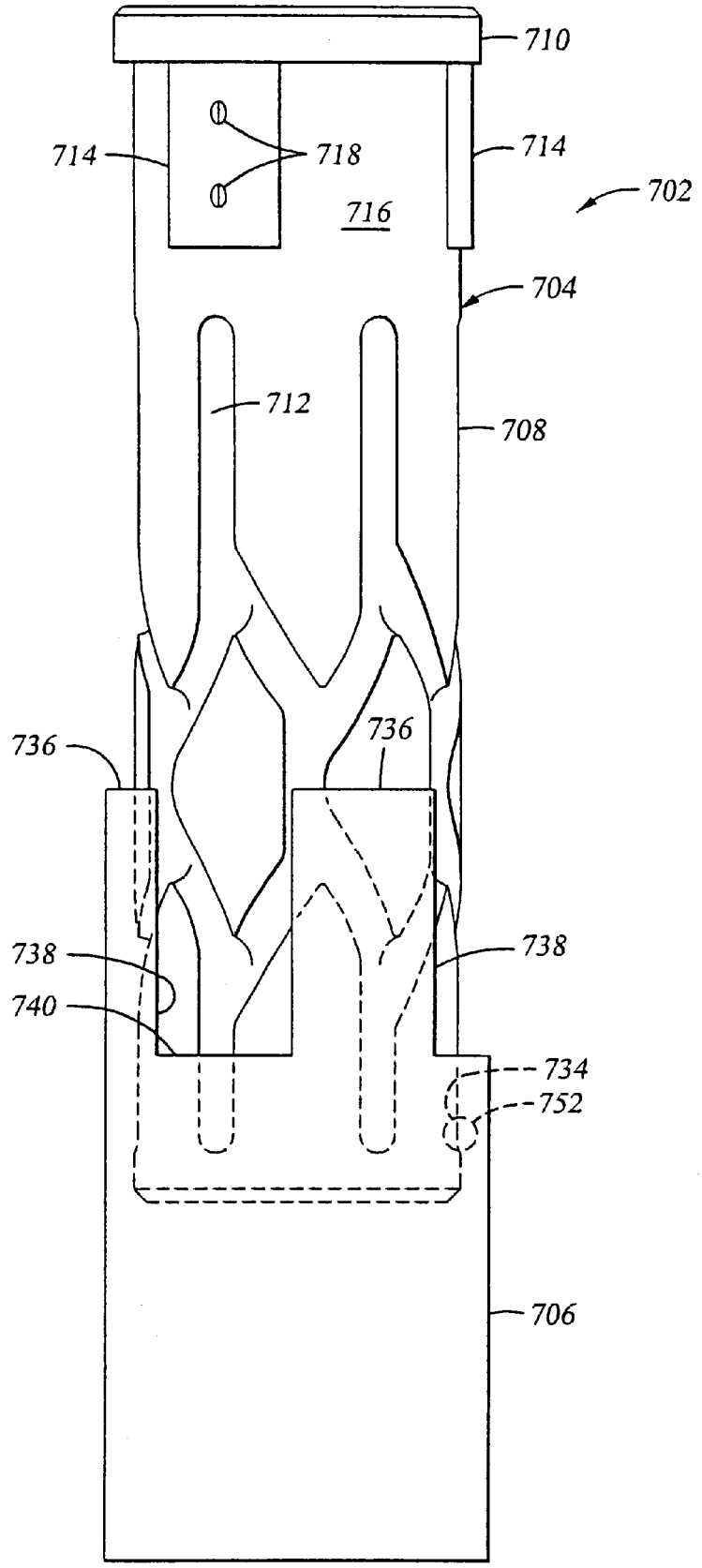
FIG. 20 is an external side view of the ratchet lug sleeve and ratchet path sleeve in a first position relative to one another.
Figure 21:
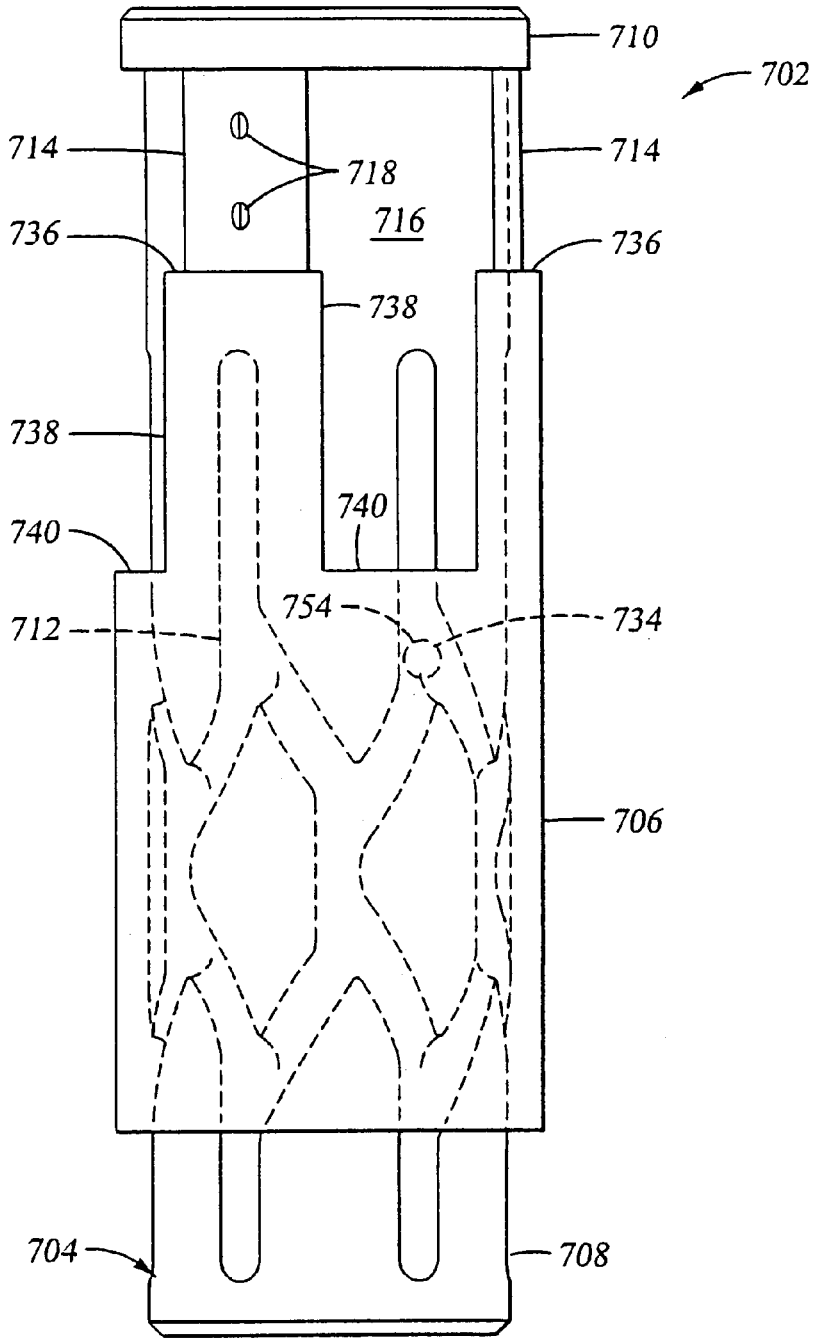
FIG. 21 is an external side view of the ratchet lug sleeve and ratchet path sleeve in a first position relative to one another.
Figure 22:
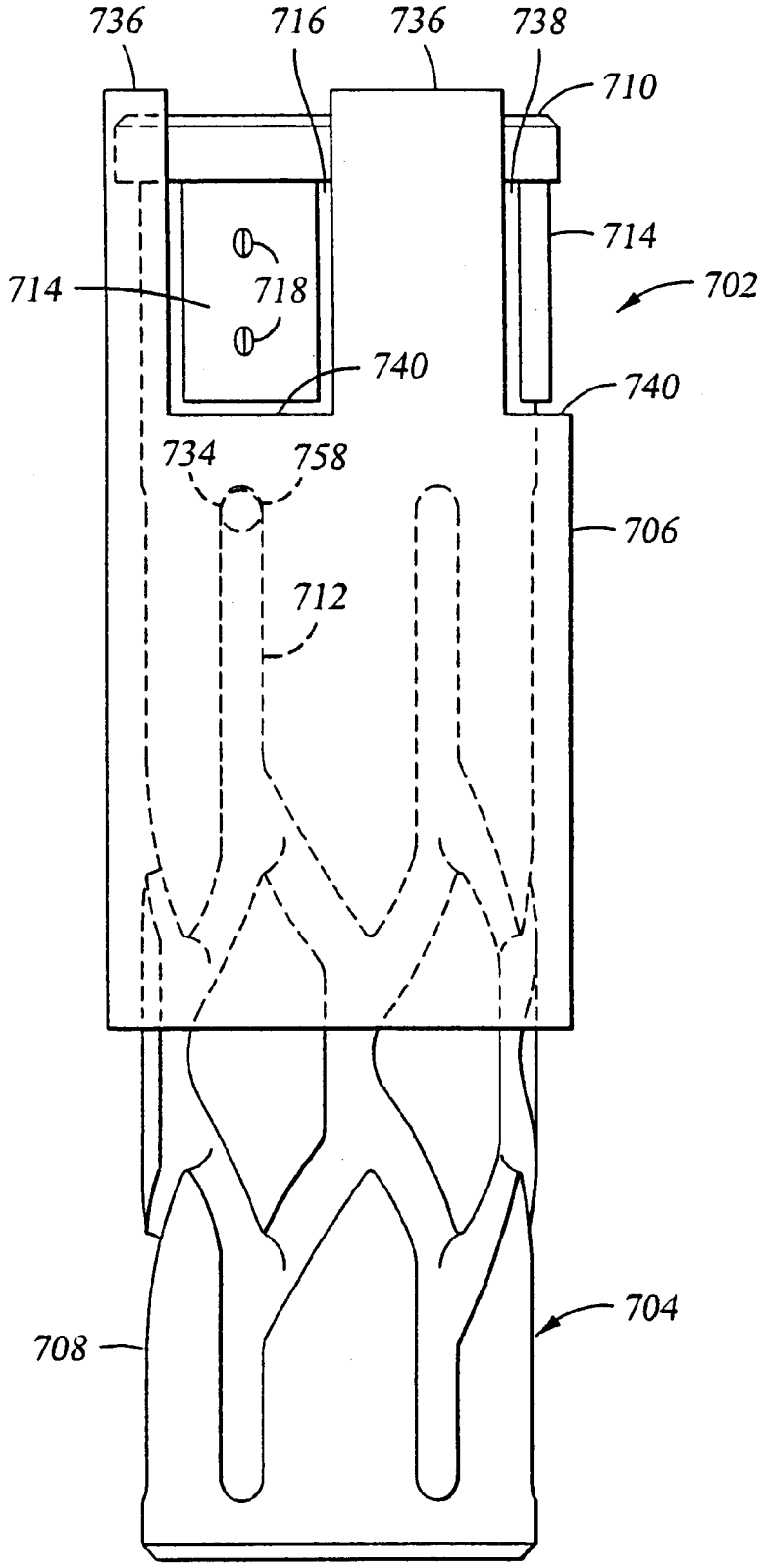
FIG. 22 is an external side view of the ratchet lug sleeve and ratchet path sleeve in a first position relative to one another.

FIGS. 20, 21 and 22 depict only the ratchet path sleeve 704 and ratchet lug sleeve 706 in order to help describe the operation of the ratchet assembly 702 as the inner piston 550 (and ratchet path sleeve 704) is moved axially with respect to the outer housing 502 of the tool 700 (and ratchet lug sleeve 706). In FIG. 20, the lug sleeve 706 is located in a lowermost position with respect to the ratchet path sleeve 704. In this position, the lug 734 is disposed within a lower lug position 752 within the ratchet path 712. Specifically, the lug 734 is placed within the first operational mode path 750. It is also noted that this position corresponds to that depicted for the entire tool 700 in FIGS. 17A–17F. The bypass valve passage 540 is not closed to fluid flow, and pressure within the wellbore is reduced so that the inner piston 550 is located in its furthest upward position with respect to the outer housing 502.

FIG. 21 illustrates the relative positions of the sleeves 704 and 706 as the lug 734 is moved upwardly along the first operational path 750, as the lug sleeve 706 is moved upwardly and rotated with respect to the ratchet path sleeve 704. Movement of the lug 734 toward an intermediate-upper position 754 along the path 750 rotates the ratchet lug sleeve 706 with respect to the ratchet path sleeve 704 and selectively brings into abutting engagement the upper end of the lug sleeve 706 with the lower edges of rectangular plates 714 of the ratchet path sleeve 704. Due to this abutment, the lug sleeve 706 can be moved upward no farther, thus limiting upward movement of the lug 734 to the upper-intermediate lug position 754. The lug 734 is moved to the intermediate-upper position 754 when the wellbore is pressurized so that the inner piston 550 is moved downwardly within the outer housing 502. In this position, the bypass valve passage 540 is not closed to fluid flow.

FIG. 22 depicts the relative positions of the sleeves 704 and 706 when the lug 734 is located in a far upper position 758. At this point, the two sleeves 704, 706 have rotated with respect to one another such that the rectangular plates 714 of the ratchet path sleeve 704 are disposed within the windows 738 of the lug sleeve 706. Upward movement of the lug sleeve 706 with respect to the ratchet path sleeve 704 will be halted when the sills 740 of the windows engage the lower edges of the plates 714. Locating the lug 734 at the far upper position 758 permits the ratchet path sleeve 704 to be moved downwardly to the farthest extent with respect to the ratchet lug sleeve 706, thus causing the bypass valve passage 540 to be closed off by the inner piston 550.

Fluid pulse signals are provided to correspond with the location of the lug 734 within the window of opportunity 764 as well as to provide a warning to the wellbore operator that the lug 734 is about to enter the window of opportunity 734. These pulses occur, as in previously described embodiments, when the annular flange 566 (see FIG. 17E) of the inner piston 550 becomes aligned with flanges 544, 546 and 548. For example, as lug 734 is translated along the first from first operational path 750 to a lower lug position 752 to an upper-intermediate lug position 754, the annular flange 566 will become substantially aligned with upper flange 544 as the inner piston 550 is moved downwardly within the outer housing 502. This alignment would occur as the lug 734 is positioned between lug positions C and D in FIG. 25. The flange 566 will become substantially aligned with the intermediate flange 546 when the lug 734 is located substantially at the position of lug position D. The flange 566 remains aligned with the intermediate flange 546 during the time the lug 734 is translated from position D to position E. The flange 566 will only become aligned with the lower flange 548 when the lug 734 is located between an upper-intermediate lug position 754 and below or proximate an upper lug position 758.

It should be understood that various modifications and changes can be made in the design and operation of the present invention without departing from the spirit thereof. For example, while the methods of remotely actuating downhole components described herein are carried out using devices of hydro-mechanical construction, the same methods could be accomplished using other components designed to accomplish them, including electrical or computerized devices. Rather, than varying fluid pressure within the wellbore to accomplish the steps described, some other controllable parameter might be altered, such as, the weight on the bit, rotation of the drill string and so forth. It should also be understood that the devices described herein could be constructed to have more than two positions or operational modes. As a result, multiple windows of opportunity can be presented and the device could be controlled to move it from the first or second operational mode and into a third, fourth or other subsequent operational mode.

Thus, while principal preferred constructions and modes of operation of the invention have been explained in what are now considered to represent its best embodiments, it should be understood that within the scope of the appended claims, the invention may be practiced otherwise than as specifically illustrated and described.

What is claimed is:

1. A method for controlling operation of a controlled device within a well bore comprising:

a) varying a controllable parameter within the well bore to alter a condition within a controller within the well bore;

b) generating a signal from the controller to the surface indicating that the mode of operation of the controlled device can be changed; and c) selectively changing the mode of operation of the controlled device in response to receiving the signal that the mode of operation of the controlled device can be changed.

2. The method of claim 1 wherein the step of selectively changing the mode of operation further comprises altering the controllable parameter within the well bore to change the mode of operation of the controlled device to a flow through mode.

3. The method of claim 1 wherein the step of selectively changing the mode of operation further comprises altering the controllable parameter within the well bore to change the mode of operation of the controlled device to a value control mode.

4. The method of claim 3 wherein the operation of altering the controllable parameter translates an operating mode sleeve within the controller.

5. The method of claim 1 further comprising changing the component to a subsequent operational mode.

6. The method of claim 1 wherein said step of generating a signal further comprises indicating whether the controller device can be between a valve control mode and a flow through mode.

7. The method of claim 1 wherein said step of generating a signal further comprises indicating that a window of opportunity is present to switch the controller between modes of operation.

8. The method of claim 1 further comprising the step of changing the mode of operation of the controller to a flow through mode.

9. The method of claim 1 further comprising the step of changing the mode of operation of the controller to a valve control mode.

10. The method of claim 9 further comprising the step of manipulating the controllable parameter to selectively actuate the controlled device.

11. A method for controlling operation of a controlled device within a well bore comprising:

a) varying a controllable parameter within the well bore to alter a condition within a controller within the well bore; and b) generating a signal from the controller to the surface indicating that the mode of operation of the controlled device can be changed, the step of generating a signal comprises generating a pressure pulse within a well bore fluid by restricting fluid flow through a portion of the controller.

12. The method of claim 11 wherein the signal is generated by a restriction of fluid flow within the controller to generate a fluid pulse.

13. A method for controlling operation of a controlled device within a well bore comprising:

a) varying a controllable parameter within the well bore to alter a condition within a controller within the well bore; and generating a signal from the controller to the surface indicating that the mode of operation of the controlled device can be changed, wherein the operation of generating a signal further comprises substantially aligning a portion of the controller with a flange and transmitting the signal to a receiver readable at the surface.

14. A method of remotely altering the operational mode of a component within a well bore, comprising:

a) placing a component within the well bore, said component being placed in a first operational mode;

b) moving a first member within the component to a predetermined position;

c) generating a signal indicating that the first member is in the predetermined position; and d) changing the component from the first operational mode to a second operational mode.

15. The method of claim 14 further comprising transmitting the signal to a receiver.

16. The method of claim 14 wherein the operation of changing the component from the first operational mode to the second operational mode comprises moving a second member within the component in response to the signal being received at said receiver to enable actuation of a valve.

17. The method of claim 14 wherein the operation of moving said first member comprises moving a piston to a predetermined position within the component by applying fluid pressure within the wellbore.

18. The method of claim 14 wherein the operation of generating a signal comprises restricting fluid flow through a portion of said component to generate a fluid pulse.

19. The method of claim 14 wherein the first operational mode comprises a flow-through condition wherein fluid flow through the component will not actuate an associated valve.

20. The method of claim 14 wherein the second operational mode comprises a valve operating mode wherein fluid flow through the component will actuate an associated valve.

21. A wellbore flow control apparatus which permits fluid flow therethrough with selective control of an associated valve, the apparatus comprising:

a) a generally cylindrical housing defining a longitudinal fluid flowbore therethrough;

b) an operating mode sleeve disposed within the housing, the sleeve being translatable between a first position, which enables a flow-through mode for the flow control apparatus wherein operation of the associated valve is not possible, and a second position, which enables a valve control mode for the flow control apparatus wherein the associated valve may be selectively operated.

22. The apparatus of claim 21 further comprising a moveable piston disposed within the housing for reciprocable motion therewithin, the piston having an alignment position within the housing, and the operating mode sleeve being translatable between its first and second positions only when the piston is placed in its alignment position.

23. The apparatus of claim 22 further comprising a remote signal generator for generating a signal indicating that the piston is in the alignment position.

24. The apparatus of claim 23 wherein the signal generator further generates signals indicating whether the flow control apparatus is in the flow-through mode or the valve control mode.

25. A wellbore flow control apparatus which permits fluid flow therethrough with selective control of an associated valve, the apparatus comprising:

a generally cylindrical housing defining a longitudinal fluid flowbore therethrough;

an operating mode sleeve disposed within the housing, the sleeve being translatable between a first position, which enables a flow-through mode for the flow control apparatus wherein operation of the associated valve is not possible, and a second position, which enables a valve control mode for the flow control apparatus wherein the associated valve may be selectively operated;

a moveable piston disposed within the housing for reciprocable motion therewithin, the piston having an alignment position within the housing, and the operating mode sleeve being translatable between its first and second positions only when the piston is placed in its alignment position;

a remote signal generator for generating a signal indicating that the piston is in the alignment position; and the remote signal generator comprising a first flange disposed upon the piston and a generally complimentary second flange disposed upon the housing, a signal being generated when the first and second flanges are substantially in alignment with each other.

26. A wellbore flow control apparatus which permits fluid flow therethrough with selective control of an associated valve, the apparatus comprising:

a generally cylindrical housing defining a longitudinal fluid flowbore therethrough;

an operating mode sleeve disposed within the housing, the sleeve being translatable between a first position, which enables a flow-through mode for the flow control apparatus wherein operation of the associated valve is not possible, and a second position which enables a valve control mode for the flow control apparatus wherein the associated valve may be selectively operated;

a moveable piston disposed within the housing for reciprocable motion therewithin, the piston having an alignment position within the housing, and the operating mode sleeve being translatable between its first and second positions only when the piston is placed in its alignment position;

a remote signal generator for generating a signal indicating that the piston is in the alignment position and for generating; and the signal generator further generating a warning signal indicating that the piston is approaching the alignment position.

27. A flow control apparatus for manipulation of downhole hydraulic drilling tools by controlling the access of circulated fluid pressure to an external hydraulic drilling tool, the apparatus comprising:

a) a housing;

b) a piston reciprocably disposed within the housing and movably responsive to fluid pressure, the piston forming a flow-through passage for directing drilling fluid therethrough;

c) a valve associated with the piston for closing off a fluid port that controls fluid flow to an external hydraulic tool; and d) a signal generator that generates a signal indicative of the axial position of the piston within the housing.

28. The apparatus of claim 27 further comprising a fluid metering assembly associated with the piston, the fluid metering assembly comprising:

a) a compression fluid spring which is compressed by movement of the piston in a first direction within the housing;

b) a metering valve which restricts the rate of flow of fluid into and out of the fluid spring to slow the rate of travel of the piston within the housing.

29. The apparatus of claim 27 further comprising a floating positioning sleeve associated with the piston, the positioning sleeve being axially translatable between at least a first position maintaining the valve in a closed position and a second position permitting selective opening of the port to divert the fluid to an external hydraulic tool.

30. The appatatus of claim 29 wherein the floating positioning sleeve further comprises an enlarged annular locating ring shaped and sized to engage a generally complimentary annular groove formed in the housing so that the positioning sleeve is retained in one of said two positions.

31. The apparatus of claim 30 further comprising a first annular groove formed in the housing shaped and sized to engage the enlarged annular locating ring such that engagement of the ring in the first groove retains the positioning sleeve in its first position.

32. The apparatus of claim 31 further comprising a second annular groove formed in the housing shaped and sized to engage the enlarged annular locating ring such that engagement of the ring in the second groove retains the positioning sleeve in the second position.

33. The apparatus of claim 29 wherein placement of the positioning sleeve in said first position limits movement of the piston within the housing in one axial direction.

34. The apparatus of claim 29 further comprising a catch sleeve affixed to the piston, the catch sleeve having surfaces which are generally complimentary to those of the positioning sleeve to engage and translate the positioning sleeve.

35. An apparatus disposed downhole in a string of pipe extending to the surface comprising:

a first member;

a second member moveably mounted on said first member and having a plurality of positions with respect to said first member;

a signal transmitted to the surface at each of said positions; and said second member being selectively operable from the surface after said second member reaches a predetermined one of said positions to change the apparatus from a first mode to a second mode of operation.

36. The apparatus of claim 35 wherein said first member is a housing and said second member is a piston reciprocably disposed within said housing.

37. The apparatus of claim 36 wherein said piston and housing form a flowpath and said piston and housing form a restriction to said flowpath at each of said positions causing an increase in fluid pressure at the surface.

38. The apparatus of claim 36 wherein a signal is selectively transmitted from the surface causing said piston to change from said first mode to said second mode.

39. The apparatus of claim 38 wherein a signal is transmitted to the surface upon the initiation of fluid flow through the apparatus.

40. The apparatus of claim 36 wherein said signal transmitted from the surface is caused by the termination of flow through the apparatus.

41. A method for controlling a controlled device within a wellbore, comprising:

adjusting a controller within the well bore between a valve control mode and a flow through mode;

generating a signal from the controller to provide a window of opportunity during which the controlled device can be moved between a valve control mode and a flow through mode; and selectively changing the mode of operation of the controlled device in response to receiving the signal that the mode of operation of the controlled device can be changed.

42. The method of claim 41 further comprising manipulating the controller when the controller is in the valve control mode to selectively actuate the controlled device.

43. A method for controlling a downhole tool, comprising:

placing a piston within a well bore in a first or second position;

providing to the surface a window of opportunity during which the piston can be moved into or out of the first or second position; and selectively actuating a valve assembly disposed on the piston by adjusting fluid flow within the well bore when a signal is received that the piston is in the appropriate of the first or second positions to selectively activate the downhole tool.

44. A method for controlling a downhole tool, comprising:

placing a piston within a well bore in a first or second position;

indicating to the surface whether the piston is in the first or second position; and adjusting fluid flow within the well bore when the piston is in the appropriate position to selectively active the downhole tool, the operation of indicating including generating pressure spikes by restricting fluid flow in the bore.

45. A control assembly for controlling operation of a tool in a well bore, comprising:

a sleeve having at least one inwardly projecting flange;

a piston having an annular projection at its lowermost portion, said piston slid ably engaged within said sleeve and;

a mode control component for altering the mode of operation of said piston from a flow through mode to a valve control mode, said mode control component slidably engaged within said sleeve.

46. The apparatus of claim 45 wherein a signal is generated when said inwardly projecting flange aligns with said annular projection.

47. The apparatus of claim 46 wherein said signal is generated to be readable at the surface.

48. The apparatus of claim 45 wherein said sleeve includes three inwardly projecting flanges.

49. The apparatus of claim 48 where a signal is generated when said annular projection aligns with each of said three inwardly projecting flanges.

50. The apparatus of claim 48 wherein said inwardly projecting flanges include an upper flange, a middle flange, and a lower flange.

51. The apparatus of claim 50 wherein:

a first signal is generated when said annular projection aligns with said upper flange, said first signal warning that change of the mode of operation of said piston may occur;

a second signal is generated when said annular projection aligns with said middle flange, said second signal indicating to move said piston out of the flow through mode and into the valve control mode; and a third signal is generated when said annular projection aligns with said lower flange, said third signal indicating that said piston is in the valve control mode.

52. A method for controlling operation of a controlled device within a well bore comprising:

a) varying a controllable parameter within the well bore to alter a condition within a controller within the well bore; and b) generating a signal from the controller to the surface indicating that the mode of operation of the controlled device can be changed, wherein said step of generating a signal further comprises indicating whether the controller device can be changed between a valve control mode and a flow through mode, and wherein said valve control mode allows selective actuation of the controlled device upon manipulation of the controllable parameter and said flow through mode prevents actuation of the controlled device upon manipulation of the controllable parameter.

* * * * *

UNITED STATES PATENT AND TRADEMARK OFFICE
Certificate

Patent No. 6,289,999

Patented: September 18, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Charles H. Dewey, Houston, TX; Wei Xu, Houston, TX; James E. Saylor III, Kingwood, TX; and Gayle Wind Shearer, Humble, TX.

Signed and Sealed this Eleventh Day of June 2002.

DAVID J. BAGNELL
*Supervisory Patent Examiner*
Art Unit 3672